US011819896B2

(12) United States Patent
Yamaguchi et al.

(10) Patent No.: US 11,819,896 B2
(45) Date of Patent: Nov. 21, 2023

(54) METHOD FOR IDENTIFYING THRUST COUNTERFORCE WORKING POINT POSITIONS AND METHOD FOR ROLLING ROLLED MATERIAL

(71) Applicant: NIPPON STEEL CORPORATION, Tokyo (JP)

(72) Inventors: Kazuma Yamaguchi, Tokyo (JP); Atsushi Ishii, Tokyo (JP); Daisuke Nikkuni, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 251 days.

(21) Appl. No.: 17/259,447

(22) PCT Filed: Aug. 8, 2019

(86) PCT No.: PCT/JP2019/031437

§ 371 (c)(1),
(2) Date: Jan. 11, 2021

(87) PCT Pub. No.: WO2020/036123

PCT Pub. Date: Feb. 20, 2020

(65) Prior Publication Data

US 2021/0387241 A1 Dec. 16, 2021

(30) Foreign Application Priority Data

Aug. 13, 2018 (JP) ..... 2018-152179
Mar. 13, 2019 (JP) ..... 2019-045718

(51) Int. Cl.
*B21B 38/08* (2006.01)
*B21B 13/02* (2006.01)

(52) U.S. Cl.
CPC ..... *B21B 38/08* (2013.01); *B21B 2013/025* (2013.01)

(58) Field of Classification Search
CPC ... B21B 38/08; B21B 2013/025; B21B 31/24; B21B 31/18; B21B 31/185; B21B 37/58;
(Continued)

(56) References Cited

U.S. PATENT DOCUMENTS 5,666,837 A * 9/1997 Kajiwara ..... B21B 13/023 72/236
6,401,506 B1 6/2002 Ogawa et al.
2013/0000371 A1 1/2013 Kasai et al.

FOREIGN PATENT DOCUMENTS

JP 55-156610 A 12/1980
JP 2009-178754 A 8/2009
(Continued)

*Primary Examiner* — Katrina M Stransky
*Assistant Examiner* — Teresa A Guthrie
(74) *Attorney, Agent, or Firm* — Birch, Stewart, Kolasch & Birch, LLP

(57) ABSTRACT

There is provided a method for identifying thrust counterforce working point positions of backup rolls of a rolling mill, the method including: changing at least either friction coefficients and inter-roll cross angles between the rolls with an unchanged kiss roll load to cause thrust forces at a plurality of levels to act between the rolls, and measuring thrust counterforces in a roll-axis direction acting on rolls forming at least one of roll pairs other than a roll pair of the backup rolls and measuring backup roll counterforces acting in a vertical direction on the backup rolls at reduction support positions in a kiss roll state; and identifying, based on the measured thrust counterforces, thrust counterforce working point positions of thrust counterforces acting on the backup rolls, using first equilibrium conditional expressions relating to forces acting on the rolls and second equilibrium conditional expressions relating to moments acting on the rolls.

14 Claims, 19 Drawing Sheets

(58) Field of Classification Search
CPC . B21B 37/60; B21B 2265/12; B21B 2269/14; B21B 45/002; B21B 45/0251; B21B 2267/10
USPC ..... 74/14.4, 10.4; 72/14.4, 10.4
See application file for complete search history.

(56) References Cited

FOREIGN PATENT DOCUMENTS

| | | | |
|---|---|---|---|
| JP | 2014-4599 | A | 1/2014 |
| WO | WO 99/43452 | A1 | 9/1999 |
| WO | WO 2017/129453 | A1 | 10/2011 |

* cited by examiner

METHOD FOR IDENTIFYING THRUST COUNTERFORCE WORKING POINT POSITIONS AND METHOD FOR ROLLING ROLLED MATERIAL

TECHNICAL FIELD

The present invention relates to a method for identifying thrust counterforce working point positions in a rolling mill and a method for rolling a rolled material.

BACKGROUND ART

One of major issues in rolling operation on a metal plate material is to equalize an elongation percentage of a rolled material between its work side and drive side. If the elongation percentage of the rolled material is made uneven between its work side and drive side, the unevenness can cause zigzagging resulting in threading trouble, camber resulting in poor shaping, or the like. In order to make elongation percentage of a rolled material even between its work side and the drive side, a difference between a reduction position on the work side of the rolling mill and a reduction position on the drive side of the rolling mill, that is, leveling is corrected.

For example, Patent Document 1 discloses a technique that corrects leveling based on a ratio of a difference in load-cell-measured vertical-direction load of a rolling mill between its work side and drive side to a sum of the load-cell-measured vertical-direction loads on the work side and the drive side. However, the difference in the load-cell-measured vertical-direction load of the rolling mill between its work side and drive side includes, as a disturbance, a thrust force that acts in a roll-axis direction between rolls that are disposed being in contact to each other. For example, in a case of a four-high rolling mill, a thrust force acts in the roll-axis direction between a work roll and a backup roll. In a case of a six-high rolling mill, thrust forces act in the roll-axis direction between a work roll and an intermediate roll and between the intermediate roll and a backup roll.

Hence, for example, Patent Document 2 discloses a technique that isolates a thrust force being a disturbance of a difference in load-cell-measured vertical-direction load of a rolling mill between a work side and a drive side to set a reduction position of the rolling mill and control the reduction position. In a sheet rolling method described in Patent Document 2, upper and lower backup rolls and upper and lower work rolls are tightened in a contact state, and thrust counterforces in a roll-axis direction acting on all of the rolls other than at least the backup rolls are measured, and backup roll counterforces acting on the upper and lower backup rolls at their reduction support positions in a vertical direction are measured. Then, based on measured values of the thrust counterforces and the backup roll counterforces, at least one of a zero point of a pressing-down device and deformation characteristics of a plate mill is computed, and based on a result of the computation, reduction position setting or reduction position control in performing rolling is performed.

LIST OF PRIOR ART DOCUMENTS

Patent Document

Patent Document 1: JP55-156610A
Patent Document 2: WO 1999/043452
Patent Document 3: JP2014-4599A

SUMMARY OF INVENTION

Technical Problem

In the technique described in Patent Document 2, the thrust counterforces acting on the rolls other than at least the backup rolls and the backup roll counterforces acting on the upper and lower backup rolls at their reduction support positions are measured in a kiss roll tightening in which the rolls are tightened in the contact state, or during rolling. Here, the thrust counterforce is a counterforce of each roll for holding the roll at its position by resisting a resultant force of thrust forces that are produced on contact surfaces between body portions of rolls due mainly to presence of minute crosses between the rolls. The thrust counterforce can be measured using, for example, a device that senses directly a load acting on a thrust bearing in a roll chock or a device that senses the load indirectly by sensing force acting on a structure such as a keeper plate fixing the roll chock in the roll-axis direction. However, the backup roll receives heavy loads from not only the keeper plate but also a pressing-down device and a roll balance system, and frictional force due to these perpendicular-direction loads can be part of the thrust counterforce. Hence, a working point position of a thrust counterforce to a backup roll resisting a resultant force of thrust forces that are produced on contact surfaces between body portions of rolls due to presence of minute crosses (hereinafter, referred to as "thrust counterforce working point position") is generally unknown.

Hence, according to the technique described in Patent Document 2, known thrust forces are caused to act on the backup rolls to measure a lateral asymmetry in load-cell-measured perpendicular-direction load, with rolls other than backup rolls being taken out and vertical-direction loads being applied to body portions of the backup rolls. Then, based on the measured lateral asymmetry in load-cell-measured vertical-direction load, the thrust counterforce working point positions of the backup rolls are identified from the equilibrium expressions relating to forces and moments.

However, it is necessary for the technique described in Patent Document 2 to take out the rolls other than the backup rolls and use calibration equipment to cause the known thrust forces to act on the backup rolls, and thus the technique can be performed only in a time of changing work rolls or the like.

Hence, the present invention is made in view of the problems and has an objective to provide a novel, improved method for identifying thrust counterforce working point positions of a backup roll and a method for rolling a rolled material that are easily feasible even in a time other than a time of changing work rolls such as an idling time of a rolling mill.

Solution to Problem

There is provided a method for identifying thrust counterforce working point positions in a rolling mill, the rolling mill being a rolling mill of four-high or more with a plurality of rolls, the rolling mill of four-high or more including a plurality of roll pairs that include at least a pair of work rolls and at least a pair of backup rolls supporting the work rolls, the method including: a first step of causing thrust forces at a plurality of levels to act between the rolls with an unchanged kiss roll load by changing at least either friction coefficients between the rolls or inter-roll cross angles between the rolls, and at each of the plurality of levels of thrust force; measuring thrust counterforces in a roll-axis direction acting on rolls forming at least any one of roll pairs other than a roll pair of the backup rolls and measuring backup roll counterforces acting in a vertical direction on the backup rolls at reduction support positions in a kiss roll state in which the rolls are brought into tight contact by a pressing-down device; and a second step of identifying, based on the measured thrust counterforces and backup roll counterforces acting on the rolls, thrust counterforce working point positions of thrust counterforces acting on the backup rolls, using first equilibrium conditional expressions relating to forces acting on the rolls and second equilibrium conditional expressions relating to moments produced in the rolls.

In the first step, the thrust counterforces in the roll-axis direction acting on rolls forming all of the roll pairs other than the roll pair of the backup rolls may be measured, and the backup roll counterforces acting in the vertical direction on the backup rolls may be measured at the reduction support positions of the backup rolls.

The rolling mill may be a four-high rolling mill that can cross a roll-axis direction of an upper roll assembly including at least its upper work roll and its upper backup roll and a roll-axis direction of a lower roll assembly including at least its lower work roll and its lower backup roll. At this time, in the first step, the thrust forces at the plurality of levels are caused to act between the rolls by changing the inter-roll cross angle between the upper work roll and the lower work roll.

Alternatively, the rolling mill may be a rolling mill that includes external-force applying devices that apply different rolling-direction external forces to a work-side roll chock and a drive-side roll chock of at least any one of its rolls. At this time, in the first step, by applying different rolling-direction external forces to the work-side roll chock and the drive-side roll chock of the roll including the external-force applying devices, the inter-roll cross angle of the roll is changed with respect to an entire roll assembly to cause the thrust forces at the plurality of levels to act between the rolls.

In addition, in the second step, based on a result of identifying the thrust counterforce working point positions of the backup rolls at the plurality of levels of thrust force, a relation between the kiss roll load and the thrust counterforce working point positions may be acquired in a kiss roll state at each of a plurality of levels of the kiss roll load.

According to another aspect of the present invention, to solve the problems, there is provided a method for rolling a rolled material, including: identifying the thrust counterforce working point positions of the backup rolls by the method for identifying thrust counterforce working point positions; measuring the thrust counterforces in the roll-axis direction acting on rolls forming all of the roll pairs other than the roll pair of the backup rolls and measuring the backup roll counterforces acting in the vertical direction on the backup rolls at the reduction support positions of the backup rolls, in the kiss roll state in which the rolls are brought into tight contact by the pressing-down device; computing at least either a zero point position of the pressing-down device or a deformation characteristic of the rolling mill based on measured values of the thrust counterforces, measured values of the backup roll counterforces, and the identified thrust counterforce working point positions of the backup rolls; and setting a reduction position for the pressing-down device in performing rolling based on a result of the computation.

According to still another aspect of the present invention, to solve the problems, there is provided a method for rolling a rolled material, including: identifying the thrust counterforce working point positions of the backup rolls beforehand by the method for identifying thrust counterforce working point positions; measuring a thrust counterforce in a roll-axis direction acting on a roll other than a backup roll in at least either an upper roll assembly including an upper work roll and an upper backup roll or a lower roll assembly including a lower work roll and a lower backup roll, and measuring backup roll counterforces acting in a vertical direction on a backup roll at reduction support positions in at least a roll assembly for which the thrust counterforce is measured, during rolling the rolled material; computing a target value of a reduction position control input corresponding to a rolling load based on the measured values of the thrust counterforces, the measured values of the backup roll counterforces, and the identified thrust counterforce working point positions of the backup rolls; and controlling the reduction position using the pressing-down device based on the target value of the reduction position control input.

According to another aspect of the present invention, to solve the problems, there is provided a method for rolling a rolled material, including: identifying the thrust counterforce working point positions of the backup rolls beforehand by the method for identifying thrust counterforce working point positions; measuring a thrust counterforce in a roll-axis direction acting on a roll other than a backup roll in at least either an upper roll assembly including an upper work roll and an upper backup roll or a lower roll assembly including a lower work roll and a lower backup roll, and measuring backup roll counterforces acting in a vertical direction on a backup roll at reduction support positions in at least a roll assembly for which the thrust counterforce is measured, during rolling the rolled material; computing an asymmetry in roll-axis direction distribution of the rolling load acting between the rolled material and the work rolls with at least a thrust force acting between a backup roll and a roll being in contact with the backup roll taken into consideration based on the measured values of the thrust counterforces, the measured values of the backup roll counterforces, and the identified thrust counterforce working point positions of the backup rolls, and computing a target value of a reduction position control input corresponding to a rolling load based on a result of the computation; and controlling the reduction position using the pressing-down device based on the target value of the reduction position control input.

The rolling mill may be a six-high rolling mill that includes three roll pairs including a pair of work rolls, a pair of intermediate rolls supporting the work rolls, and a pair of backup rolls, and in the first step, the thrust counterforces in the roll-axis direction acting on rolls forming a roll pair being either the roll pair of the intermediate rolls or the roll pairs of the work rolls may be measured, and the backup roll counterforces acting in the vertical direction on the backup rolls may be measured at the reduction support positions of the backup rolls.

The rolling mill may include external-force applying devices that apply different rolling-direction external forces to a work-side roll chock and a drive-side roll chock of at least one of its rolls, and in the first step, by applying different rolling-direction external forces to the work-side roll chock and the drive-side roll chock of the roll including the external-force applying devices, the inter-roll cross angle of the roll is changed with respect to an entire roll assembly to cause the thrust forces at the plurality of levels to act between the rolls.

In addition, in the second step, based on a result of identifying the thrust counterforce working point positions of the backup rolls at the plurality of levels of thrust force, a relation between the kiss roll load and the thrust counterforce working point positions may be acquired in a kiss roll state at each of a plurality of levels of the kiss roll load.

According to another aspect of the present invention, to solve the problems, there is provided a method for rolling a rolled material, including: identifying the thrust counterforce working point positions of the backup rolls by the method for identifying thrust counterforce working point positions in a six-high rolling mill; measuring the thrust counterforces in the roll-axis direction acting on rolls forming a roll pair being either a roll pair of the intermediate rolls or a roll pair of the work rolls and measuring the backup roll counterforces acting in the vertical direction on the backup rolls at the reduction support positions of the backup rolls, in the kiss roll state in which the rolls are brought into tight contact by the pressing-down device; computing at least either a zero point position of the pressing-down device or a deformation characteristic of the rolling mill based on measured values of the thrust counterforces, measured values of the backup roll counterforces, and the identified thrust counterforce working point positions of the backup rolls; and setting a reduction position for the pressing-down device in performing rolling based on a result of the computation.

According to still another aspect of the present invention, to solve the problems, there is provided a method for rolling a rolled material, including: identifying the thrust counterforce working point positions of the backup rolls beforehand by the method for identifying thrust counterforce working point positions in a six-high rolling mill; measuring a thrust counterforce in a roll-axis direction acting on either an intermediate roll or a work roll in either an upper roll assembly including an upper work roll, an upper intermediate roll, and an upper backup roll or a lower roll assembly including a lower work roll, a lower intermediate roll, and a lower backup roll, and measuring backup roll counterforces acting in a vertical direction on a backup roll at reduction support positions in at least a roll assembly for which the thrust counterforce is measured, during rolling the rolled material; computing a target value of a reduction position control input corresponding to a rolling load based on the measured values of the thrust counterforces, the measured values of the backup roll counterforces, and the identified thrust counterforce working point positions of the backup rolls; and controlling the reduction position using the pressing-down device based on the target value of the reduction position control input.

According to another aspect of the present invention, to solve the problems, there is provided a method for rolling a rolled material, including: identifying the thrust counterforce working point positions of the backup rolls beforehand by the method for identifying thrust counterforce working point positions in a six-high rolling mill; measuring a thrust counterforce in a roll-axis direction acting on either an intermediate roll or a work roll in either an upper roll assembly including an upper work roll, an upper intermediate roll, and an upper backup roll or a lower roll assembly including a lower work roll, a lower intermediate roll, and a lower backup roll, and measuring backup roll counterforces acting in a vertical direction on a backup roll at reduction support positions in at least a roll assembly for which the thrust counterforce is measured, during rolling the rolled material; computing an asymmetry in roll-axis direction distribution of the rolling load acting between the rolled material and the work rolls with at least a thrust force acting between a backup roll and a roll being in contact with the backup roll taken into consideration based on the measured values of the thrust counterforces, the measured values of the backup roll counterforces, and the identified thrust counterforce working point positions of the backup rolls, and computing a target value of a reduction position control input corresponding to a rolling load based on a result of the computation; and controlling the reduction position using the pressing-down device based on the target value of the reduction position control input.

Advantageous Effects of Invention

As described above, according to the present invention, thrust counterforce working point positions of backup rolls can be easily identified even in a time other than a time of changing work rolls such as an idling time of a rolling mill.

DESCRIPTION OF EMBODIMENTS

Figure 1A:
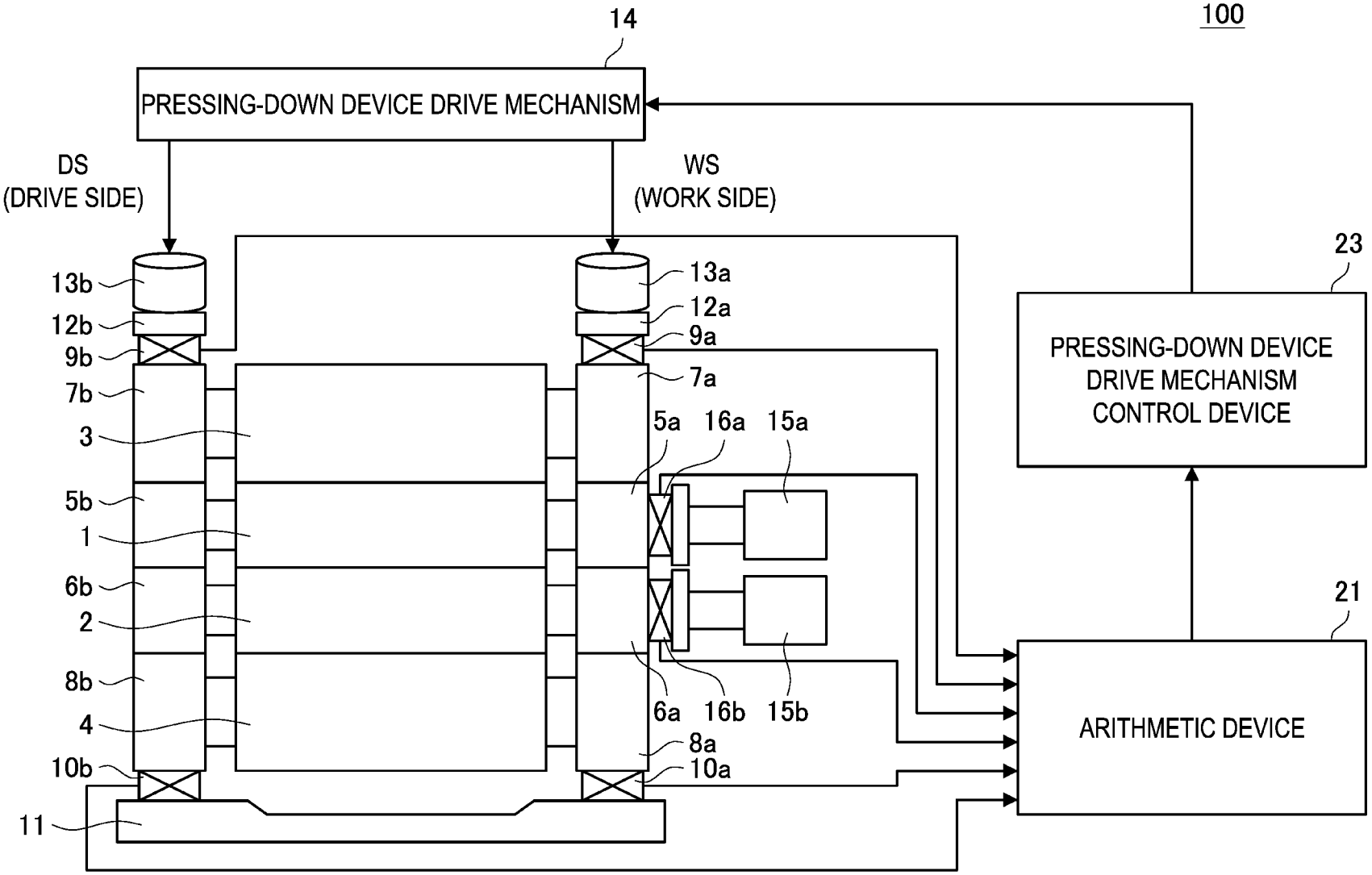
FIG. 1A is an explanatory diagram illustrating a configuration example of a four-high rolling mill.

A preferred embodiment of the present invention will be described below in detail with reference to the accompanying drawings. In the present specification and drawings, components having substantially the same functions and structures are denoted by the same reference characters, and the repeated description thereof will be omitted.

1. Method for Identifying Thrust Counterforce Working Point Positions of Backup Rolls

[1-1. Configuration of Rolling Mill]

Figure 1B:
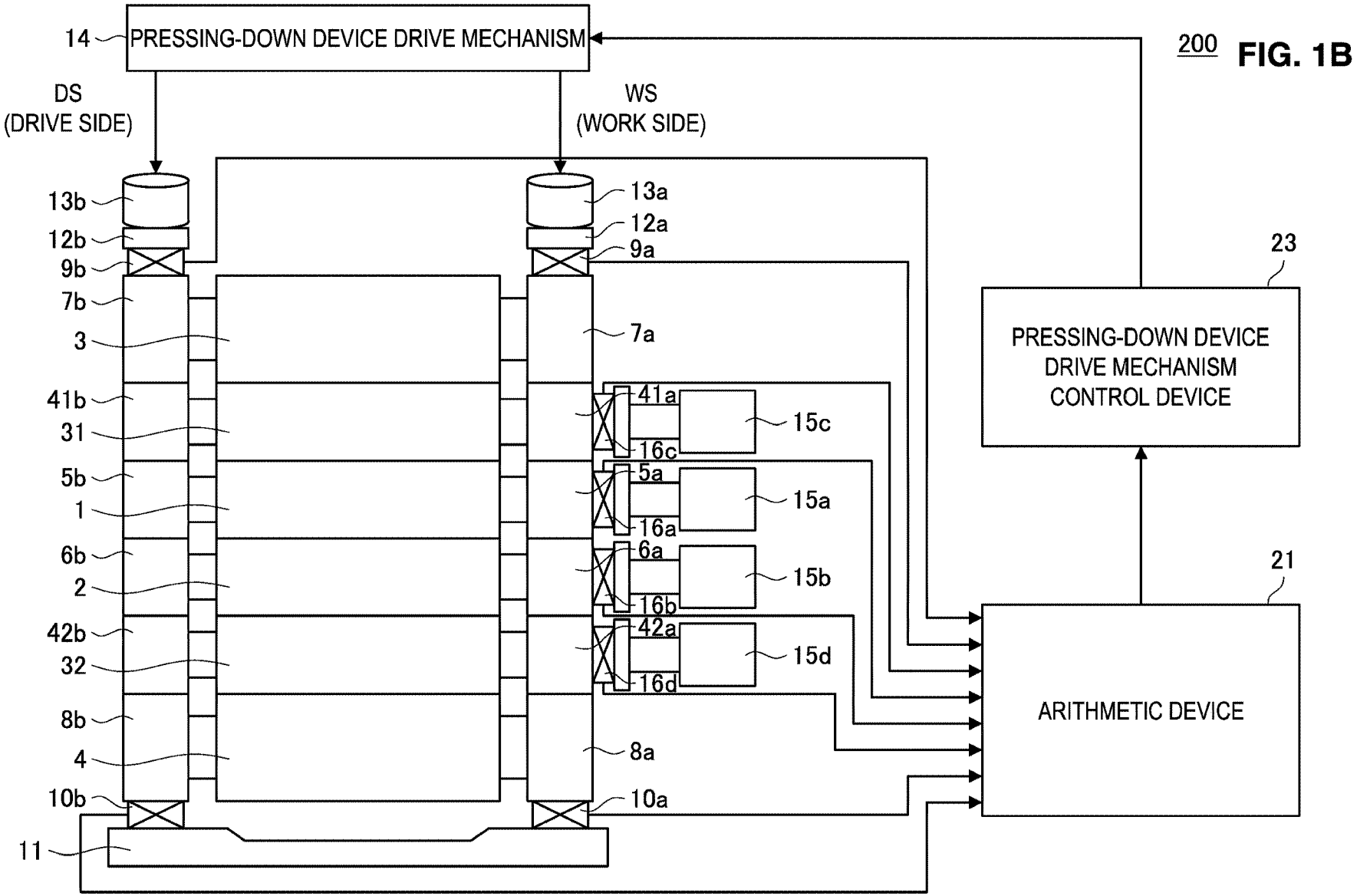
FIG. 1B is an explanatory diagram illustrating a configuration example of a six-high rolling mill.

First, a schematic configuration of a rolling mill to which a method for identifying thrust counterforce working point positions of backup rolls according to an embodiment of the present invention will be described with reference to FIG. 1A and FIG. 1B. FIG. 1A is an explanatory diagram illustrating a configuration example of a four-high rolling mill. FIG. 1B is an explanatory diagram illustrating a configuration example of a six-high rolling mill. The present invention is applicable to a rolling mill of four-high or more with a plurality of rolls that includes a plurality of roll pairs including at least a pair of work rolls and at least a pair of backup rolls supporting the work rolls. In FIG. 1A and FIG. 1B, in the roll-axis direction, a work side is denoted as WS, and a drive side is denoted as DS.

(Configuration of Four-High Rolling Mill)

A rolling mill 100 illustrated in FIG. 1A is a four-high rolling mill that includes a pair of work rolls 1 and 2 and a pair of backup rolls 3 and 4 supporting the work rolls 1 and 2. The upper work roll 1 is supported by upper work roll chocks 5*a* and 5*b*, and the lower work roll 2 is supported by lower work roll chocks 6*a* and 6*b*. The upper backup roll 3 is supported by upper backup roll chocks 7*a* and 7*b*, and the lower backup roll 4 is supported by lower backup roll chocks 8*a* and 8*b*. The upper work roll 1 and the upper backup roll 3 form an upper roll assembly, and the lower work roll 2 and the lower backup roll 4 form a lower roll assembly. The upper work roll chocks 5*a* and 5*b*, the lower work roll chocks 6*a* and 6*b*, the upper backup roll chocks 7*a* and 7*b*, and the lower backup roll chocks 8*a* and 8*b* are held by a housing 11. Note that FIG. 1A illustrates only a portion of the housing 11 located below the lower backup roll 4.

The rolling mill 100 includes upper load sensing devices 9*a* and 9*b* that sense a vertical roll load relating to the upper roll assembly and lower load sensing devices 10*a* and 10*b* that sense a vertical roll load relating to the lower roll assembly. The upper load sensing device 9*a* and the lower load sensing device 10*a* sense a vertical roll load on the work side, and the upper load sensing device 9*b* and the lower load sensing device 10*b* sense a vertical roll load on the drive side.

Above the upper load sensing devices 9*a* and 9*b*, a pressing-down device that applies a load in a vertically downward direction to the upper backup roll chocks 7*a* and 7*b* is provided. The pressing-down device includes press blocks 12*a* and 12*b*, screws 13*a* and 13*b*, and a pressing-down device drive mechanism 14. The press blocks 12*a* and 12*b* press the upper backup roll chocks 7*a* and 7*b* from above the upper load sensing devices 9*a* and 9*b* provided on upper sides of the upper backup roll chocks 7*a* and 7*b*, respectively. The screws 13*a* and 13*b* form a mechanism for adjusting a reduction position and exemplify a pressing-down device. The screws 13*a* and 13*b* adjust amounts of pressing of the press blocks 12*a* and 12*b*, respectively. The screws 13*a* and 13*b* are driven by the pressing-down device drive mechanism 14. Examples of the pressing-down device drive mechanism 14 include a motor.

The upper work roll 1 and the lower work roll 2 according to the present embodiment respectively include work roll shift devices 15*a* and 15*b* that move roll positions of the upper work roll 1 and the lower work roll 2 in the roll-axis direction. The work roll shift devices 15*a* and 15*b* may include, for example, hydraulic cylinders. In addition, the upper work roll 1 and the lower work roll 2 are provided with thrust counterforce measurement apparatuses 16*a* and 16*b* that measure the thrust counterforces acting on the upper work roll 1 and the lower work roll 2, respectively. The thrust counterforce measurement apparatuses 16*a* and 16*b* may include, for example, load cells.

Here, the thrust counterforce is a counterforce of each roll for holding the roll at its position by resisting a resultant force of thrust forces that exerts on the roll, the thrust forces being produced on contact surfaces between body portions of rolls due mainly to presence of minute cross angles between the rolls. A thrust counterforce is generally loaded onto a keeper plate via a roll chock; however, in a case of the rolling mill 100 including the work roll shift devices 15*a* and 15*b*, thrust counterforces are loaded onto the work roll shift devices 15*a* and 15*b*. Backup roll counterforces that act at reduction support positions of the upper and lower backup rolls 3 and 4 are generally measured by load cells. However, in a case of a rolling mill including a pressing-down device that includes hydraulic cylinders or the like, the backup roll counterforces can be calculated also from measured values of pressures in the hydraulic cylinders.

The rolling mill 100 according to the present embodiment includes an arithmetic device 21 and pressing-down device drive mechanism control device 23, as devices that perform information processing for controlling reduction position setting and reduction position control by the pressing-down device. The arithmetic device 21 performs computational processing for identifying thrust counterforce working point positions of the backup rolls based on results of measurement by the upper load sensing devices 9*a* and 9*b*, the lower load sensing devices 10*a* and 10*b*, and the thrust counterforce measurement apparatuses 16*a* and 16*b*. Based on the identified thrust counterforce working point positions of the backup rolls, the arithmetic device 21 performs computation for setting the reduction position of the rolling mill 100 and performs computation of a control input for the reduction position during rolling. The pressing-down device drive mechanism control device 23 computes a control value for driving the pressing-down device drive mechanism 14 based on a result of computation by the arithmetic device 21 and drives, based on the computed control value, the pressing-down device drive mechanism 14.

(Configuration of Six-High Rolling Mill)

A rolling mill 200 illustrated in FIG. 1B is a six-high rolling mill that includes three roll pairs including a pair of work rolls 1 and 2, and a pair of intermediate rolls 31 and 32 and a pair of backup rolls 3 and 4 that support the work rolls 1 and 2. The upper work roll 1 is supported by upper work roll chocks 5*a* and 5*b*, and the lower work roll 2 is supported by lower work roll chocks 6*a* and 6*b*. The upper intermediate roll 31 is supported by upper intermediate roll chocks 41*a* and 41*b*, and the lower intermediate roll 32 is supported by lower intermediate roll chocks 42*a* and 42*b*. The upper backup roll 3 is supported by upper backup roll chocks 7*a* and 7*b*, and the lower backup roll 4 is supported by lower backup roll chocks 8*a* and 8*b*.

The upper work roll 1, the upper intermediate roll 31, and the upper backup roll 3 form an upper roll assembly, and the lower work roll 2, the lower intermediate roll 32, and the lower backup roll 4 form a lower roll assembly. The upper work roll chocks 5*a* and 5*b*, the lower work roll chocks 6*a* and 6*b*, the upper intermediate roll chocks 41*a* and 41*b*, the lower intermediate roll chocks 42*a* and 42*b*, the upper backup roll chocks 7*a* and 7*b*, and the lower backup roll chocks 8*a* and 8*b* are held by a housing 11. Note that FIG. 1B illustrates only a portion of the housing 11 located below the lower backup roll 4.

The rolling mill 200 includes upper load sensing devices 9*a* and 9*b* that sense a vertical roll load relating to the upper roll assembly and lower load sensing devices 10*a* and 10*b* that sense a vertical roll load relating to the lower roll assembly. Above the upper load sensing devices 9*a* and 9*b*, a pressing-down device that applies a load in a vertically downward direction to the upper backup roll chocks 7*a* and 7*b* is provided. The pressing-down device includes press blocks 12*a* and 12*b*, screws 13*a* and 13*b*, and a pressing-down device drive mechanism 14. These devices and mechanism function as in the four-high rolling mill 100 illustrated in FIG. 1A.

The upper work roll 1 and the lower work roll 2 respectively include work roll shift devices 15*a* and 15*b* that move roll positions of the upper work roll 1 and the lower work roll 2 in the roll-axis direction. The upper intermediate roll 31 and the lower intermediate roll 32 respectively include intermediate roll shift devices 15*c* and 15*d* that move roll positions of the upper intermediate roll 31 and the lower intermediate roll 32 in the roll-axis direction. The work roll shift devices 15*a* and 15*b* and the intermediate roll shift devices 15*c* and 15*d* may include, for example, hydraulic cylinders.

In addition, the upper work roll 1 and the lower work roll 2 are provided with thrust counterforce measurement apparatuses 16*a* and 16*b* that measure the thrust counterforces acting on the upper work roll 1 and the lower work roll 2, respectively. In addition, the upper intermediate roll 31 and the lower intermediate roll 32 are provided with thrust counterforce measurement apparatuses 16*c* and 16*d* that measure the thrust counterforces acting on the upper intermediate roll 31 and the lower intermediate roll 32, respectively. The thrust counterforce measurement apparatuses 16*a*, 16*b*, 16*c*, and 16*d* may include, for example, load cells. Backup roll counterforces that act at reduction support positions of the upper and lower backup rolls 3 and 4 are generally measured by load cells. However, in a case of a rolling mill including a pressing-down device that includes hydraulic cylinders or the like, the backup roll counterforces can be calculated also from measured values of pressures in the hydraulic cylinders.

The rolling mill 200 according to the present embodiment includes an arithmetic device 21 and pressing-down device drive mechanism control device 23, as devices that perform information processing for controlling reduction position setting and reduction position control by the pressing-down device. The arithmetic device 21 performs computational processing for identifying thrust counterforce working point positions of the backup rolls based on results of measurement by the upper load sensing devices 9*a* and 9*b*, the lower load sensing devices 10*a* and 10*b*, and the thrust counterforce measurement apparatuses 16*a*, 16*b*, 16*c*, and 16*d*. Based on the identified thrust counterforce working point positions of the backup rolls, the arithmetic device 21 performs computation for setting the reduction position of the rolling mill 200 and performs computation of a control input for the reduction position during rolling. The pressing-down device drive mechanism control device 23 computes a control value for driving the pressing-down device drive mechanism 14 based on a result of computation by the arithmetic device 21 and drives, based on the computed control value, the pressing-down device drive mechanism 14.

As above, the schematic configurations of the four-high rolling mill 100 and the six-high rolling mill 200 are described. Note that the configurations of the rolling mills 100 and 200 respectively illustrated in FIG. 1A and FIG. 1B are merely an example; for example, in place of the screws 13*a* and 13*b* that press down the press blocks 12*a* and 12*b*, pressing-down devices that utilize hydraulic pressure to press down the press blocks 12*a* and 12*b* may be used.

[1-2. Identification Processing]

(1) Summary

A method for identifying thrust counterforce working point positions of backup rolls according to the present embodiment enables identification of thrust counterforce working point positions of upper and lower backup rolls to be easily performed even in a time other than a time of changing work rolls such as an idling time of a rolling mill.

An inter-roll thrust force due to inter-roll minute cross is one of factors in making a load distribution between rolls asymmetrical and brings about a lateral asymmetry in vertical roll load between the work side and the drive side. Such an inter-roll thrust force causes zigzagging of a rolled material. It is therefore necessary to correctly determine thrust forces and load distributions between rolls from a balance between forces in the roll-axis direction acting on the rolls and a balance between moments acting on the rolls, and to set and control leveling accordingly. To calculate the thrust forces and the load distributions between rolls from the balance between forces in the roll-axis direction acting on the rolls and the balance between moments acting on the rolls, it is necessary to identify the thrust counterforce working point positions of the upper and lower backup rolls. (For Four-High Rolling Mill)

Figure 2A:
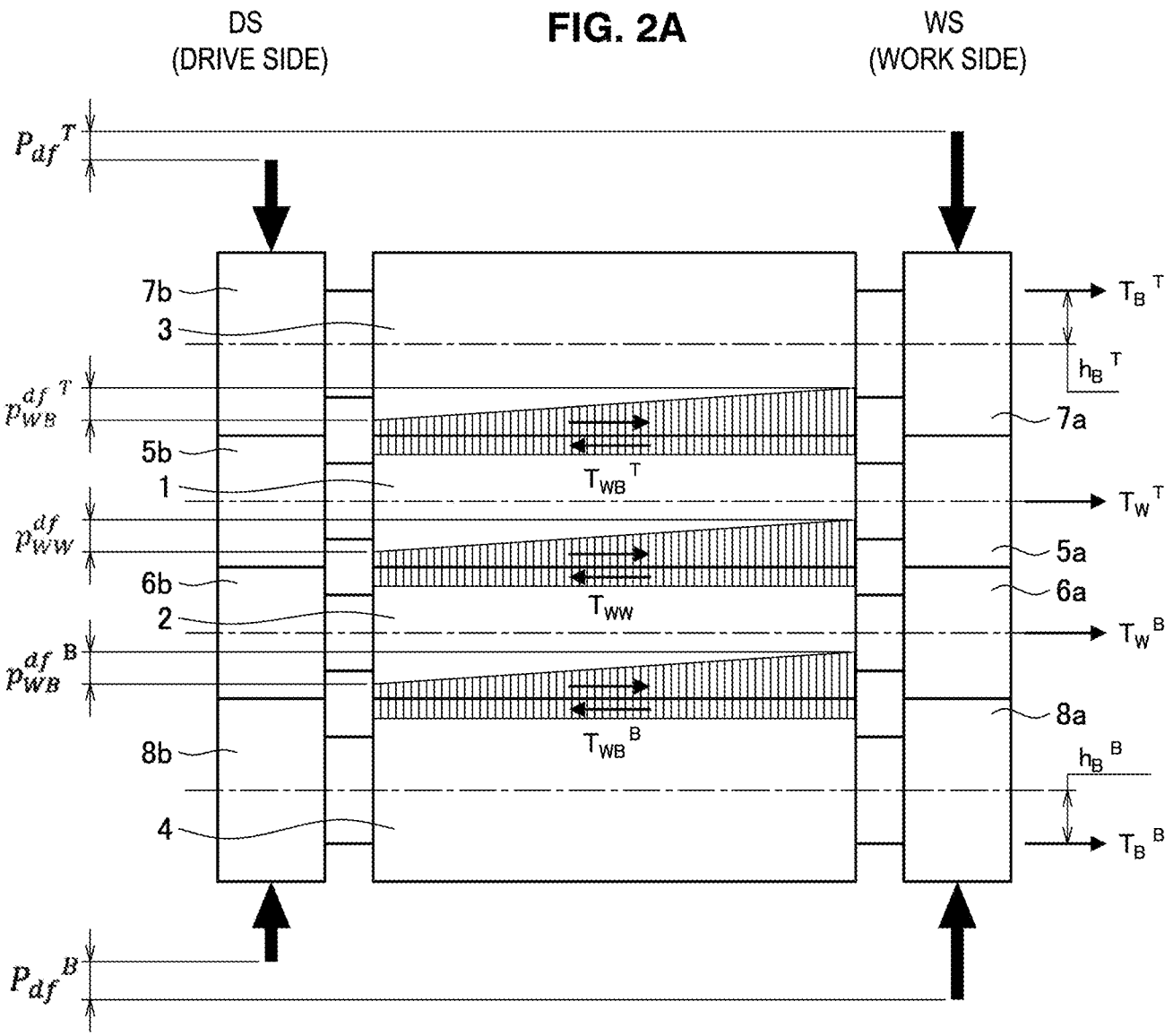
FIG. 2A is a schematic diagram illustrating thrust forces in the roll-axis direction acting on the rolls and perpendicular-direction components asymmetrical between the work side and the drive side in a kiss roll tightened state in a four-high rolling mill.

Here, FIG. 2A illustrates a schematic diagram depicting thrust forces in the roll-axis direction acting on the rolls and perpendicular-direction components asymmetrical between the work side and the drive side in the kiss roll tightened state in a four-high rolling mill. Of the components of forces illustrated in FIG. 2A, those that can be acquired as measured values are the following four components.

$T_W^T$: Thrust counterforce that acts on the upper work roll chocks 5*a* and 5*b*

$T_W^B$: Thrust counterforce that acts on the lower work roll chocks 6*a* and 6*b*

$P_{df}^T$: Difference in backup roll counterforce between the work side and the drive side at the reduction support positions of the upper backup roll 3

$P_{df}^B$: Difference in backup roll counterforce between the work side and the drive side at the reduction support positions of the lower backup roll 4

In addition, in the case of the four-high rolling mill, measurement of the thrust counterforces and the backup roll counterforces produces the following ten unknowns that are involved in equilibrium conditions of forces and moments acting on the rolls.

$T_B^T$: Thrust counterforce that acts on the upper backup roll chocks 7*a* and 7*b*

$T_{WB}^T$: Thrust force that acts between the upper work roll 1 and the upper backup roll 3

$T_{WW}$: Thrust force that acts between the upper work roll 1 and the lower work roll 2

$T_{WB}^B$: Thrust force that acts between the lower work roll 2 and the lower backup roll 4

$T_B^B$: Thrust counterforce that acts on the lower backup roll chocks 8*a* and 8*b*

$p^{df}_{WB}{}^T$: Difference between the work side and the drive side in distribution of line loads between the upper work roll 1 and the upper backup roll 3

$p^{df}_{WB}{}^B$: Difference between the work side and the drive side in distribution of line loads between the lower work roll 2 and the lower backup roll 4

$p^{df}_{WW}$: Difference between the work side and the drive side in distribution of line loads between the upper work roll 1 and the lower work roll 2

$h_B^T$: Working point position of a thrust counterforce that acts on the upper backup roll chocks 7*a* and 7*b*

$h_B^B$: Working point position of a thrust counterforce that acts on the lower backup roll chocks 8*a* and 8*b*

Here, the distribution of line loads is a roll-axis direction distribution of a kiss roll load that acts on body portions of the rolls, in which a load per unit body length is referred to as line load. If thrust counterforces that act on the roll chocks 7*a*, 7*b*, 8*a*, and 8*b* of the backup rolls 3 and 4 can be measured, this is of course preferable because this enables more accurate calculation; however, the roll chocks 7*a*, 7*b*, 8*a*, and 8*b* of the backup rolls 3 and 4 receive backup roll counterforces that are much larger than the thrust counterforces. Therefore, thrust counterforce working point positions of the backup rolls 3 and 4 are generally different from center positions of their roll axis. Note that the description will be made here on an assumption that measured values of the thrust counterforces of the backup rolls 3 and 4 are not used because the measurement of the thrust counterforces is not easy. If the thrust counterforces of the backup rolls 3 and 4 can be measured, the unknowns are reduced by four including the working point positions. This causes equations to outnumber unknowns described below, which enables the unknowns to be determined as solutions of least squares of all of the equations, further improving calculation accuracy.

Equations applicable to determining the ten unknowns include four equilibrium conditional expressions relating to forces of the rolls in the roll-axis direction (first equilibrium conditional expressions) shown in the following Formulas (1-1) to (1-4) and four equilibrium conditional expressions relating to moments of the rolls (second equilibrium conditional expressions) shown in the following Formulas (1-5) to (1-8), eight in total.

[Expression 1]

$$-T_{WB}^T-T_B^T=0 \tag{1-1}$$

$$T_{WB}^T-T_{WW}-T_W^T=0 \tag{1-2}$$

$$T_{WW}-T_{WB}^B-T_W^B=0 \tag{1-3}$$

$$T_{WB}^B-T_B^B=0 \tag{1-4}$$

$$T_{WB}^T D_B^T/2+T_B^T h_B^T+p_{WB}^{df^T}(l_{WB}^T)^2/12-P_{df}^T a_B^T/2=0 \tag{1-5}$$

$$T_{WB}^T D_W^T/2+T_{WW} D_W^T/2-p_{WB}^{df^T}(l_{WB}^T)^2/12-p_{WW}^{df}(l_{WW})^2/12=0 \tag{1-6}$$

$$T_{WB}^B D_W^B/2+T_{WW} D_W^B/2-p_{WB}^{df^B}(l_{WB}^B)^2/12-p_{WW}^{df}(l_{WW})^2/12=0 \tag{1-7}$$

$$T_{WB}^B D_B^B/2+T_B^T h_B^B-p_{WB}^{df^B}(l_{WB}^B)^2/12-p_{df}^B a_B^B/2=0 \tag{1-8}$$

Here, $D_B^T$ denotes a diameter of the upper backup roll 3, $D_W^T$ denotes a diameter of the upper work roll 1, $D_W^B$ denotes a diameter of the lower work roll 2, and $D_B^B$ denotes a diameter of the lower backup roll 4. In addition, $a_B^T$ denotes a span of the upper backup roll 3, $a_B^B$ denotes a span of the lower backup roll 4, $l_{WB}^T$ denotes a length of a contact zone between the upper backup roll 3 and the upper work roll 1, $l_{WW}$ denotes a length of a contact zone between the upper work roll 1 and the lower work roll 2, and $l_{WB}^B$ denotes a length of a contact zone between the lower backup roll 4 and the lower work roll 2. Note that unknowns that are involved in equilibrium conditional expressions relating to forces of the rolls in the perpendicular direction are excluded here, on an assumption that the equilibrium conditional expressions of the forces in the perpendicular direction are already taken into consideration.

Since there are ten unknowns for the eight equations of Formulas (1-1) to (1-8) shown above, it is necessary to measure or identify two unknowns to determine all of the unknowns. Here, the thrust forces and the distributions of line loads are difficult to measure directly since the thrust forces and the line loads are forces acting between the rolls. Therefore, a practical solution is to identify beforehand the working point positions $h_B^T$ and $h_B^B$ of the thrust counterforces that act on the upper backup roll chocks 7*a* and 7*b* and the lower backup roll chocks 8*a* and 8*b*. When these thrust counterforce working point positions $h_B^T$ and $h_B^B$ can be identified, all of the unknowns can be determined by solving the equilibrium conditional expressions relating to the forces of the rolls in the roll-axis direction and the equilibrium conditional expressions relating to the moments of the rolls for the remaining eight unknowns.

(For Six-High Rolling Mill)

Figure 2B:
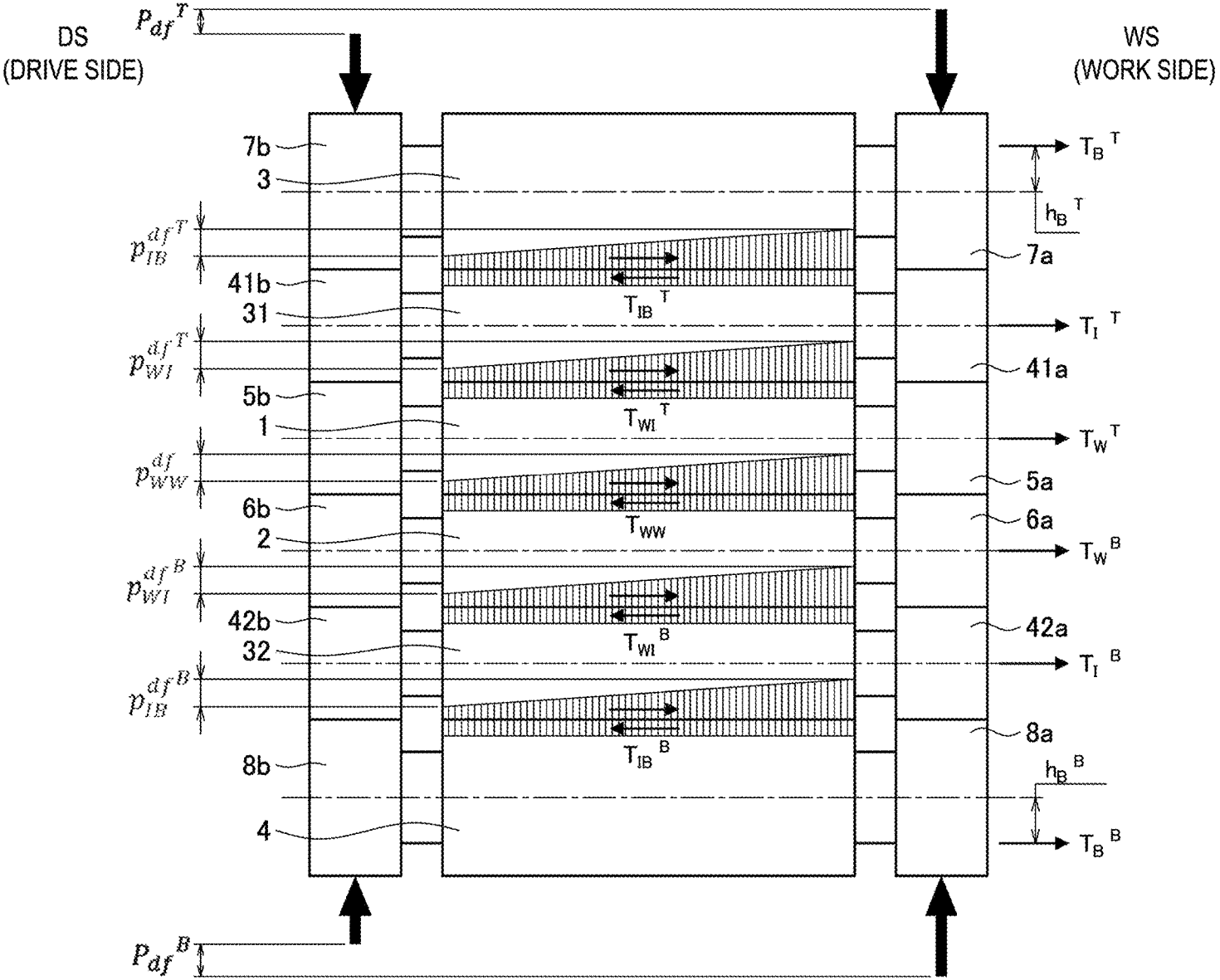
FIG. 2B is a schematic diagram illustrating thrust forces in the roll-axis direction acting on the rolls and perpendicular-direction components asymmetrical between the work side and the drive side in the kiss roll tightened state in a six-high rolling mill.

Here, FIG. 2B illustrates a schematic diagram depicting thrust forces in the roll-axis direction acting on the rolls and perpendicular-direction components asymmetrical between the work side and the drive side in the kiss roll tightened state in a six-high rolling mill. Of the components of forces illustrated in FIG. 2B, those that can be acquired as measured values are the following six components.

$T_W^T$: Thrust counterforce that acts on the upper work roll chocks 5*a* and 5*b*

$T_W^B$: Thrust counterforce that acts on the lower work roll chocks 6*a* and 6*b*

$T_I^T$: Thrust counterforce that acts on the upper intermediate roll chocks 41*a* and 41*b*

$T_I^B$: Thrust counterforce that acts on the lower intermediate roll chocks 42*a* and 42*b*

$P_{df}^T$: Difference in backup roll counterforce between the work side and the drive side at the reduction support positions of the upper backup roll 3

$P_{df}^B$: Difference in backup roll counterforce between the work side and the drive side at the reduction support positions of the lower backup roll 4

In addition, in the case of the six-high rolling mill, measurement of the thrust counterforces and the backup roll counterforces produces the following 14 unknowns that are involved in equilibrium conditions of forces and moments acting on the rolls.

$T_B^T$: Thrust counterforce that acts on the upper backup roll chocks 7*a* and 7*b*

$T_{IB}^T$: Thrust force that acts between the upper intermediate roll 31 and the upper backup roll 3

$T_{WI}^T$: Thrust force that acts between the upper work roll 1 and the upper intermediate roll 31

$T_{WW}$: Thrust force that acts between the upper work roll 1 and the lower work roll 2

$T_{WI}^B$: Thrust force that acts between the lower work roll 2 and the lower intermediate roll 32

$T_{IB}^B$: Thrust force that acts between the lower intermediate roll 32 and the lower backup roll 4

$T_B^B$: Thrust counterforce that acts on the lower backup roll chocks 8*a* and 8*b*

$p^{df}{}_{IB}^T$: Difference between the work side and the drive side in distribution of line loads between the upper intermediate roll 31 and the upper backup roll 3

$p^{df}{}_{WI}^T$: Difference between the work side and the drive side in distribution of line loads between the upper work roll 1 and the upper intermediate roll 31

$p^{df}{}_{WI}^B$: Difference between the work side and the drive side in distribution of line loads between the lower work roll 2 and the lower intermediate roll 32

$p^{df}{}_{IB}^B$: Difference between the work side and the drive side in distribution of line loads between the lower intermediate roll 32 and the lower backup roll 4

$p^{df}{}_{WW}$: Difference between the work side and the drive side in distribution of line loads between the upper work roll 1 and the lower work roll 2

$h_B^T$: Working point position of a thrust counterforce that acts on the upper backup roll chocks 7*a* and 7*b*

$h_B^B$: Working point position of a thrust counterforce that acts on the lower backup roll chocks 8*a* and 8*b*

Also in this case, if the thrust counterforces of the backup rolls 3 and 4 can be measured, the unknowns are reduced by four including the working point positions.

This causes equations to outnumber unknowns described below, which enables the unknowns to be determined as solutions of least squares of all of the equations, further improving calculation accuracy.

Equations applicable to determining the 14 unknowns include 6 equilibrium conditional expressions relating to forces of the rolls in the roll-axis direction (first equilibrium conditional expressions) shown in the following Formulas (2-1) to (2-6) and 6 equilibrium conditional expressions relating to moments of the rolls (second equilibrium conditional expressions) shown in the following Formulas (2-7) to (2-12), 12 in total.

[Expression 2]

$$-T_{IB}^T-T_B^T=0 \tag{2-1}$$

$$T_{IB}^T-T_{WI}-T_I^T=0 \tag{2-2}$$

$$T_{WI}^T-T_{WW}-T_W^T=0 \tag{2-3}$$

$$T_{WW}-T_{WI}^B-T_W^B=0 \tag{2-4}$$

$$T_{WI}^B=T_{IB}^B-T_I^B=0 \tag{2-5}$$

$$T_{IB}^B-T_B^B=0 \tag{2-6}$$

$$T_{IB}^T D_B^T/2+T_B^T h_B^T+p_{IB}^{df^T}(l_{IB}^T)^2/12-P_{df}^T a_B^T/2=0 \tag{2-7}$$

$$T_{IB}^T D_I^T/2+T_{WI}^T D_I^T/2-p_{IB}^{df^T}(l_{IB}^T)^2/12-p_{WI}^{df^T}(l_{WI}^T)^2/12=0 \tag{2-8}$$

$$T_{WI}^T D_W^T/2+T_{WW} D_W^T/2-p_{WI}^{df^T}(l_{WI}^T)^2/12-p_{WW}^{df}(l_{WW})^2/12=0 \tag{2-9}$$

$$T_{WW} D_W^B/2+T_{WI}^B D_W^B/2-p_{WW}^{df}(l_{WW})^2/12-p_{WI}^{df^B}(l_{WI}^B)^2/12=0 \tag{2-10}$$

$$T_{WI}^B D_I^B/2+T_{IB}^B D_I^B/2-p_{WI}^{df^B}(l_{WI}^B)^2/12+p_{IB}^{df^B}(l_{IB}^B)^2/12=0 \tag{2-11}$$

$$T_{IB}^B D_B^B/2+T_B^B h_B^B-p_{IB}^{df^B}(l_{IB}^B)^2/12-p_{df}^B a_B^B/2=0 \tag{2-12}$$

Here, $D_I^T$ denotes a diameter of the upper intermediate roll 31, and $D_I^B$ denotes a diameter of the lower intermediate roll 32. In addition, $l_{IB}^T$ denotes a length of a contact zone between the upper backup roll 3 and the upper intermediate roll 31, $l_{WI}^T$ denotes a length of a contact zone between the upper intermediate roll 31 and the upper work roll 1, $l_{WI}^B$ denotes a length of a contact zone between the lower intermediate roll 32 and the lower work roll 2, and $l_{IB}^B$ denotes a length of a contact zone between the lower backup roll 4 and the lower intermediate roll 32. Note that unknowns that are involved in equilibrium conditional expressions relating to forces of the rolls in the perpendicular direction are excluded here, on an assumption that the equilibrium conditional expressions of the forces in the perpendicular direction are already taken into consideration.

Since there are 14 unknowns for the 12 equations of Formulas (2-1) to (2-12) shown above, it is necessary to measure or identify 2 unknowns to determine all of the unknowns. Here, the thrust forces and the distributions of line loads are difficult to measure directly since the thrust forces and the line loads are forces acting between the rolls. Therefore, a practical solution is to identify beforehand the working point positions $h_B^T$ and $h_B^B$ of the thrust counterforces that act on the upper backup roll chocks 7*a* and 7*b* and the lower backup roll chocks 8*a* and 8*b*. When these thrust counterforce working point positions $h_B^T$ and $h_B^B$ can be identified, all of the unknowns can be determined by solving the equilibrium conditional expressions relating to the forces of the rolls in the roll-axis direction and the equilibrium conditional expressions relating to the moments of the rolls for the remaining 12 unknowns.

Moreover, in the six-high rolling mill, there is a case where only the thrust counterforces of either the work rolls or the intermediate rolls can be measured. For example, in a case where only the thrust counterforces $T_W^T$ and $T_W^B$ of the work rolls can be measured, the thrust counterforce $T_I^T$ and $T_I^B$ of the intermediate rolls are unknowns. In this case, the number of the unknowns in Formulas (2-1) to (2-12) shown above increases from 14 to 16. In such a case, the number of the unknowns can be reduced to 12 by, as described above, identifying beforehand the working point positions $h_B^T$ and $h_B^B$ of the thrust counterforces that act on the upper backup roll chocks 7*a* and 7*b* and the lower backup roll chocks 8*a* and 8*b* and by, for example, assuming that the thrust forces $T_{IB}^T$ and $T_{IB}^B$ that act between the intermediate rolls and the backup rolls are zero. Even in a case where such conditions are not established, the remaining unknowns can be all determined by making at least two of the unknowns known.

As for conventional identification of the thrust counterforce working point positions of upper and lower backup rolls, for example, according to the technique described in Patent Document 2, known thrust forces are first caused to act on the backup rolls to measure lateral asymmetries in load-cell-measured vertical-direction load, with rolls other than backup rolls being taken out and perpendicular-direction loads being applied to body portions of the backup rolls. Then, based on the measured lateral asymmetries in load-cell-measured vertical-direction load, the thrust counterforce working point positions of the backup rolls are identified from the equilibrium expressions relating to forces and moments. However, because the thrust forces depend on friction coefficients of rolls and cross angles between the rolls, it is difficult to generate the known thrust forces steadily. In addition, it is necessary for the technique to take out the rolls other than the backup rolls, and thus the technique can be performed only in a time of changing work rolls or the like.

The inventor of the present application conducted studies about an easily feasible method that can isolate a thrust force from a difference between the work side and the drive side in load-cell-measured vertical-direction load of a rolling mill that contains the thrust force as a disturbance. As a result, the inventor found that thrust counterforce working point positions of backup rolls fluctuate due to variations in magnitude of a rolling load. The inventor considers that the conventional identification of thrust counterforce working point positions of upper and lower backup rolls described in Patent Document 2 cannot identify the thrust counterforce working point positions of the upper and lower backup rolls with high accuracy because fluctuations in thrust counterforce working point positions of the backup rolls due to variations in a rolling load are not taken into consideration, which makes it impossible to sufficiently isolate a thrust force being a disturbance.

Figure 3:
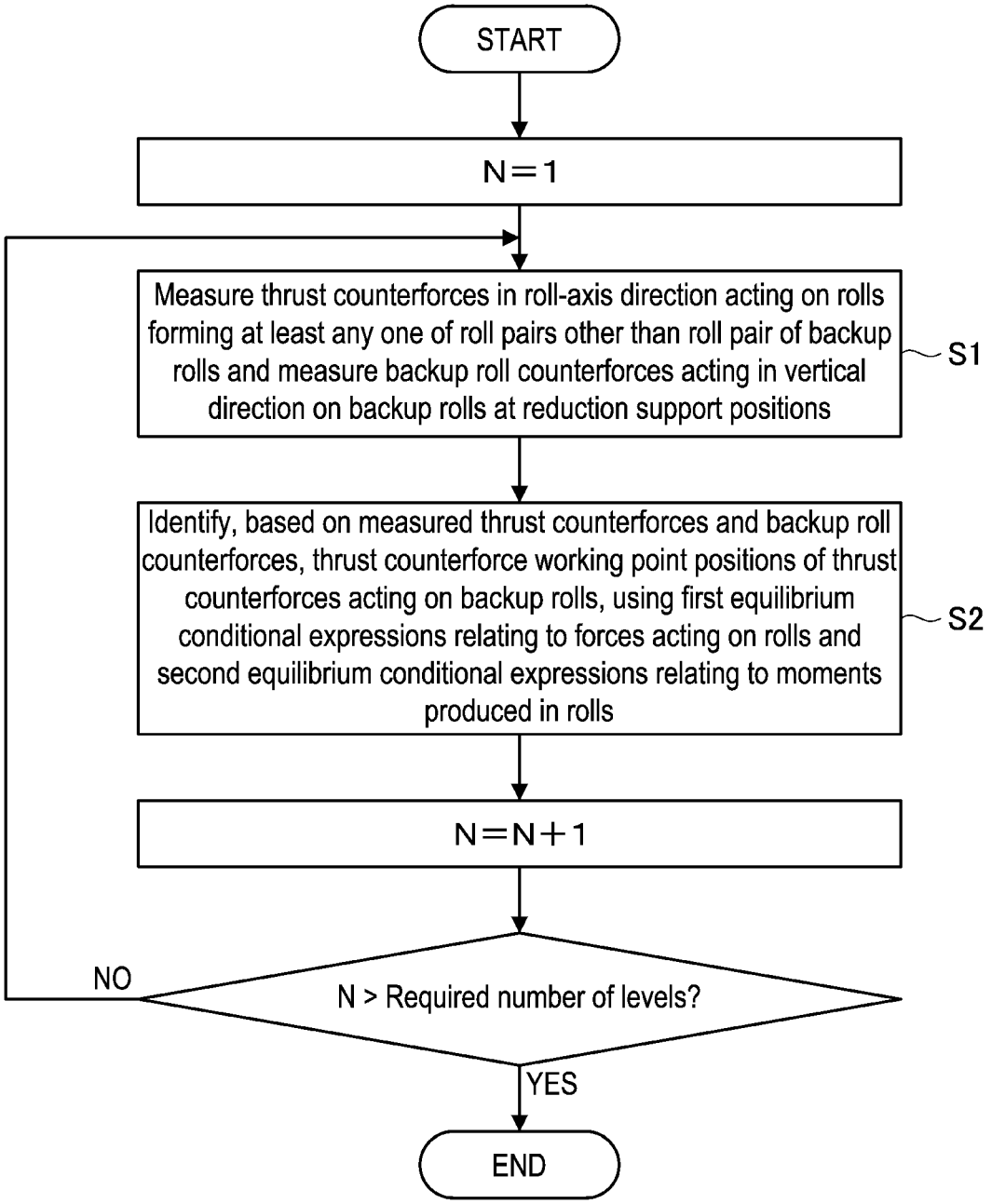
FIG. 3 is a flowchart illustrating a method for identifying thrust counterforce working point positions of backup rolls according to an embodiment of the present invention.

Hence, the method for identifying a thrust counterforce working point position according to the present embodiment includes performing processing illustrated in FIG. 3 to take into consideration the fluctuations in thrust counterforce working point positions of backup rolls due to variations in a rolling load. That is, in the identification, with an unchanged kiss roll load, thrust forces at level numbers required to identify the thrust counterforce working point positions (required number of levels) are first caused to act between the rolls, and at each level N, thrust counterforces in a roll-axis direction acting on rolls forming at least one of roll pairs other than a roll pair of the backup rolls are measured, and backup roll counterforces acting in a vertical direction on the backup rolls are measured (S1: first step). Then, based on the measured thrust counterforces and backup roll counterforces, thrust counterforce working point positions of thrust counterforces acting on the backup rolls are identified from the first equilibrium conditional expressions relating to the forces acting on the rolls and the second equilibrium conditional expressions relating to the moments acting on the rolls (S2: second step).

More in detail, an inter-roll thrust force T varies in accordance with an inter-roll load P. A relation between the inter-roll thrust force T and the inter-roll load P can be expressed by the following Formula (3) using a thrust coefficient $\mu_T$.

[Expression 3]

$$T=\mu_T P \tag{3}$$

Here, according to Patent Document 3, the thrust coefficient $\mu_T$ can be expressed by the following Formula (4) using an inter-roll cross angle $\phi$, a friction coefficient $\mu$, a Poisson's ratio $\gamma$, a Young's modulus G, an inter-roll line load p, a WR radius $R_W$, and a BUR radius $R_B$.

[Expression 4]

$$\mu_T = \mu\left[1-\left\{1-\frac{\phi}{\mu}\sqrt{\frac{\pi G R_{eq}(1-\gamma)}{P}}\right\}^2\right] \tag{4}$$

Here, on an assumption that the Poisson's ratio $\gamma$, the Young's modulus G, the WR radius $R_W$, and BUR radius $R_B$ are known, and the inter-roll line load p is constant, the inter-roll thrust force T can be consequently expressed in a form of a function that varies only with the inter-roll cross angle $\phi$ and the friction coefficient $\mu$, as shown in the following Formula (5).

[Expression 5]

$$T=T(\phi,\mu) \tag{5}$$

Therefore, different thrust forces can be generated with the unchanged kiss roll load by changing at least one of the inter-roll cross angle and the friction coefficient between the rolls. By using this, in a state where a thrust force at each of a plurality of levels is caused to act between the rolls, backup roll counterforces and thrust counterforces in the axis-direction that acts on all the rolls other than the backup rolls in the kiss roll tightened state are measured. By performing the measurement a plurality of times in this manner, the equilibrium conditional expressions, which are Formulas (1-1) to (1-8) shown above in the case of the four-high rolling mill or Formulas (2-1) to (2-12) shown above in the case of the six-high rolling mill, outnumber the unknowns, enabling all of the unknowns to be determined.

(2) Specific Technique (a. In a Case of Changing Friction Coefficient)

Figure 4A:
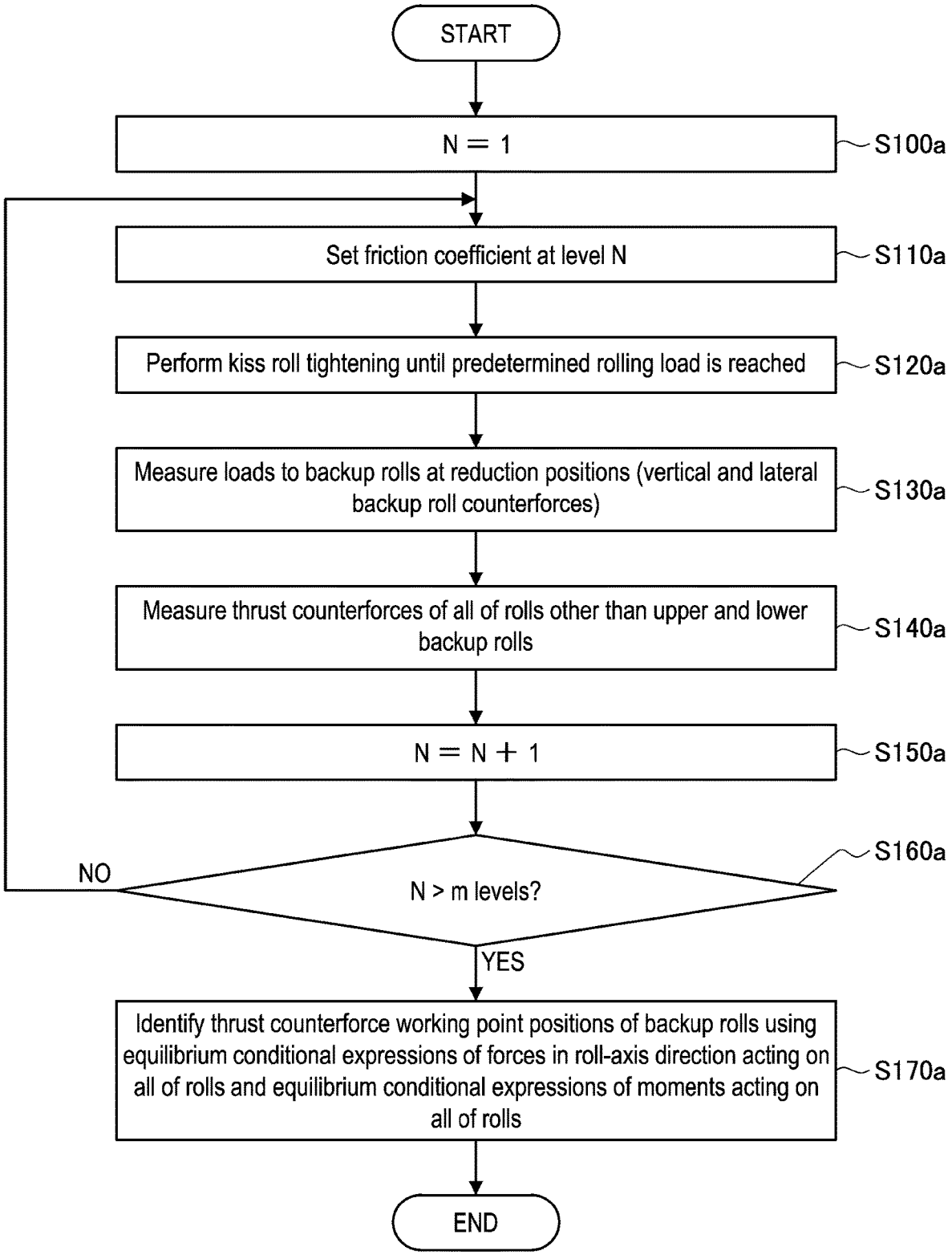
FIG. 4A is a flowchart illustrating an example of a method for identifying thrust counterforce working point positions of backup rolls according to an embodiment of the present invention, where the method is performed while a friction coefficient between rolls is changed.

(i. In a Case where Thrust Counterforces of all of the Rolls Other than the Backup Rolls can Be Measured) First, a case of changing the friction coefficient between the rolls will be described with reference to FIG. 4A. FIG. 4A is a flowchart illustrating an example of a method for identifying thrust counterforce working point positions of backup rolls according to the present embodiment, where the method is performed while the friction coefficient between the rolls is changed. Processing illustrated in FIG. 4A is feasible for a rolling mill that can measure thrust counterforces of all of its rolls other than its backup rolls and applicable to a rolling mill of four-high or more.

The friction coefficient between the rolls can be changed by changing a lubrication condition of the rolls.

(For Four-High Rolling Mill)

For example, in the case of the four-high rolling mill, a thrust force $T_{WB}^{T}$ that acts between the upper work roll 1 and the upper backup roll 3, a thrust force $T_{WW}$ that acts between the upper work roll 1 and the lower work roll 2, and a thrust force $T_{WB}^{B}$ that acts between the lower work roll 2 and the lower backup roll 4 can be expressed by the following Formulas (6-1) to (6-3).

[Expression 6]

$$T_{WB}^{T}=T_{WB}^{T}(\phi_{WB}^{T},\mu_{WB}^{T}) \quad (6\text{-}1)$$

$$T_{WW}=T_{WW}(\phi_{WW},\mu_{WW}) \quad (6\text{-}2)$$

$$T_{WB}^{B}=T_{WB}^{B}(\phi_{WB}^{B},\mu_{WB}^{B}) \quad (6\text{-}3)$$

Here, $\phi_{WB}^{T}$ denotes an inter-roll cross angle between the upper work roll 1 and the upper backup roll 3, $\phi_{WW}$ Denotes an Inter-Roll Cross Angle Between the Upper Work roll 1 and the lower work roll 2, and $\phi_{WB}^{B}$ denotes an inter-roll cross angle between the lower work roll 2 and the lower backup roll 4. In addition, $\mu_{WB}^{T}$ denotes a friction coefficient between the upper work roll 1 and the upper backup roll 3, $\mu_{WW}$ denotes a friction coefficient between the upper work roll 1 and the lower work roll 2, and $\mu_{WB}^{B}$ denotes a friction coefficient between the lower work roll 2 and the lower backup roll 4.

Using these, unknowns involved in the equilibrium conditional expressions relating to the forces acting on the rolls and the equilibrium conditional expression relating to the moments acting on the rolls are resolved, resulting in the following 13 unknowns.

$\phi_{WB}^{T}$: Inter-roll cross angle between the upper work roll 1 and the upper backup roll 3

$\phi_{WW}$: Inter-roll cross angle between the upper work roll 1 and the lower work roll 2

$\phi_{WB}^{B}$: Inter-roll cross angle between the lower work roll 2 and the lower backup roll 4

$\mu_{WB}^{T}$: Friction coefficient between the upper work roll 1 and the upper backup roll 3

$\mu_{WW}$: Friction coefficient between the upper work roll 1 and the lower work roll 2

$\mu_{WB}^{B}$: Friction coefficient between the lower work roll 2 and the lower backup roll 4

$T_{W}^{T}$: Thrust counterforce that acts on the upper work roll chocks 5*a* and 5*b*

$T_{W}^{B}$: Thrust counterforce that acts on the lower work roll chocks 6*a* and 6*b*

$p^{df}_{WB}{}^{T}$: Difference between the work side and the drive side in distribution of line loads between the upper work roll 1 and the upper backup roll 3

$p^{df}_{WB}{}^{B}$: Difference between the work side and the drive side in distribution of line loads between the lower work roll 2 and the lower backup roll 4

$p^{df}_{WW}$: Difference between the work side and the drive side in distribution in line loads between the upper work roll 1 and the lower work roll 2

$h_{B}^{T}$: Working point position of a thrust counterforce that acts on the upper backup roll chocks 7*a* and 7*b*

$h_{B}^{B}$: Working point position of a thrust counterforce that acts on the lower backup roll chocks 8*a* and 8*b*

Equations applicable to determining these unknowns include four equilibrium conditional expressions relating to the forces of the rolls in the roll-axis direction shown in Formulas (1-1) to (1-4) shown above, four equilibrium conditional expressions relating to the moments of the rolls shown in Formulas (1-5) to (1-8) shown above, and two assumption expressions that assume the friction coefficients between the rolls to be equal (i.e., $\mu=\mu_{WB}^{T}=\mu_{WW}=\mu_{WB}^{B}$), ten in total.

As seen from the above, the unknowns exceed the equations by three, and thus all of the unknowns cannot be determined by performing the measurement only once. Hence, the measurement is performed a plurality of times while changing a level of the friction coefficient. As a number of levels of the friction coefficient is increased by one, the number of the equations is increased by ten. At the same time, regarding the unknowns, in a case where the inter-roll cross angle is made constant and a kiss roll tightening load is unchanged, the working point positions of the thrust counterforces acting on the upper and lower backup roll chocks 7*a*, 7*b*, 8*a*, and 8*b* do not fluctuate.

Therefore, unknowns that vary by changing the friction coefficient are eight unknowns including $\mu_{WB}^{T}$, $\mu_{WB}^{B}$, $T_{W}^{T}$, $T_{W}^{B}$, $p^{df}_{WB}{}^{T}$, $p^{df}_{WB}{}^{B}$, and $p^{df}_{WW}$.

That is, performing the measurement with an unchanged kiss roll load under friction coefficient conditions at 3 levels in total produces 29 unknowns in total and 30 equations in total, and thus the equations outnumber the unknowns, enabling all of the unknowns to be determined.

(For Six-High Rolling Mill)

In the case of the six-high rolling mill, a thrust force $T_{IB}^{T}$ that acts between the upper intermediate roll 31 and the upper backup roll 3, a thrust force $T_{WI}^{T}$ that acts between the upper work roll 1 and the upper intermediate roll 31, a thrust force $T_{WW}$ that acts between the upper work roll 1 and the lower work roll 2, a thrust force $T_{WI}^{B}$ that acts between the lower work roll 2 and the lower intermediate roll 32, and a thrust force $T_{IB}^{B}$ that acts between the lower intermediate roll 32 and the lower backup roll 4 can be expressed by the following Formula (7-1) to (7-5).

[Expression 7]

$$T_{IB}^{T}=T_{IB}^{T}(\phi_{IB}^{T},\mu_{IB}^{T}) \quad (7\text{-}1)$$

$$T_{WI}^{T}=T_{WI}^{T}(\phi_{WI}^{T},\mu_{WI}^{T}) \quad (7\text{-}2)$$

$$T_{WW}=T_{WW}(\phi_{WW},\mu_{WW}) \quad (7\text{-}3)$$

$$T_{WI}^{B}=T_{WI}^{B}(\phi_{WI}^{B},\mu_{WI}^{B}) \quad (7\text{-}4)$$

$$T_{IB}^{B}=T_{IB}^{B}(\phi_{IB}^{B},\mu_{IB}^{B}) \quad (7\text{-}5)$$

Here, $\phi_{IB}^{T}$ denotes an inter-roll cross angle between the upper intermediate roll 31 and the upper backup roll 3, $\phi_{WI}^{T}$ denotes an inter-roll cross angle between the upper work roll 1 and the upper intermediate roll 31, $\phi_{WW}$ denotes an inter-roll cross angle between the upper work roll 1 and the lower work roll 2, $\phi_{WI}^{B}$ denotes an inter-roll cross angle between the lower work roll 2 and the lower intermediate roll 32, and $\phi_{IB}^{B}$ denotes an inter-roll cross angle between the lower work roll 2 and the lower intermediate roll 32. In addition, $\mu_{IB}^{T}$ denotes a friction coefficient between the upper intermediate roll 31 and the upper backup roll 3, $\mu_{WI}^{T}$ denotes a friction coefficient between the upper work roll 1 and the upper intermediate roll 31, $\mu_{WW}$ denotes a friction coefficient between the upper work roll 1 and the lower work roll 2, $\mu_{WI}^{B}$ denotes a friction coefficient between the lower work roll 2 and the lower intermediate roll 32, and $\mu_{IB}^{B}$ denotes a friction coefficient between the lower intermediate roll 32 and the lower backup roll 4.

Using these, unknowns involved in the equilibrium conditional expressions relating to the forces acting on the rolls and the equilibrium conditional expression relating to the moments acting on the rolls are resolved, resulting in the following 19 unknowns.

$\phi_{IB}^{T}$: Inter-roll cross angle between the upper intermediate roll 31 and the upper backup roll 3

$\phi_{WI}^{T}$: Inter-roll cross angle between the upper work roll 1 and the upper intermediate roll 31

$\phi_{WW}$: Inter-roll cross angle between the upper work roll 1 and the lower work roll 2

$\phi_{WI}^{B}$: Inter-roll cross angle between the lower work roll 2 and the lower intermediate roll 32

$\phi_{IB}^{B}$: Inter-roll cross angle between the lower intermediate roll 32 and the lower backup roll 4

$\mu_{IB}^{T}$: Friction coefficient between the upper intermediate roll 31 and the upper backup roll 3

$\mu_{WI}^{T}$: Friction coefficient between the upper work roll 1 and the upper intermediate roll 31

$\mu_{WW}$: Friction coefficient between the upper work roll 1 and the lower work roll 2

$\mu_{WI}^{B}$: Friction coefficient between the lower work roll 2 and the lower intermediate roll 32

$\mu_{IB}^{B}$: Friction coefficient between the lower intermediate roll 32 and the lower backup roll 4

$T_{W}^{T}$: Thrust counterforce that acts on the upper work roll chocks 5*a* and 5*b*

$T_{W}^{B}$: Thrust counterforce that acts on the lower work roll chocks 6*a* and 6*b*

$p^{df}_{IB}{}^{T}$: Difference between the work side and the drive side in distribution of line loads between the upper intermediate roll 31 and the upper backup roll 3

$p^{df}_{WI}{}^{T}$: Difference between the work side and the drive side in distribution of line loads between the upper work roll 1 and the upper intermediate roll 31

$p^{df}_{WW}$: Difference between the work side and the drive side in distribution of line loads between the upper work roll 1 and the lower work roll 2

$p^{df}_{WI}{}^{B}$: Difference between the work side and the drive side in distribution of line loads between the lower work roll 2 and the lower intermediate roll 32

$p^{df}_{IB}{}^{B}$: Difference between the work side and the drive side in distribution of line loads between the lower intermediate roll 32 and the lower backup roll 4

$h_{B}^{T}$: Working point position of a thrust counterforce that acts on the upper backup roll chocks 7*a* and 7*b*

$h_{B}^{B}$: Working point position of a thrust counterforce that acts on the lower backup roll chocks 8*a* and 8*b*

Equations applicable to determining these unknowns include 6 equilibrium conditional expressions relating to the forces of the rolls in the roll-axis direction shown in Formulas (2-1) to (2-6) shown above, 6 equilibrium conditional expressions relating to the moments of the rolls shown in Formulas (2-7) to (2-12) shown above, and 4 assumption expressions that assume the friction coefficients between the rolls to be equal (i.e., $\mu=\mu_{IB}^{T}=\mu_{WI}^{T}=\mu_{WW}=\mu_{WI}^{B}=\mu_{IB}^{B}$), 16 in total.

As seen from the above, the unknowns exceed the equations by three, and thus all of the unknowns cannot be determined by performing the measurement only once. Hence, the measurement is performed a plurality of times while changing a level of the friction coefficient. As a number of levels of the friction coefficient is increased by 1, the number of the equations is increased by 16. At the same time, regarding the unknowns, in a case where the inter-roll cross angle is made constant and a kiss roll tightening load is unchanged, the working point positions of the thrust counterforces acting on the upper and lower backup roll chocks 7*a*, 7*b*, 8*a*, and 8*b* do not fluctuate. Therefore, unknowns that vary by changing the friction coefficient are 12 unknowns including, $\mu_{IB}^{T}$, $\mu_{WI}^{T}$, $\mu_{WW}$, $\mu_{WI}^{B}$, $\mu_{IB}^{B}$, $T_{B}^{T}$, $T_{B}^{B}$, $p^{df}_{IB}{}^{T}$, $p^{df}_{WI}{}^{T}$, $p^{df}_{WW}$, $p^{df}_{WI}{}^{B}$, and $p^{df}_{IB}{}^{B}$.

That is, performing the measurement with an unchanged kiss roll load under friction coefficient conditions at 2 levels in total produces 31 unknowns in total and 32 equations in total, and thus the equations outnumber the unknowns, enabling all of the unknowns to be determined.

These levels of the friction coefficients can be easily provided by setting, for example, non-lubrication, water lubrication, oil lubrication, and the like. In addition, performing the measurement with more levels of the friction coefficients allows use of solutions of least squares of the equations, enabling further improvement in calculation accuracy.

The method for identifying the thrust counterforce working point positions of the backup rolls that is performed while the friction coefficients between the rolls are changed can be performed specifically as follows. Such an identification method is performed by, for example, the arithmetic device 21 illustrated in FIG. 1A.

As illustrated in FIG. 4A, first, with N denoting a level number of the friction coefficient, the level number N is set to one (S100*a*). Next, the friction coefficient at the level N is set (S110*a*), and then a pressing-down load is applied by the pressing-down device until a predetermined kiss roll tightening load is reached, bringing about a kiss roll tightened state (S120*a*). Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf.

Then, in the kiss roll tightened state, the backup roll counterforces acting on the backup rolls 3 and 4 in the vertical direction at their reduction support positions are measured (S130*a*). In addition, the thrust counterforces acting on the rolls other than the backup rolls 3 and 4 in the roll-axis direction are measured (S140*a*). For example, in the case of the four-high rolling mill, thrust counterforces of the upper work roll 1 and the lower work roll 2 are measured. In the case of the six-high rolling mill, thrust counterforces of the upper work roll 1 and the lower work roll 2, and thrust counterforces of the upper intermediate roll 31 and the lower intermediate roll 32 are measured.

Upon the measurement of the backup roll counterforces and the thrust counterforces at one level, the level number N is increased by one (S150*a*), and whether the level number N has exceeded a minimum level number m, at which the equilibrium equations can outnumber the unknowns, is determined (S160*a*). The minimum level number m at which the equilibrium equations can outnumber the unknowns is determined beforehand. For example, for the four-high rolling mill, the number of the levels is three (m=3), and for the six-high rolling mill, the number of levels is two (m=2). In step S160*a*, in a case where N is not more than the minimum level number m at which the equilibrium equations can outnumber the unknowns, processes of steps S110*a* to S150*a* are repeatedly performed.

In contrast, in step S160*a*, in a case where N is more than the minimum level number m at which the equilibrium equations can outnumber the unknowns, the thrust counterforce working point positions of the backup rolls are determined by solving the equilibrium conditional expressions relating to the forces of the rolls in the roll-axis direction and the equilibrium conditional expressions of the moments of the rolls (S170*a*). For example, in the case of the four-high rolling mill, the thrust counterforce working point positions of the backup rolls are determined by solving the four equilibrium conditional expressions relating to the forces in the roll-axis direction shown in Formulas (1-1) to (1-4) shown above and the four equilibrium conditional expressions of the moments shown in Formulas (1-5) to (1-8) shown above, for the work rolls 1 and 2 and the backup rolls 3 and 4. In the case of the six-high rolling mill, the thrust counterforce working point positions of the backup rolls are determined by solving the six equilibrium conditional expressions relating to the forces in the roll-axis direction shown in Formulas (2-1) to (2-6) shown above and the six equilibrium conditional expressions of the moments shown in Formulas (2-7) to (2-12) shown above, for the work rolls 1 and 2, the intermediate rolls 31 and 32, and the backup rolls 3 and 4.

As seen from the above, the thrust counterforce working point positions of the backup rolls can be identified by keeping the inter-roll cross angles constant, setting the plurality of roll lubrication states, and measuring the pressing-down load in the kiss roll tightened state in each roll lubrication state.

(ii. In a Case where Thrust Counterforces of Only Either the Work Rolls or the Intermediate Rolls can be Measured in the Six-High Rolling Mill)

Figure 4B:
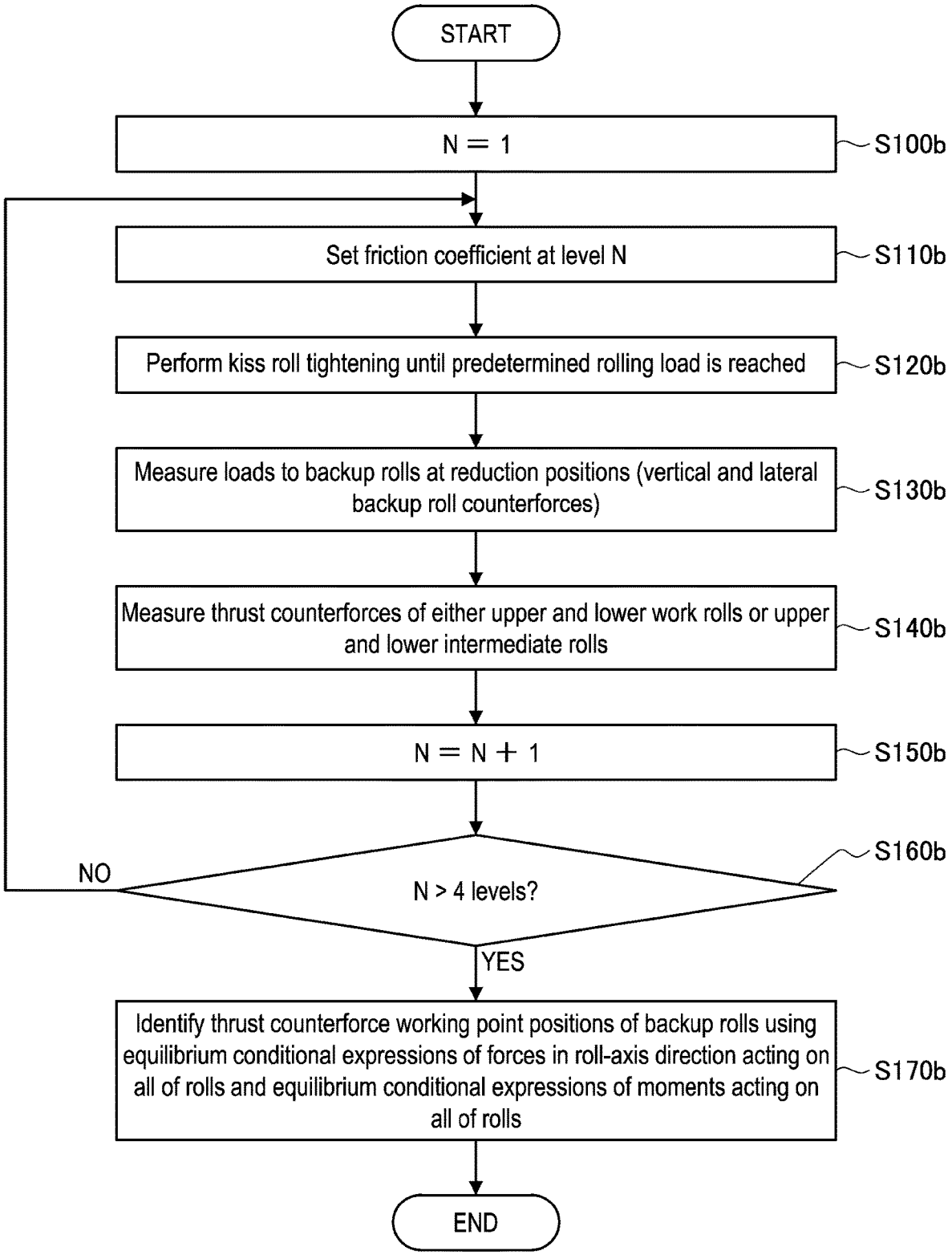
FIG. 4B is a flowchart illustrating another example of a method for identifying thrust counterforce working point positions of backup rolls according to an embodiment of the present invention, where the method is performed while the friction coefficient between the rolls is changed.

Next, another example of the case of changing the friction coefficient between the rolls will be described with reference to FIG. 4B. FIG. 4B is a flowchart illustrating another example of a method for identifying thrust counterforce working point positions of backup rolls according to the present embodiment, where the method is performed while the friction coefficient between the rolls is changed. Processing illustrated in FIG. 4B is processing in a six-high rolling mill that allows thrust counterforces of only either its work rolls or its intermediate rolls to be measured.

In the six-high rolling mill, for example, in a case where only the thrust counterforces $T_W^T$ and $T_W^B$ of the work rolls can be measured, the thrust counterforces $T_I^T$ and $T_I^B$ of the intermediate rolls are unknowns, and in a case where only the thrust counterforces $T_I^T$ and $T_I^B$ of the intermediate rolls can be measured, the thrust counterforces $T_W^T$ and $T_W^B$ of the work rolls are unknowns. Therefore, the number of the unknowns increases by 2 to 21 as compared with the case of the six-high rolling mill in which the thrust counterforces of the work rolls and the intermediate rolls can be measured. At the same time, the equations applicable to determining these unknowns include, as described above, the 6 equilibrium conditional expressions relating to the forces of the rolls in the roll-axis direction shown in Formulas (2-1) to (2-6) shown above, the 6 equilibrium conditional expressions relating to the moments of the rolls shown in Formulas (2-7) to (2-12) shown above, and the 4 assumption expressions that assume the friction coefficients between the rolls to be equal, 16 in total.

As seen from the above, the unknowns exceed the equations by five, and thus all of the unknowns cannot be determined by performing the measurement only once. Hence, the measurement is performed a plurality of times while changing a level of the friction coefficient. As a number of levels of the friction coefficient is increased by 1, the number of the equations is increased by 16. At the same time, regarding the unknowns, in a case where the inter-roll cross angle is made constant and a kiss roll tightening load is unchanged, the working point positions of the thrust counterforces acting on the upper and lower backup roll chocks 7*a*, 7*b*, 8*a*, and 8*b* do not fluctuate. Therefore, unknowns that vary by changing the friction coefficient are 14 unknowns including $\mu_{IB}^T$, $\mu_{WI}^T$, $\mu_{WW}$, $\mu_{WI}^B$, $\mu_{IB}^B$, $T_I^T$, $T_I^B$, $T_B^T$, $T_B^B$, $p^{df}_{IB}{}^T$, $p^{df}_{WI}{}^T$, $p^{df}_{WW}$, $p^{df}_{WI}{}^B$, and $p^{df}_{IB}{}^B$.

That is, performing the measurement with an unchanged kiss roll load under friction coefficient conditions at 4 levels in total produces 63 unknowns in total and 64 equations in total, and thus the equations outnumber the unknowns, enabling all of the unknowns to be determined. As described above, the four levels of friction coefficients can be provided by setting, for example, non-lubrication, water lubrication, oil lubrication, and the like, or using a plurality of lubricants. In addition, performing the measurement with more levels of the friction coefficients allows use of solutions of least squares of the equations, enabling further improvement in calculation accuracy.

The method for identifying the thrust counterforce working point positions of the backup rolls that is performed while the friction coefficients between the rolls are changed can be performed specifically as follows. Such an identification method is performed by, for example, the arithmetic device 21 illustrated in FIG. 1B.

As illustrated in FIG. 4B, first, with N denoting a level number of the friction coefficient, the level number N is set to one (S100*b*). Next, the friction coefficient at the level N is set (S110*b*), and then a pressing-down load is applied by the pressing-down device until a predetermined kiss roll tightening load is reached, bringing about a kiss roll tightened state (S120*b*). Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf. Then, in the kiss roll tightened state, the backup roll counterforces acting on the backup rolls 3 and 4 in the vertical direction at their reduction support positions are measured (S130*b*). In addition, the thrust counterforces that act in the roll-axis direction on either the upper work roll 1 and the lower work roll 2 or the upper intermediate roll 31 and the lower intermediate roll 32 are measured (S140*b*).

Upon the measurement of the backup roll counterforces and the thrust counterforces at one level, the level number N is increased by one (S150*b*), and whether the level number N has exceeded a minimum level number, at which the equilibrium equations can outnumber the unknowns, is determined (S160*b*). The minimum level number at which the equilibrium equations can outnumber the unknowns is determined beforehand; four levels in the present example. In step S160*b*, in a case where N is not more than the minimum level number at which the equilibrium equations can outnumber the unknowns, processes of steps S110*b* to S150*b* are repeatedly performed. In step S160*b*, in a case where N is more than the minimum level number at which the equilibrium equations can outnumber the unknowns, the six equilibrium conditional expressions relating to the forces of the rolls in the roll-axis direction shown in Formulas (2-1) to (2-6) shown above and the six equilibrium conditional expressions of the moments of the rolls shown in Formulas (2-7) to (2-12) shown above are solved to determine the thrust counterforce working point positions of the backup rolls (S170*b*).

As seen from the above, the thrust counterforce working point positions of the backup rolls can be identified by keeping the inter-roll cross angles constant, setting the plurality of roll lubrication states, and measuring the pressing-down load in the kiss roll tightened state in each roll lubrication state.

Note that such a method is given the assumption that the friction coefficients between the rolls are all equal to one another because it is difficult to apply lubricant between only specified rolls. However, in a case where, for example, roll surface roughness or the like is predominant, the friction coefficients between the rolls differ even when the same lubricant is used, which may degrade calculation accuracy. In such a case, it is desirable to apply a method in which the measurement is performed at a plurality of levels by changing the inter-roll cross angle, as described below.

(b. In a Case of Changing an Inter-Roll Cross Angle)

Next, a case of changing the inter-roll cross angle will be described with reference to FIG. 5 to FIG. 6B. In the case of changing the inter-roll cross angle, it is necessary to distinguish between a normal rolling mill and a rolling mill such as a pair cross mill, which can cross its upper and lower roll assemblies in a horizontal direction.

Figure 5:
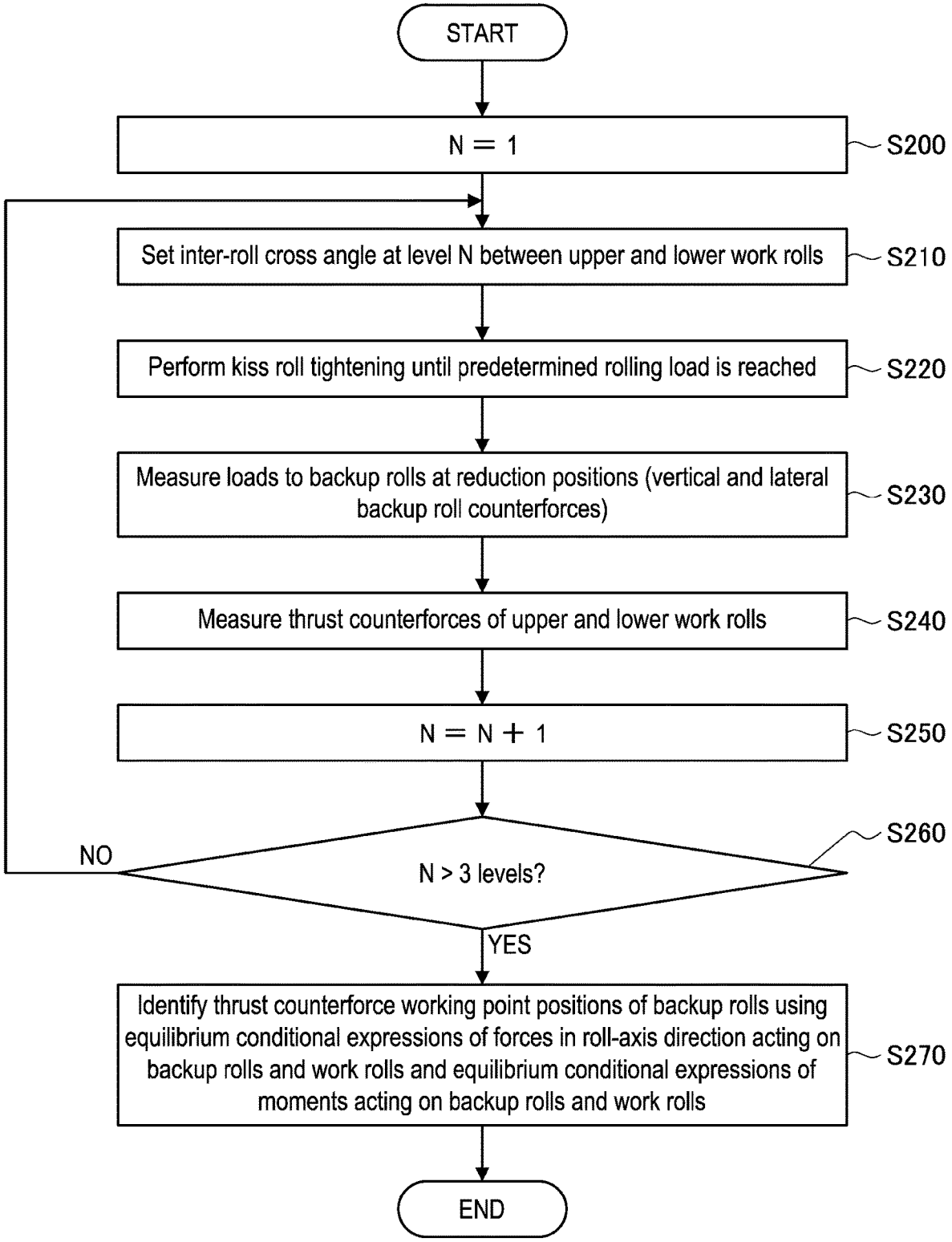
FIG. 5 is a flowchart illustrating an example of a method for identifying thrust counterforce working point positions of backup rolls according to the embodiment, where the method is performed using a pair cross mill while an inter-roll cross angle is changed.
Figure 6A:
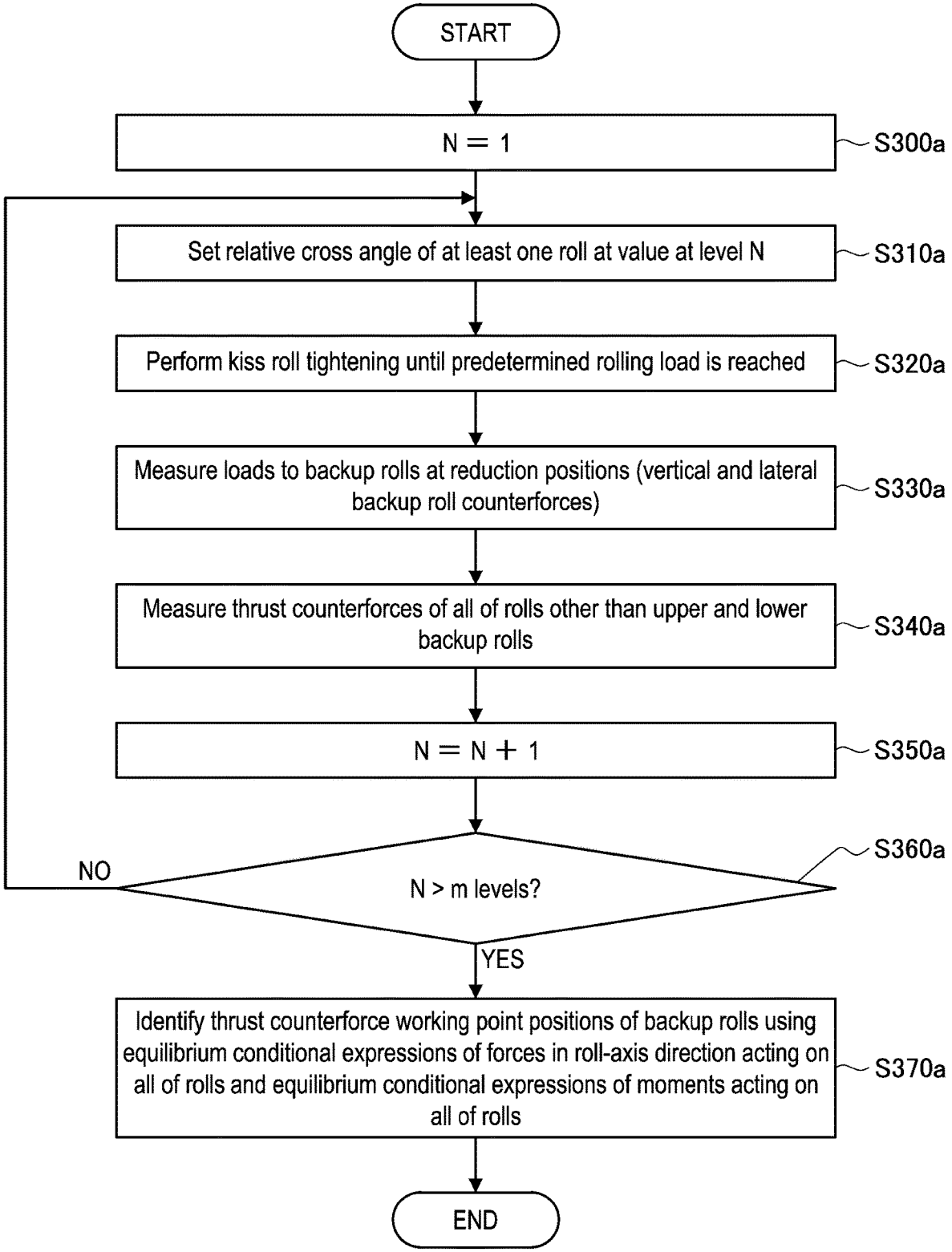
FIG. 6A is a flowchart illustrating an example of a method for identifying thrust counterforce working point positions of backup rolls according to the embodiment, where the method is performed using a normal rolling mill while an inter-roll cross angle is changed.

FIG. 5 is a flowchart illustrating an example of a method for identifying thrust counterforce working point positions of backup rolls according to the present embodiment, where the method is performed using a pair cross mill while the inter-roll cross angle is changed. FIG. 6A and FIG. 6B are flowcharts illustrating examples of a method for identifying thrust counterforce working point positions of backup rolls according to the present embodiment, where the method is performed using a normal rolling mill while the inter-roll cross angle is changed. Processing illustrated in FIG. 6A is feasible for a rolling mill that can measure thrust counterforces of all of its rolls other than its backup rolls and applicable to a rolling mill of four-high or more. Processing illustrated in FIG. 6B is applicable to a six-high rolling mill that allows thrust counterforces of only either its work rolls or its intermediate rolls to be measured.

(b-1. In a Case of Using a Pair Cross Mill)

First, based on FIG. 5, a method for identifying thrust counterforce working point positions of backup rolls 3 and 4 in a case of using a rolling mill such as a pair cross mill, which can cross its upper and lower roll assemblies in the horizontal direction will be described. That is, the rolling mill is a rolling mill that can cross a roll-axis direction of the upper roll assembly including at least its upper work roll 1 and its upper backup roll 3 and a roll-axis direction of the lower roll assembly including at least its lower work roll 2 and its lower backup roll 4. In such a rolling mill, an inter-roll cross angle $\phi_{WW}$ of the upper and lower work rolls 1 and 2 is changed, and thrust counterforce working point positions of the backup rolls 3 and 4 are identified.

In this case, as in the case of changing the friction coefficient between the rolls, the number of the unknowns involved in the equilibrium conditions relating to the forces and the moments is 13, and the number of the equations is 10. The unknowns exceed the equations by three, and thus all of the unknowns cannot be determined by performing the measurement only once. Hence, the measurement is performed a plurality of times with an unchanged kiss roll load while changing a level of the inter-roll cross angle $\phi_{WW}$ between the upper and lower work rolls 1 and 2. As a number of levels of the inter-roll cross angle $\phi_{WW}$ is increased by one, the number of the equations is increased by eight. At the same time, regarding the unknowns, in a case where the friction coefficient is made constant and a kiss roll tightening load is unchanged, the working point positions of the thrust counterforces acting on the upper and lower backup roll chocks 7*a*, 7*b*, 8*a*, and 8*b* do not fluctuate. Therefore, unknowns that vary by changing the inter-roll cross angle $\phi_{WW}$ are six unknowns including $\phi_{WW}$, $T_W^T$, $T_W^B$, $p^{df}_{WB}{}^T$, $p^{df}_{WB}{}^B$, and $p^{df}_{WW}$.

That is, performing the measurement under inter-roll cross angle conditions for the upper and lower work rolls 1 and 2 at 3 levels in total produces 25 unknowns in total and 26 equations in total, and thus the equations outnumber the unknowns, enabling all of the unknowns to be determined. In the case of the pair cross mill, the change of the inter-roll cross angle between the upper and lower work rolls 1 and 2 can be easily made because an actuator used for shape control can be used as it is. In addition, performing the measurement with more levels of the inter-roll cross angle between the upper and lower work rolls 1 and 2 allows use of solutions of least squares of the equations, enabling further improvement in calculation accuracy.

Furthermore, this identification method is given the assumption that the friction coefficients between the rolls are all equal to one another, as in the case of changing the friction coefficient. However, in a case where, for example, roll surface roughness or the like is predominant, the friction coefficients between the rolls differ, which may degrade calculation accuracy. When the assumption is excluded, the number of the equations becomes eight; however, performing the measurement under the inter-roll cross angle conditions for the upper and lower work rolls 1 and 2 at 4 levels in total produces 31 unknowns in total and 32 equations in total. The equations thus can outnumber the unknowns, enabling all of the unknowns to be determined.

The method for identifying the thrust counterforce working point positions of the backup rolls that is performed while the inter-roll cross angle conditions for the upper and lower work rolls 1 and 2 are changed can be performed specifically as follows. Such an identification method is performed by, for example, the arithmetic device 21 illustrated in FIG. 1A.

As illustrated in FIG. 5, first, with N denoting a level number of the inter-roll cross angle $\phi_{WW}$ between the upper and lower work rolls 1 and 2, the level number N is set to one (S200). Next, the inter-roll cross angle $\phi_{WW}$ at the level N is set (S210), and then a pressing-down load is applied by the pressing-down device until a predetermined kiss roll tightening load is reached, bringing about a kiss roll tightened state (S220). Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf. Then, in the kiss roll tightened state, the backup roll counterforces acting on the backup rolls 3 and 4 in the vertical direction at their reduction support positions are measured (S230). In addition, the thrust counterforces that act in the roll-axis direction on the rolls other than the backup rolls 3 and 4, which are the upper work roll 1 and the lower work roll 2 in the case of a four-high rolling mill, are measured (S240).

Upon the measurement of the backup roll counterforces and the thrust counterforces at one level, the level number N is increased by one (S250), and whether the level number N has exceeded a minimum level number, at which the equilibrium equations can outnumber the unknowns, is determined (S260). The minimum level number at which the equilibrium equations can outnumber the unknowns is determined beforehand; three levels in the present example. In step S260, in a case where N is not more than the minimum level number at which the equilibrium equations can outnumber the unknowns, processes of steps S210 to S250 are repeatedly performed. In step S260, in a case where N is more than the minimum level number at which the equilibrium equations can outnumber the unknowns, the four equilibrium conditional expressions relating to the forces of the rolls in the roll-axis direction shown in Formulas (1-1) to (1-4) shown above and the four equilibrium conditional expressions of the moments of the rolls shown in Formulas (1-5) to (1-8) shown above are solved to determine the thrust counterforce working point positions of the backup rolls (S270).

As seen from the above, the thrust counterforce working point positions of the backup rolls can be identified in the pair cross mill by setting a plurality of inter-roll cross angles $\phi_{WW}$ of the upper and lower work rolls 1 and 2, and measuring the pressing-down load in the kiss roll tightened state with each inter-roll cross angle $\phi_{WW}$.

(b-2. In a Case of Using a Normal Rolling Mill)

Next, based on FIG. 6A and FIG. 6B, a method for identifying thrust counterforce working point positions of backup rolls 3 and 4 in a case of using a normal rolling mill other than a pair cross mill will be described. At this time, the rolling mill includes external-force applying devices that apply different rolling-direction external forces to a work-side roll chock and a drive-side roll chock of at least any one of its rolls. The external-force applying devices are, for example, hydraulic cylinders. The external-force applying devices apply the different rolling-direction external forces to the work-side roll chock and the drive-side roll chock of the roll including the external-force applying devices, enabling an inter-roll cross angle of the roll to be changed with respect to an entire roll assembly. Then, the measurement of the backup roll counterforces and the thrust counterforces is performed with inter-roll cross angles at a plurality of levels to identify the thrust counterforce working point positions of the backup rolls 3 and 4.

(i. In a Case where Thrust Counterforces of all of the Rolls Other than the Backup Rolls can be Measured)

(for Four-High Rolling Mill)

In a case of a four-high rolling mill, as in the case of using a pair cross mill, the number of the unknowns involved in the equilibrium conditions relating to the forces and the moments is 13, and the number of the equations is 10. The unknowns exceed the equations by three, and thus all of the unknowns cannot be determined by performing the measurement only once. Hence, the measurement is performed a plurality of times on, for example, at least one roll with an unchanged kiss roll load while changing a cross angle relative to the entire roll assembly (hereinafter, also referred to as "relative cross angle"). In the following, a case where the measurement of the backup roll counterforces and the thrust counterforces is performed while changing an inter-roll cross angle of the lower work roll 2 with respect to the entire roll assembly to identify the thrust counterforce working point positions of the backup rolls 3 and 4 will be discussed.

At this time, the inter-roll cross angle $\phi_{WW}$ between the upper and lower work rolls 1 and 2 and the inter-roll cross angle $\phi_{WB}^{B}$ between the lower work roll 2 and the lower backup roll 4 vary. On the other hand, a relative angle between the upper work roll 1 and the lower backup roll 4 does not vary. Hence, a constant C is used, with which these inter-roll cross angles establish the following Formula (8). With Formula (8) taken into consideration, the number of the unknowns including C is 14, and the number of the equations including Formula (8) is 11.

[Expression 8]

$$\phi_{WW}+\phi_{WB}^{B}=C \tag{8}$$

As a number of the levels is increased by 1, the number of the equations including Formula (8) shown above is increased by 9. At the same time, regarding the unknowns, in a case where the friction coefficient is made constant and a kiss roll tightening load is unchanged, the working point positions of the thrust counterforces acting on the upper and lower backup roll chocks 7*a*, 7*b*, 8*a*, and 8*b* do not fluctuate. Therefore, unknowns that vary by changing a relative cross angle of the lower work roll are seven unknowns including $\phi_{WW}$, $\phi_{WB}^{B}$, $T_{W}^{T}$, $T_{W}^{B}$, $p^{df}_{WB}{}^{T}$, $p^{df}_{WB}{}^{B}$ and $p^{df}_{WW}$.

That is, performing the measurement under relative cross angle conditions for the lower work roll at 3 levels in total produces 28 unknowns in total and 29 equations in total, and thus the equations outnumber the unknowns, enabling all of the unknowns to be determined.

(For Six-High Rolling Mill)

In a case of a six-high rolling mill, the number of the unknowns involved in the equilibrium conditions relating to the forces and the moments is 19, and the number of the equations is 16. The unknowns exceed the equations by three, and thus all of the unknowns cannot be determined by performing the measurement only once. Hence, the measurement is performed a plurality of times on, for example, at least one roll with an unchanged kiss roll load while changing the relative cross angle. In the following, a case where the measurement of the backup roll counterforces and the thrust counterforces is performed while changing an inter-roll cross angle of the lower work roll 2 with respect to the entire roll assembly to identify the thrust counterforce working point positions of the backup rolls 3 and 4 will be discussed.

At this time, the inter-roll cross angle $\phi_{WW}$ between the upper and lower work rolls 1 and 2 and the inter-roll cross angle $\phi_{WI}^{B}$ between the lower work roll 2 and the lower intermediate roll 32 vary. On the other hand, a relative angle between the upper work roll 1 and the lower intermediate roll 32 does not vary. Hence, a constant C' is used, with which these inter-roll cross angles establish the following Formula (9). With Formula (9) taken into consideration, the number of the unknowns including C' is 20, and the number of the equations including Formula (9) is 17.

[Expression 9]

$$\phi_{WW}+\phi_{WI}^{B}=C' \tag{9}$$

As a number of the levels is increased by 1, the number of the equations including Formula (9) shown above is increased by 13. At the same time, regarding the unknowns, in a case where the friction coefficient is made constant (i.e., $\mu=\mu_{IB}^{T}=\mu_{WI}^{T}=\mu_{WW}=\mu_{WI}^{B}=\mu_{IB}^{B}$) and a kiss roll tightening load is unchanged, the working point positions of the thrust counterforces acting on the upper and lower backup roll chocks 7*a*, 7*b*, 8*a*, and 8*b* do not fluctuate. Therefore, unknowns that vary by changing a relative cross angle of the lower work roll are nine unknowns including $\phi_{WW}$, $\phi_{WI}^{B}$, $T_{B}^{T}$, $T_{B}^{B}$, $p^{df}_{IB}{}^{T}$, $p^{df}_{WI}{}^{B}$, $p^{df}_{WW}$, $p^{df}_{WI}{}^{B}$, and $p^{df}_{IB}{}^{B}$.

That is, performing the measurement under relative cross angle conditions for the lower work roll at 2 levels in total produces 29 unknowns in total and 30 equations in total, and thus the equations outnumber the unknowns, enabling all of the unknowns to be determined.

In a rolling mill that includes, for example, hydraulic cylinders in gaps between its housing and roll chocks, the change of the relative cross angle of the lower work roll can be easily made by changing a difference in rolling direction load between the work side and the drive side. In addition, performing the measurement with more levels of the relative cross angle of the lower work roll allows use of solutions of least squares of the equations, enabling further improvement in calculation accuracy.

Furthermore, this identification method is given the assumption that the friction coefficients between the rolls are all equal to one another, as in the case of changing the inter-roll cross angle between the upper and lower work rolls 1 and 2. However, in a case where, for example, roll surface roughness or the like is predominant, the friction coefficients between the rolls differ, which may degrade calculation accuracy. In the case of the four-high rolling mill, when the assumption is excluded, the number of the equations becomes nine. However, performing the measurement under the inter-roll cross angle conditions for the upper and lower work rolls 1 and 2 at 4 levels in total can produce 35 unknowns in total and 36 equations in total. In the case of the six-high rolling mill, when the assumption relating to the friction coefficient is excluded, the number of the equations becomes 13. However, performing the measurement under the inter-roll cross angle conditions for the upper and lower work rolls 1 and 2 at 3 levels in total can produce 38 unknowns in total and 39 equations in total. The equations thus can outnumber the unknowns, enabling all of the unknowns to be determined.

The method for identifying the thrust counterforce working point positions of the backup rolls that is performed while the relative cross angle condition of the lower work roll is changed can be performed specifically as follows. Such an identification method is performed by, for example, the arithmetic device 21 illustrated in FIG. 1A.

As illustrated in FIG. 6A, first, with N denoting a level number of a relative cross angle of a given roll, the level number N is set to one (S300*a*). Next, the relative cross angle of at least one roll at the level N is set (S310*a*), and then a pressing-down load is applied by the pressing-down device until a predetermined kiss roll tightening load is reached, bringing about a kiss roll tightened state (S320*a*). Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf.

Then, in the kiss roll tightened state, the backup roll counterforces acting on the backup rolls 3 and 4 in the vertical direction at their reduction support positions are measured (S330*a*). In addition, the thrust counterforces acting on the rolls other than the backup rolls 3 and 4 in the roll-axis direction are measured (S340*a*). For example, in the case of the four-high rolling mill, thrust counterforces of the upper work roll 1 and the lower work roll 2 are measured. In the case of the six-high rolling mill, thrust counterforces of the upper work roll 1 and the lower work roll 2, and thrust counterforces of the upper intermediate roll 31 and the lower intermediate roll 32 are measured.

Upon the measurement of the backup roll counterforces and the thrust counterforces at one level, the level number N is increased by one (S350*a*), and whether the level number N has exceeded a minimum level number m, at which the equilibrium equations can outnumber the unknowns, is determined (S360*a*). The minimum level number m at which the equilibrium equations can outnumber the unknowns is determined beforehand. For example, for the four-high rolling mill, the number of the levels is three (m=3), and for the six-high rolling mill, the number of levels is two (m=2). In step S360*a*, in a case where N is not more than the minimum level number m at which the equilibrium equations can outnumber the unknowns, processes of steps S310*a* to S350*a* are repeatedly performed.

In contrast, in step S360*a*, in a case where N is more than the minimum level number m at which the equilibrium equations can outnumber the unknowns, the thrust counterforce working point positions of the backup rolls are determined by solving the equilibrium conditional expressions relating to the forces of the rolls in the roll-axis direction and the equilibrium conditional expressions of the moments of the rolls (S370*a*). For example, in the case of the four-high rolling mill, the thrust counterforce working point positions of the backup rolls are determined by solving the four equilibrium conditional expressions relating to the forces in the roll-axis direction shown in Formulas (1-1) to (1-4) shown above and the four equilibrium conditional expressions of the moments shown in Formulas (1-5) to (1-8) shown above, for the work rolls 1 and 2 and the backup rolls 3 and 4. In the case of the six-high rolling mill, the thrust counterforce working point positions of the backup rolls are determined by solving the six equilibrium conditional expressions relating to the forces in the roll-axis direction shown in Formulas (2-1) to (2-6) shown above and the six equilibrium conditional expressions of the moments shown in Formulas (2-7) to (2-12) shown above, for the work rolls 1 and 2, the intermediate rolls 31 and 32, and the backup rolls 3 and 4.

As seen from the above, the thrust counterforce working point positions of the backup rolls can be identified even in a rolling mill other than a pair cross mill by setting a relative cross angle with respect to an entire roll assembly to at least one roll, and measuring the pressing-down load in the kiss roll tightened state with a plurality of relative cross angles.

(ii. In a Case where Thrust Counterforces of Only Either the Work Rolls or the Intermediate Rolls can be Measured in the Six-High Rolling Mill)

Next, based on FIG. 6B, a method for identifying thrust counterforce working point positions of backup rolls that is performed while a relative cross angle conditions for a lower work roll is changed in a six-high rolling mill that allows thrust counterforces of only either its work rolls or its intermediate rolls to be measured will be described.

In the six-high rolling mill, for example, in a case where only the thrust counterforces $T_W^T$ and $T_W^B$ of the work rolls can be measured, the thrust counterforces $T_I^T$ and $T_I^B$ of the intermediate rolls are unknowns, and in a case where only the thrust counterforces $T_I^T$ and $T_I^B$ of the intermediate rolls can be measured, the thrust counterforces $T_W^T$ and $T_W^B$ of the work rolls are unknowns. Therefore, the number of the unknowns increases by 2 to 22 as compared with the case of the six-high rolling mill in which the thrust counterforces of the work rolls and the intermediate rolls can be measured. At the same time, the equations applicable to determining these unknowns include, as described above, the 6 equilibrium conditional expressions relating to the forces of the rolls in the roll-axis direction shown in Formulas (2-1) to (2-6) shown above, the 6 equilibrium conditional expressions relating to the moments of the rolls shown in Formulas (2-7) to (2-12) shown above, the 4 assumption expressions that assume the friction coefficients between the rolls to be equal, and Formula (9) shown above relating to the inter-roll cross angle, 17 in total.

As a number of the levels is increased by 1, the number of the equations is increased by 13, and the number of the unknowns is increased by 11. Therefore, performing the measurement under relative cross angle conditions for the lower work roll at 4 levels in total produces 55 unknowns in total and 56 equations in total, and thus the equations outnumber the unknowns, enabling all of the unknowns to be determined.

When the assumption that the friction coefficients between the rolls are all equal to each other is excluded, the number of the equations becomes 13. In this case, performing the measurement under the inter-roll cross angle conditions for the upper and lower work rolls 1 and 2 at 6 levels in total can produce 77 unknowns in total and 78 equations in total. The equations thus can outnumber the unknowns, enabling all of the unknowns to be determined.

The method for identifying thrust counterforce working point positions of backup rolls that is performed while a relative cross angle conditions for a lower work roll is changed in a six-high rolling mill that allows thrust counterforces of only either its work rolls or its intermediate rolls to be measured can be performed specifically as follows. Such an identification method is performed by, for example, the arithmetic device 21 illustrated in FIG. 1B.

Figure 6B:
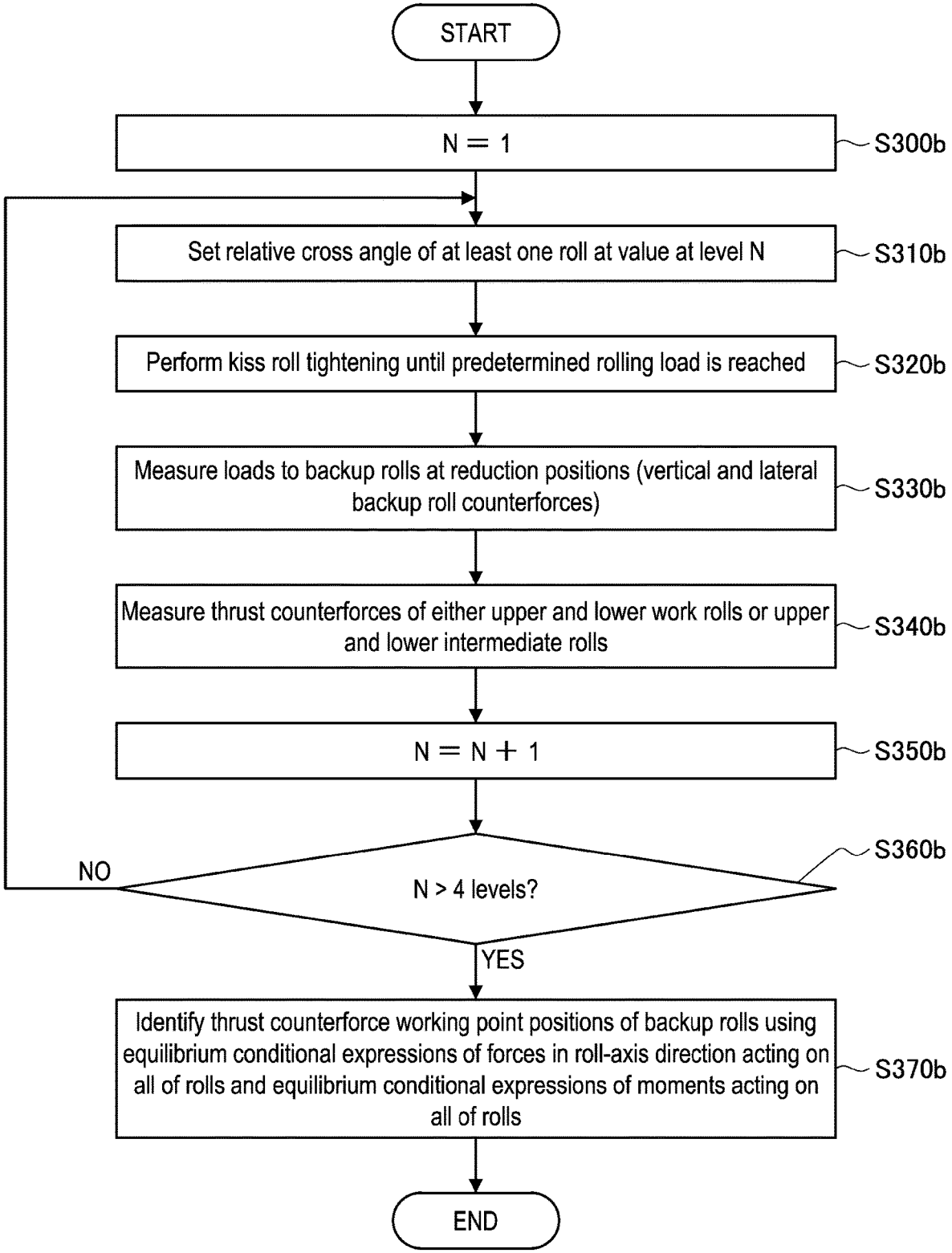
FIG. 6B is a flowchart illustrating another example of a method for identifying thrust counterforce working point positions of backup rolls according to the embodiment, where the method is performed using a normal rolling mill while an inter-roll cross angle is changed.

As illustrated in FIG. 6B, first, with N denoting a level number of a relative cross angle of a given roll, the level number N is set to one (S300*b*). Next, the relative cross angle of at least one roll at the level N is set (S310*b*), and then a pressing-down load is applied by the pressing-down device until a predetermined kiss roll tightening load is reached, bringing about a kiss roll tightened state (S320*b*). Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf. Then, in the kiss roll tightened state, the backup roll counterforces acting on the backup rolls 3 and 4 in the vertical direction at their reduction support positions are measured (S330*b*). In addition, the thrust counterforces that act in the roll-axis direction on either the upper work roll 1 and the lower work roll 2 or the upper intermediate roll 31 and the lower intermediate roll 32 are measured (S340*b*).

Upon the measurement of the backup roll counterforces and the thrust counterforces at one level, the level number N is increased by one (S350*b*), and whether the level number N has exceeded a minimum level number, at which the equilibrium equations can outnumber the unknowns, is determined (S360*b*). The minimum level number at which the equilibrium equations can outnumber the unknowns is determined beforehand; four levels in the present example. In step S360*b*, in a case where N is not more than the minimum level number at which the equilibrium equations can outnumber the unknowns, processes of steps S310*b* to S350*b* are repeatedly performed. In contrast, in step S360*b*, in a case where N is more than the minimum level number at which the equilibrium equations can outnumber the unknowns, the six equilibrium conditional expressions relating to the forces of the rolls in the roll-axis direction shown in Formulas (2-1) to (2-6) shown above and the six equilibrium conditional expressions of the moments of the rolls shown in Formulas (2-7) to (2-12) shown above are solved to determine the thrust counterforce working point positions of the backup rolls (S370*b*).

As seen from the above, the thrust counterforce working point positions of the backup rolls can be identified even in a rolling mill other than a pair cross mill by setting a relative cross angle with respect to an entire roll assembly to at least one roll, and measuring the pressing-down load in the kiss roll tightened state with a plurality of relative cross angles.

A specific example of the method for identifying thrust counterforce working point positions of backup rolls according to the present embodiment is described above. Although the specific example is described about a case where either the inter-roll cross angle or the friction coefficient between rolls is changed to generate different thrust forces, note that the present invention is not limited to such an example. For example, in a case where the minimum level number at which the equilibrium equations can outnumber the unknowns cannot be set only by changing the inter-roll cross angle to increase the number of levels, the number of levels may be increased by changing the friction coefficient. Conversely, in a case where the minimum level number at which the equilibrium equations can outnumber the unknowns cannot be set only by changing the friction coefficient to increase the number of levels, the number of levels may be increased by changing the inter-roll cross angle. In either case, performing the measurement a plurality of times causes the equilibrium conditional expressions outnumber the unknowns, enabling all of the unknowns to be determined.

(3) Relation Between Kiss Roll Tightening Load and Working Point Positions

Figure 7:
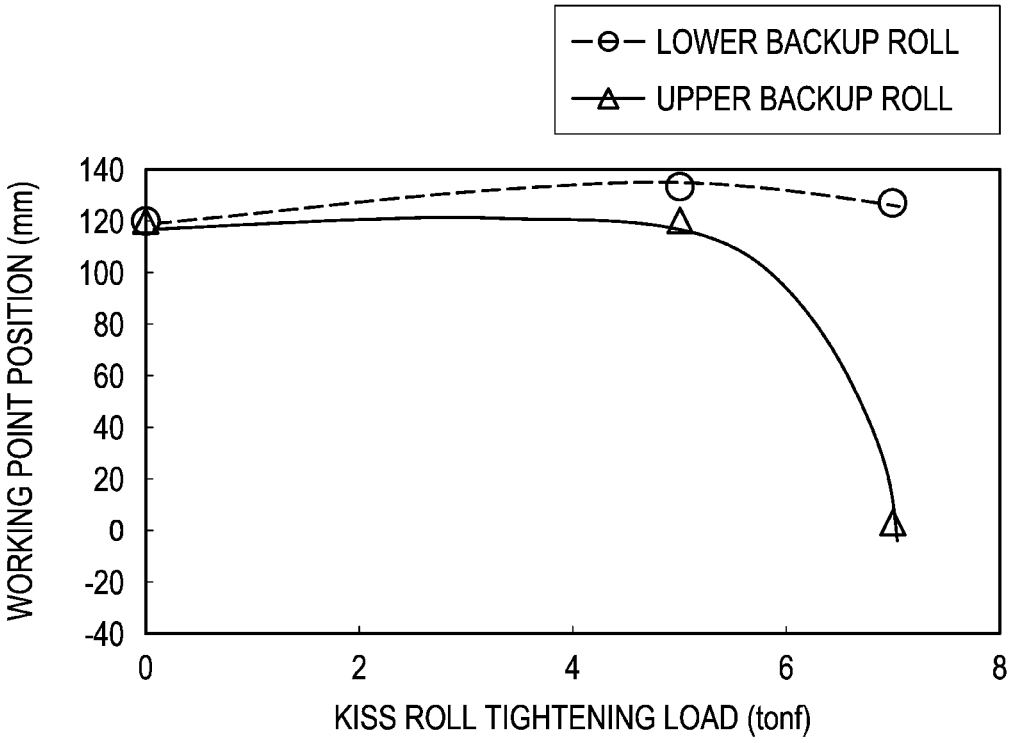
FIG. 7 is an explanatory diagram illustrating an example of a relation between kiss roll tightening load and thrust counterforce working point positions.

By the method for identifying thrust counterforce working point positions of backup rolls described above, a relation between kiss roll tightening load and thrust counterforce working point positions of backup rolls 3 and 4 as shown in FIG. 7 is acquired. As illustrated in FIG. 7, the thrust counterforce working point positions of the upper backup roll 3 and the lower backup roll 4 both vary little until the kiss roll tightening load ranges from zero to a given kiss roll tightening load, but as the kiss roll tightening load becomes more than the given kiss roll tightening load, the thrust counterforce working point positions of the backup rolls 3 and 4 decreases to come close to a roll axial center. In particular, the thrust counterforce working point position of the upper backup roll 3 sharply decreases when exceeding the given kiss roll tightening load. In this manner, the thrust counterforce working point positions of the backup rolls 3 and 4 vary in accordance with the kiss roll tightening load.

By acquiring such a relation between the rolling load and the thrust counterforce working point positions of the backup rolls 3 and 4, the thrust counterforce working point positions of the backup rolls 3 and 4 to be applied can be determined in accordance with at least one of a setting value and an actual value of the rolling load in rolling. The relation between the rolling load and the thrust counterforce working point positions of the backup rolls 3 and 4 can be introduced to a system by use of, for example, a model or a table that represents a correlation between the rolling load and the thrust counterforce working point positions of the backup rolls 3 and 4.

The backup roll chocks 7*a*, 7*b*, 8*a*, and 8*b* simultaneously receive backup roll counterforces that are much larger than the thrust counterforces, and thus their thrust counterforce working point positions generally fluctuate in accordance with magnitudes of the backup roll counterforces. The backup roll counterforces during rolling are, namely, rolling reaction forces, which vary in accordance with operational conditions such as a material of a rolled material and a rolling reduction rate. The magnitudes of the backup roll counterforces in turn vary, causing the thrust counterforce working point positions of the backup rolls 3 and 4 to vary. By making a model or a table of the relation between the rolling load and the thrust counterforce working point positions, the thrust counterforce working point positions of the backup rolls 3 and 4 can be set appropriately in accordance with the rolling load in rolling. As a result, computation for an optimum leveling control input can be performed more accurately.

2. Method for Rolling Rolled Material

Next, reduction position setting and reduction position control in rolling a rolled material using the thrust counterforce working point positions of the backup rolls 3 and 4 identified by the method for identifying thrust counterforce working point positions of backup rolls will be described.

[2-1. Reduction Position Setting by Zero Adjustment]

Figure 8A:
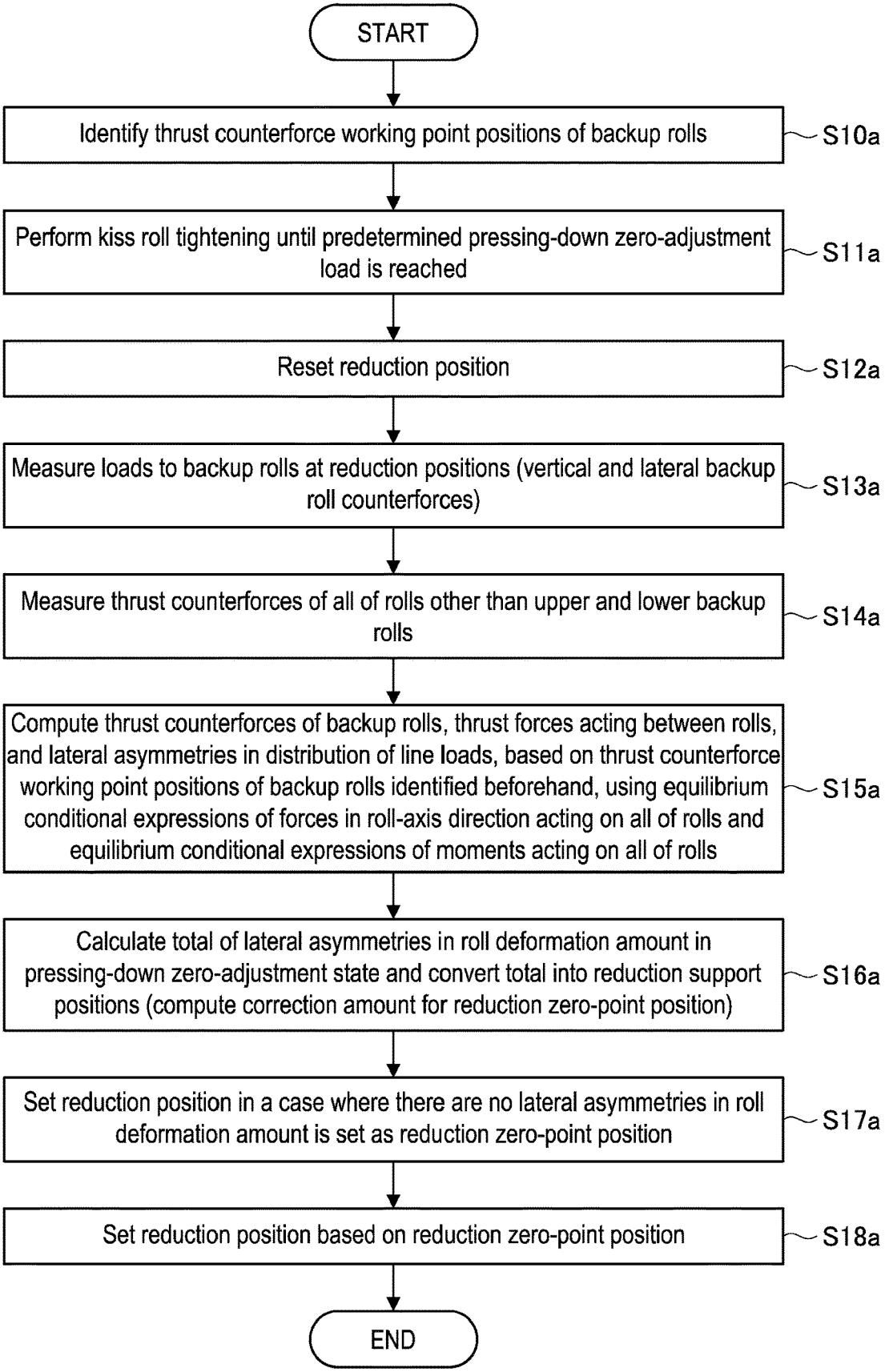
FIG. 8A is a flowchart illustrating an example of processing for reduction position setting by zero adjustment using a pressing-down device according to the present embodiment.
Figure 8B:
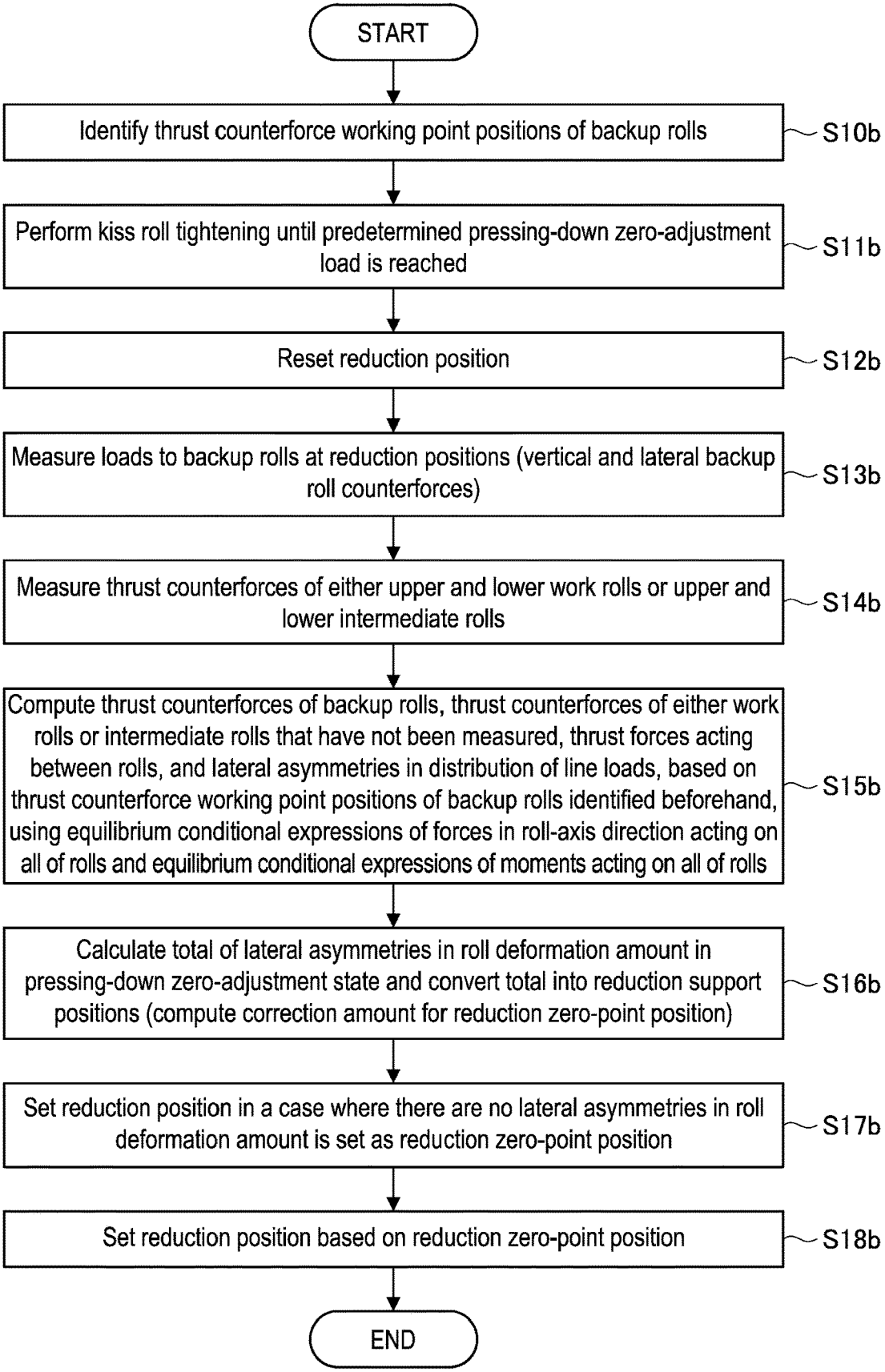
FIG. 8B is a flowchart illustrating another example of processing for reduction position setting by zero adjustment using the pressing-down device according to the present embodiment.

First, based on FIG. 8A and FIG. 8B, reduction position setting by zero adjustment using a pressing-down device will be described as reduction position setting for the rolling mill 100. FIG. 8A and FIG. 8B are flowcharts each illustrating processing for the reduction position setting by zero adjustment using a pressing-down device. Processing illustrated in FIG. 8A is feasible for a rolling mill that can measure thrust counterforces of all of its rolls other than its backup rolls and applicable to a rolling mill of four-high or more. Processing illustrated in FIG. 8B is applicable to a six-high rolling mill that allows thrust counterforces of only either its work rolls or its intermediate rolls to be measured.

A zero point of a pressing-down device deviates by a difference in roll flatness between the work side and the drive side caused by a difference in distribution of line loads acting on the rolls of the rolling mill 100 between the work side and the drive side, from a true reduction position at which rolling is performed evenly between the work side and the drive side with no inter-roll thrust forces occurring. It is therefore necessary to correct this amount of error always in the reduction position setting or to correct, more practically, the zero point itself with the amount of error taken into consideration. In either case, it is necessary to measure the backup roll counterforces of the backup rolls 3 and 4 at their reduction support positions and the thrust counterforces acting on the rolls other than the backup rolls 3 and 4 to estimate the difference between the work side and the drive side in distribution of line loads acting on the rolls. If either of the measured values is lacking, the number of the unknowns is eight or more in a case of, for example, a four-high rolling mill, which makes it impossible to estimate the difference between the work side and the drive side in distribution of line loads acting on the rolls.

In a case where the rolling mill 100 is not a four-high rolling mill but a six-high rolling mill, further including intermediate rolls, a number of inter-roll contact zones is increased by one every increase of one in a number of the intermediate rolls. Also in this case, a number of unknowns increased by measuring thrust counterforces of the intermediate rolls is two: a thrust force that acts on an increased inter-roll contact zone and a difference in distribution of line loads between the work side and the drive side. At the same time, a number of available equations is also increased by two: an equilibrium conditional expression relating to a force of the intermediate roll in the roll-axis direction and an equilibrium conditional expression of a moment of the intermediate roll; therefore, by combining the two equations with the equations relating to the other rolls, all of the equations can be solved.

In this manner, by measuring the thrust counterforces acting on all of the rolls other than at least the backup rolls, differences between the work side and the drive side in distribution of line loads acting between all of the rolls in the kiss roll state can be determined accurately even in a case of a rolling mill of four-high or more. This enables the zero adjustment with the pressing-down device to be performed accurately including particularly asymmetry between the work side and the drive side.

(i. In a Case where Thrust Counterforces of all of the Rolls Other than the Backup Rolls can be Measured)

First, processing in a rolling mill of four-high or more in which thrust counterforces of all of its rolls other than its backup rolls can be measured will be described. As illustrated in FIG. 8A, first, the thrust counterforce working point positions of the backup rolls 3 and 4 are identified (S10*a*). As the identification process in step S10*a*, for example, any one of the methods for identifying thrust counterforce working point positions of backup rolls 3 and 4 illustrated in FIG. 4A, FIG. 5, and FIG. 6A may be used.

Next, a pressing-down load is applied by the pressing-down device until the pressing-down load reaches a predetermined pressing-down zero-adjustment load, so as to bring about the kiss roll tightened state (S11*a*), and a reduction position is reset (S12*a*).

The pressing-down zero-adjustment load is set at, for example, about 1000 tonf in a case of a hot rolling mill. In step S12*a*, for example, the reduction position may be reset to zero. Then, in the kiss roll tightened state, the backup roll counterforces acting on the backup rolls 3 and 4 at their reduction support positions in the vertical direction are measured (S13*a*). In addition, the thrust counterforces acting on the rolls other than the backup rolls 3 and 4 in the roll-axis direction are measured (S14*a*). In the case of a four-high rolling mill, thrust counterforces of the upper work roll 1 and the lower work roll 2 are measured, and in the case of a six-high rolling mill, thrust counterforces of the upper work roll 1 and the lower work roll 2, and thrust counterforces of the upper intermediate roll 31 and the lower intermediate roll 32 are measured.

Thereafter, based on the thrust counterforce working point positions of the backup rolls 3 and 4 that are identified beforehand in step S10*a*, the thrust counterforces of the backup rolls 3 and 4, the thrust forces acting between all of the rolls, and the lateral asymmetries in distribution of line loads acting between all of the rolls are computed (S15*a*). The thrust forces and the lateral asymmetries in the distribution of line loads are acquired as those between the rolls including the work rolls 1 and 2 and the backup rolls 3 and 4 in the case of a four-high rolling mill and are acquired as those between the rolls including the work rolls 1 and 2, the intermediate rolls 31 and 32, and the backup rolls 3 and 4 in the case of a six-high rolling mill.

At the thrust counterforce working point positions of the backup rolls 3 and 4, thrust counterforce working point positions corresponding to the pressing-down zero-adjustment load are set. The thrust counterforces, the thrust forces, and the lateral asymmetries in distribution of line loads can be determined by computing the equilibrium conditional expressions relating to the forces in the roll-axis direction and the equilibrium conditional expressions of the moments described above. Specifically, in the case of the four-high rolling mill, the thrust counterforces, the thrust forces, and the lateral asymmetries in distribution of line loads can be determined based on the equilibrium conditional expressions relating to the forces of the work rolls 1 and 2 and the backup rolls 3 and 4 in the roll-axis direction shown in Formulas (1-1) to (1-4) and the equilibrium conditional expressions of the moments of the work rolls 1 and 2 and the backup rolls 3 and 4 shown in Formulas (1-5) to (1-8) shown above. In the case of the six-high rolling mill, the thrust counterforces, the thrust forces, and the lateral asymmetries in distribution of line loads can be determined based on the equilibrium conditional expressions relating to the forces of the work rolls 1 and 2, the intermediate rolls 31 and 32, and the backup rolls 3 and 4 in the roll-axis direction shown in Formulas (2-1) to (2-6) and the equilibrium conditional expressions of the moments of the work rolls 1 and 2, the intermediate rolls 31 and 32, and the backup rolls 3 and 4 shown in Formulas (2-7) to (2-12) shown above.

Then, based on a result of the computation in step S15*a*, a total of lateral asymmetries in roll deformation amount in a pressing-down zero-adjustment state is calculated, and the lateral asymmetries in roll deformation amount are converted into reduction support positions (S16*a*). This calculates a correction amount for a reduction zero-point position.

Next, a reduction position in a case where there are no lateral asymmetries in roll deformation amount is set as the reduction zero-point position (S17*a*). That is, the reduction zero-point position is corrected by the correction amount calculated in step S16*a*. Then, based on the corrected reduction zero-point position, the reduction position is set (S18*a*).

(ii. In a Case where Thrust Counterforces of Only Either the Work Rolls or the Intermediate Rolls can be Measured in the Six-High Rolling Mill)

Next, processing in a six-high rolling mill that allows thrust counterforces of only either its work rolls or its intermediate rolls to be measured will be described. As illustrated in FIG. 8B, first, the thrust counterforce working point positions of the backup rolls 3 and 4 are identified (S10*b*). As the identification process in step S10*b*, for example, any one of the methods for identifying thrust counterforce working point positions of backup rolls 3 and 4 illustrated in FIG. 4B, FIG. 5, and FIG. 6B may be used.

Next, a pressing-down load is applied by the pressing-down device until the pressing-down load reaches a predetermined pressing-down zero-adjustment load, so as to bring about the kiss roll tightened state (S11*b*), and a reduction position is reset (S12*b*). The pressing-down zero-adjustment load is set at, for example, about 1000 tonf in a case of a hot rolling mill. In step S12*b*, for example, the reduction position may be reset to zero. Then, in the kiss roll tightened state, the backup roll counterforces acting on the backup rolls 3 and 4 in the vertical direction at their reduction support positions are measured (S13*b*). In addition, the thrust counterforces acting on either the work rolls 1 and 2 or the intermediate rolls 31 and 32 in the roll-axis direction are measured (S14*b*).

Thereafter, based on the thrust counterforce working point positions of the backup rolls 3 and 4 that are identified beforehand in step S10*b*, the thrust counterforces of the backup rolls 3 and 4, the thrust counterforces of either the work rolls 1 and 2 or the intermediate rolls 31 and 32 that have not been measured, the thrust forces acting between all of the rolls (i.e., the work rolls 1 and 2, the intermediate rolls 31 and 32, and the backup rolls 3 and 4), and the lateral asymmetries in distribution of line loads acting between all of the rolls are computed (S15*b*).

At the thrust counterforce working point positions of the backup rolls 3 and 4, thrust counterforce working point positions corresponding to the pressing-down zero-adjustment load are set. The thrust counterforces, the thrust forces, and the lateral asymmetries in distribution of line loads can be determined based on the equilibrium conditional expressions relating to the forces of the work rolls 1 and 2, the intermediate rolls 31 and 32, and the backup rolls 3 and 4 in the roll-axis direction shown in Formulas (2-1) to (2-6) shown above and the equilibrium conditional expressions of the moments of the work rolls 1 and 2, the intermediate rolls 31 and 32, and the backup rolls 3 and 4 shown in Formulas (2-7) to (2-12) shown above.

Then, based on a result of the computation in step S15*b*, a total of lateral asymmetries in roll deformation amount in a pressing-down zero-adjustment state is calculated, and the lateral asymmetries in roll deformation amount are converted into reduction support positions (S16*b*). This calculates a correction amount for a reduction zero-point position.

Next, a reduction position in a case where there are no lateral asymmetries in roll deformation amount is set as the reduction zero-point position (S17*b*). That is, the reduction zero-point position is corrected by the correction amount calculated in step S16*b*. Then, based on the corrected reduction zero-point position, the reduction position is set (S18*b*).

The processing for the zero adjustment using a pressing-down device is described above. In the processing for the zero adjustment using a pressing-down device, the method for identifying thrust counterforce working point positions of backup rolls 3 and 4 described above is used to identify the thrust counterforce working point positions of the backup rolls 3 and 4, by which the zero adjustment can be performed more accurately. As a result, the adjustment of a reduction position of a rolling mill can be performed with high accuracy.

Note that in a case of using a plurality of pressing-down zero-adjustment loads, the measurement of the thrust forces may be performed with a pressing-down zero-adjustment load at each of a plurality of levels, or a model or a table that represents a correlation between the rolling load and the thrust counterforce working point position of the backup rolls 3 and 4 may be used.

[2-2. Reduction Position Setting in Accordance with Deformation Characteristics of a Housing-Pressing-Down System]

Figure 9A:
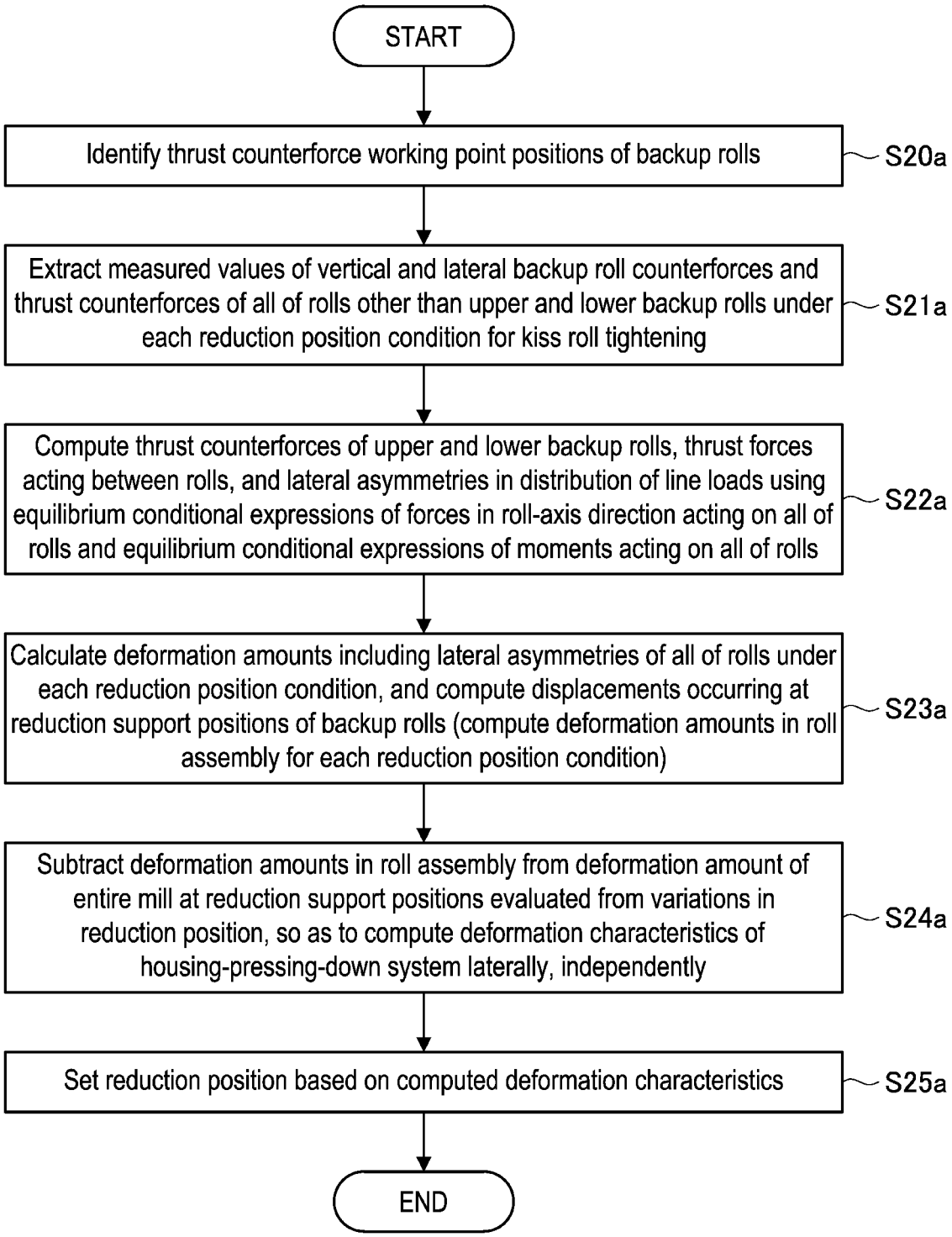
FIG. 9A is a flowchart illustrating an example of processing for reduction position setting in accordance with deformation characteristics of a housing-pressing-down system according to the present embodiment.
Figure 9B:
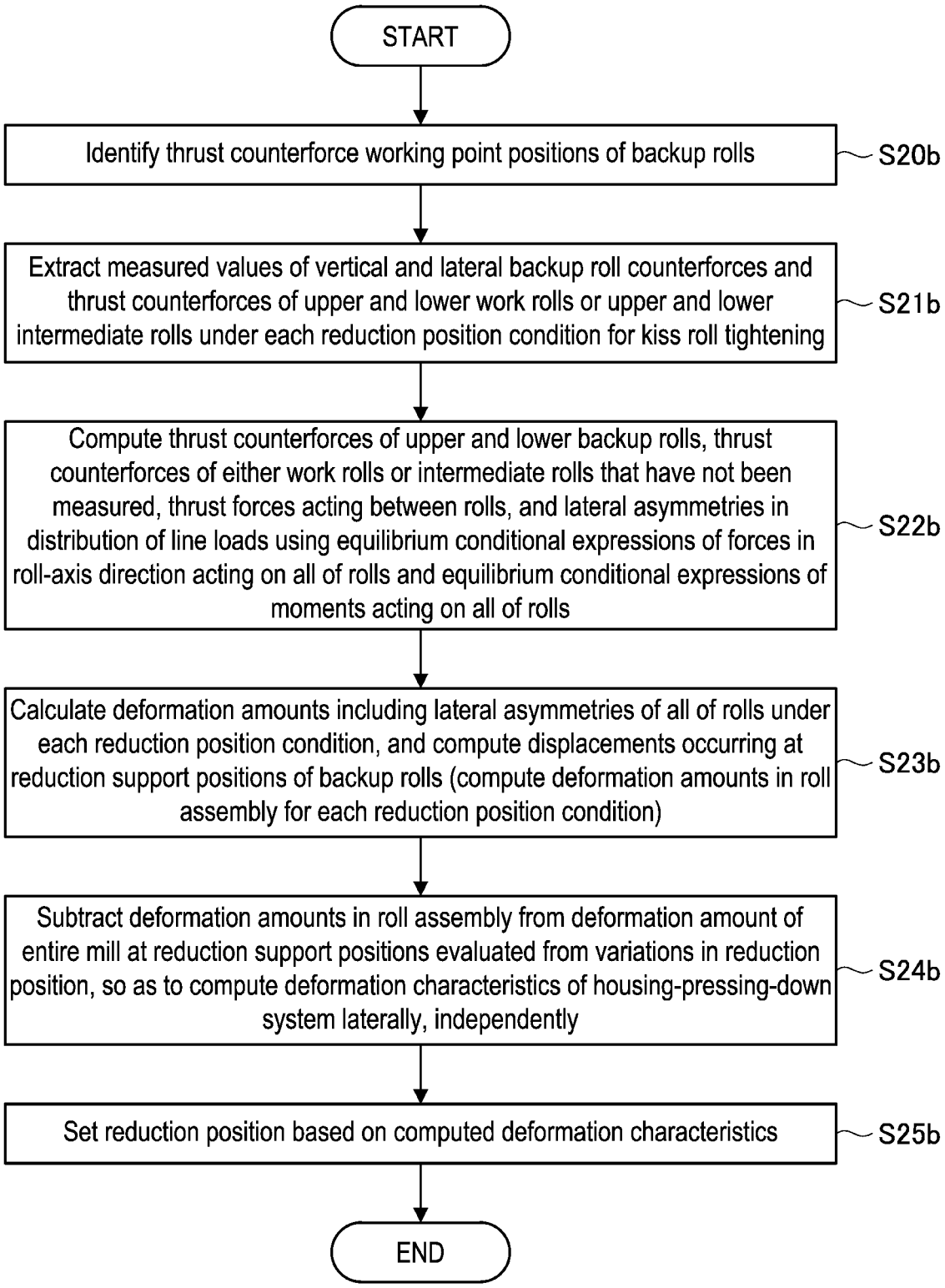
FIG. 9B is a flowchart illustrating another example of processing for reduction position setting in accordance with deformation characteristics of the housing-pressing-down system according to the present embodiment.

Next, based on FIG. 9A and FIG. 9B, reduction position setting in accordance with deformation characteristics of a housing-pressing-down system will be described as the reduction position setting for the rolling mill 100. FIG. 9A and FIG. 9B are flowcharts each illustrating processing for the reduction position setting in accordance with the deformation characteristics of the housing-pressing-down system. The reduction position setting in accordance with the deformation characteristics of the housing-pressing-down system can be performed concurrently with the reduction position setting by zero adjustment described above. Processing illustrated in FIG. 9A is feasible for a rolling mill that can measure thrust counterforces of all of its rolls other than its backup rolls and applicable to a rolling mill of four-high or more. Processing illustrated in FIG. 9B is applicable to a six-high rolling mill that allows thrust counterforces of only either its work rolls or its intermediate rolls to be measured.

(i. In a Case where Thrust Counterforces of all of the Rolls Other than the Backup Rolls can be Measured)

First, processing in a rolling mill of four-high or more in which thrust counterforces of all of its rolls other than its backup rolls can be measured will be described. As illustrated in FIG. 9A, first, the thrust counterforce working point positions of the backup rolls 3 and 4 are identified (S20*a*). As the identification process in step S20*a*, for example, any one of the methods for identifying thrust counterforce working point positions of backup rolls 3 and 4 illustrated in FIG. 4A, FIG. 5, and FIG. 6A may be used. In a case where the processing illustrated in FIG. 9A is performed concurrently with the reduction position setting by zero adjustment illustrated in FIG. 8A, either step S20*a* or step S10*a* in FIG. 8A is to be performed.

Next, under each reduction position condition for the predetermined kiss roll tightening load given by the pressing-down device, the backup roll counterforces acting on the backup rolls 3 and 4 in the vertical direction at the reduction support positions are measured, and the thrust counterforces acting on the rolls other than the backup rolls 3 and 4 in the roll-axis direction are measured (S21*a*). The thrust counterforces are measured on the upper work roll 1 and the lower work roll 2 in the case of a four-high rolling mill and measured on the upper work roll 1 and the lower work roll 2, and the upper intermediate roll 31 and the lower intermediate roll 32 in the case of a six-high rolling mill. Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf.

Thereafter, based on the thrust counterforce working point positions of the backup rolls 3 and 4 that are identified beforehand in step S20*a*, the thrust counterforces of the backup rolls 3 and 4, the thrust forces acting between all of the rolls, and the lateral asymmetries in distribution of line loads acting between all of the rolls are computed (S22*a*). The thrust forces and the lateral asymmetries in the distribution of line loads are acquired as those between the rolls including the work rolls 1 and 2 and the backup rolls 3 and 4 in the case of a four-high rolling mill and are acquired as those between the rolls including the work rolls 1 and 2, the intermediate rolls 31 and 32, and the backup rolls 3 and 4 in the case of a six-high rolling mill.

At the thrust counterforce working point positions of the backup rolls 3 and 4, thrust counterforce working point positions corresponding to each kiss roll tightening load are set. The thrust counterforces, the thrust forces, and the lateral asymmetries in distribution of line loads can be determined by computing the equilibrium conditional expressions relating to the forces in the roll-axis direction and the equilibrium conditional expressions of the moments described above. Specifically, in the case of the four-high rolling mill, the thrust counterforces, the thrust forces, and the lateral asymmetries in distribution of line loads can be determined based on the equilibrium conditional expressions relating to the forces of the work rolls 1 and 2 and the backup rolls 3 and 4 in the roll-axis direction shown in Formulas (1-1) to (1-4) and the equilibrium conditional expressions of the moments of the work rolls 1 and 2 and the backup rolls 3 and 4 shown in Formulas (1-5) to (1-8) shown above. In the case of the six-high rolling mill, the thrust counterforces, the thrust forces, and the lateral asymmetries in distribution of line loads can be determined based on the equilibrium conditional expressions relating to the forces of the work rolls 1 and 2, the intermediate rolls 31 and 32, and the backup rolls 3 and 4 in the roll-axis direction shown in Formulas (2-1) to (2-6) and the equilibrium conditional expressions of the moments of the work rolls 1 and 2, the intermediate rolls 31 and 32, and the backup rolls 3 and 4 shown in Formulas (2-7) to (2-12) shown above.

Then, based on a result of the computation in step S22*a*, deformation amounts including their lateral asymmetries of all of the rolls are calculated under each reduction position condition, and using the calculated deformation amounts, displacements that occur at the reduction support positions of the backup rolls 3 and 4 are computed (S23*a*). Examples of the deformation amounts of the rolls include deflections of the rolls and flatnesses of the rolls. The deformation amounts of the rolls are calculated on the work rolls 1 and 2 and the backup rolls 3 and 4 in the case of a four-high rolling mill and are calculated on the work rolls 1 and 2, the intermediate rolls 31 and 32, and the backup rolls 3 and 4 in the case of a six-high rolling mill. In step S23*a*, deformation amounts in the roll assembly are computed for each reduction position condition.

Thereafter, the deformation amounts in the roll assembly calculated in step S23*a* is subtracted from a deformation amount of an entire rolling mill at the reduction support positions that is evaluated from variations in the reduction position, so that the deformation characteristics of the housing-pressing-down system of the rolling mill is calculated (S24*a*). The deformation characteristics of the housing-pressing-down system are computed laterally, independently for the work side and the drive side. Then, based on the deformation characteristics of the housing-pressing-down system calculated in step S24*a*, the reduction position is set (S25*a*).

(ii. In a Case where Thrust Counterforces of Only Either the Work Rolls or the Intermediate Rolls can be Measured in the Six-High Rolling Mill)

Next, processing in a six-high rolling mill that allows thrust counterforces of only either its work rolls or its intermediate rolls to be measured will be described. First, the thrust counterforce working point positions of the backup rolls 3 and 4 are identified (S20*b*). As the identification process in step S20*b*, for example, any one of the methods for identifying thrust counterforce working point positions of backup rolls 3 and 4 illustrated in FIG. 4B or FIG. 6B may be used. In a case where the processing illustrated in FIG. 9B is performed concurrently with the reduction position setting by zero adjustment illustrated in FIG. 8B, either step S20*b* or step S10*b* in FIG. 8B is to be performed.

Next, under each reduction position condition for the predetermined kiss roll tightening load given by the pressing-down device, the backup roll counterforces acting on the backup rolls 3 and 4 in the vertical direction at the reduction support positions are measured, and the thrust counterforces acting on either the work rolls 1 and 2 or the intermediate rolls 31 and 32 in the roll-axis direction are measured (S21*b*). Here, the predetermined kiss roll tightening load is to be set at any value not more than a maximum load up to which the rolling mill can apply the load. In a case of a hot rolling mill, for example, the predetermined kiss roll tightening load is preferably set at about 1000 tonf.

Thereafter, based on the thrust counterforce working point positions of the backup rolls 3 and 4 that are identified beforehand in step S20*b*, the thrust counterforces of the backup rolls 3 and 4, the thrust counterforces of either the work rolls 1 and 2 or the intermediate rolls 31 and 32 that have not been measured, the thrust forces acting on all of the rolls (i.e., the work rolls 1 and 2, the intermediate rolls 31 and 32, and the backup rolls 3 and 4), and the lateral asymmetries in distribution of line loads acting on all of the rolls are computed (S22*b*).

At the thrust counterforce working point positions of the backup rolls 3 and 4, thrust counterforce working point positions corresponding to each kiss roll tightening load are set. The thrust counterforces, the thrust forces, and the lateral asymmetries in distribution of line loads can be determined by computing the equilibrium conditional expressions relating to the forces in the roll-axis direction and the equilibrium conditional expressions of the moments described above. That is, the thrust counterforces, the thrust forces, and the lateral asymmetries in distribution of line loads can be determined based on the equilibrium conditional expressions relating to the forces of the work rolls 1 and 2, the intermediate rolls 31 and 32, and the backup rolls 3 and 4 in the roll-axis direction shown in Formulas (2-1) to (2-6) and the equilibrium conditional expressions of the moments of the work rolls 1 and 2, the intermediate rolls 31 and 32, and the backup rolls 3 and 4 shown in Formulas (2-7) to (2-12) shown above.

Then, based on a result of the computation in step S22*b*, deformation amounts including their lateral asymmetries of all of the rolls are calculated under each reduction position condition, and using the calculated deformation amounts, displacements that occur at the reduction support positions of the backup rolls 3 and 4 are computed (S23*b*). Examples of the deformation amounts of the rolls include deflections of the rolls and flatnesses of the rolls, and the deformation amounts are calculated on the work rolls 1 and 2, the intermediate rolls 31 and 32, and the backup rolls 3 and 4. In step S23*b*, deformation amounts in the roll assembly are computed for each reduction position condition.

Thereafter, the deformation amounts in the roll assembly calculated in step S23*b* is subtracted from a deformation amount of an entire rolling mill at the reduction support positions that is evaluated from variations in the reduction position, so that the deformation characteristics of the housing-pressing-down system of the rolling mill is calculated (S24*b*). The deformation characteristics of the housing-pressing-down system are computed laterally, independently for the work side and the drive side. Then, based on the deformation characteristics of the housing-pressing-down system calculated in step S24*b*, the reduction position is set (S25*b*).

The processing for reduction position setting in accordance with deformation characteristics of a housing-pressing-down system is described above. In the processing for the reduction position setting in accordance with deformation characteristics of a housing-pressing-down system, the method for identifying thrust counterforce working point positions of backup rolls 3 and 4 described above is used to identify the thrust counterforce working point positions of the backup rolls 3 and 4, by which the deformation characteristics of the housing-pressing-down system can be determined more accurately. As a result, the adjustment of a reduction position of a rolling mill can be performed with high accuracy.

Note that in a case of using a plurality of pressing-down zero-adjustment loads, the measurement of the thrust forces may be performed with a pressing-down zero-adjustment load at each of a plurality of levels, or a model or a table that represents a correlation between the rolling load and the thrust counterforce working point position of the backup rolls 3 and 4 may be used.

[2-3. Reduction Position Control During Rolling]

Figure 10A:
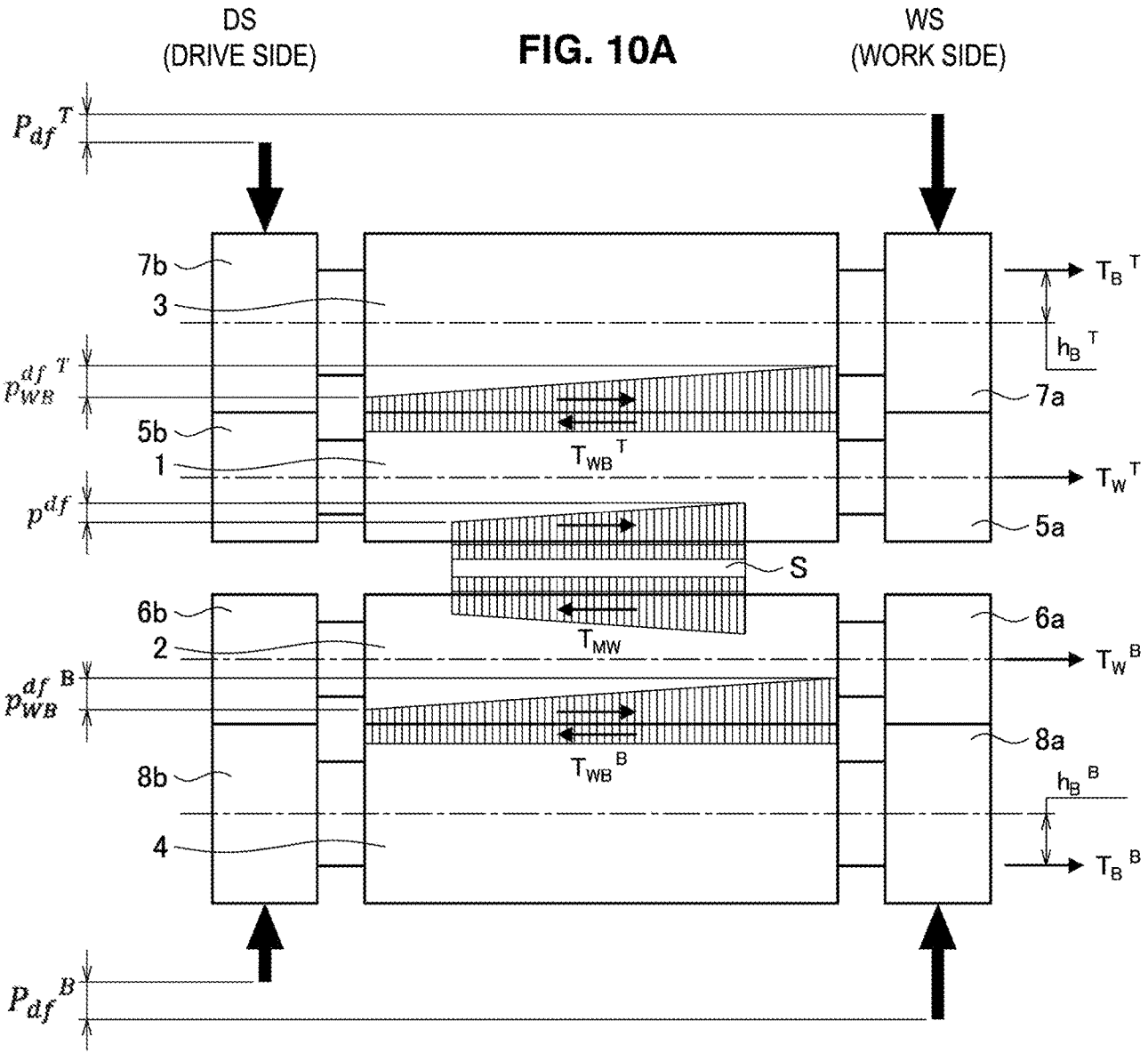
FIG. 10A is a schematic diagram illustrating thrust forces in the roll-axis direction acting on the rolls and perpendicular-direction components asymmetrical between the work side and the drive side during rolling in a four-high rolling mill.
Figure 10B:
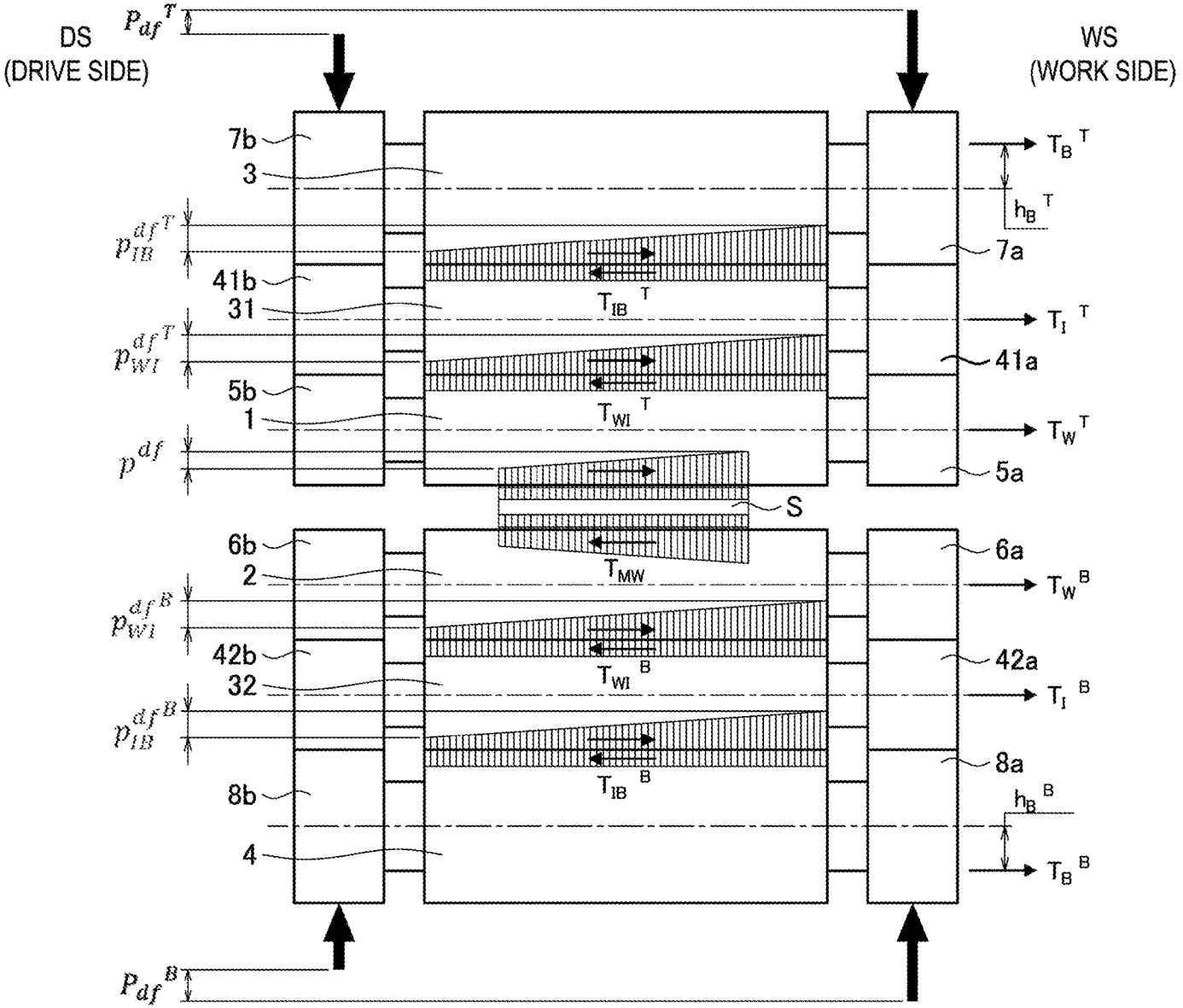
FIG. 10B is a schematic diagram illustrating thrust forces in the roll-axis direction acting on the rolls and perpendicular-direction components asymmetrical between the work side and the drive side during rolling in a six-high rolling mill.
Figure 11A:
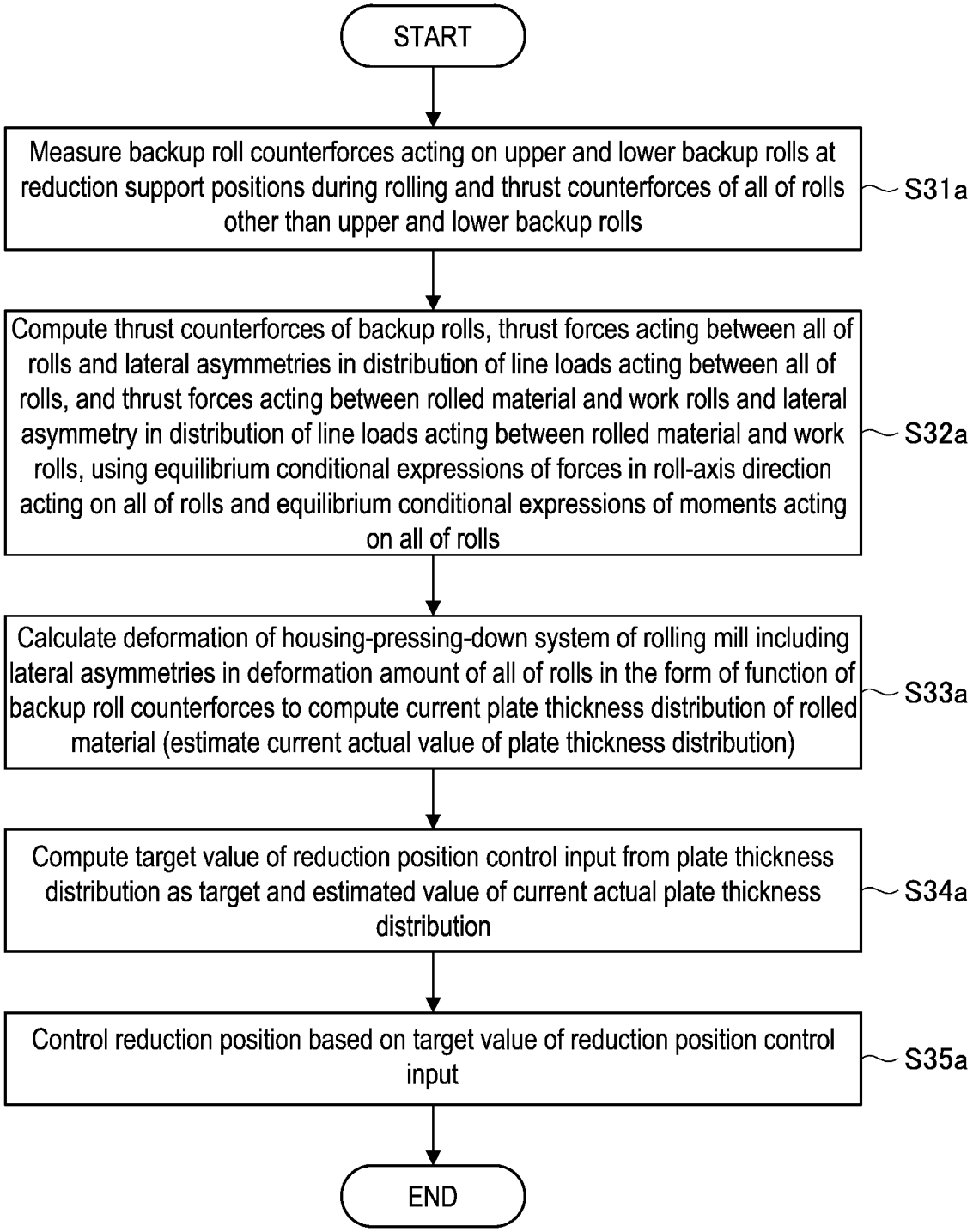
FIG. 11A is a flowchart illustrating an example of processing for reduction position control during rolling according to the present embodiment.
Figure 11B:
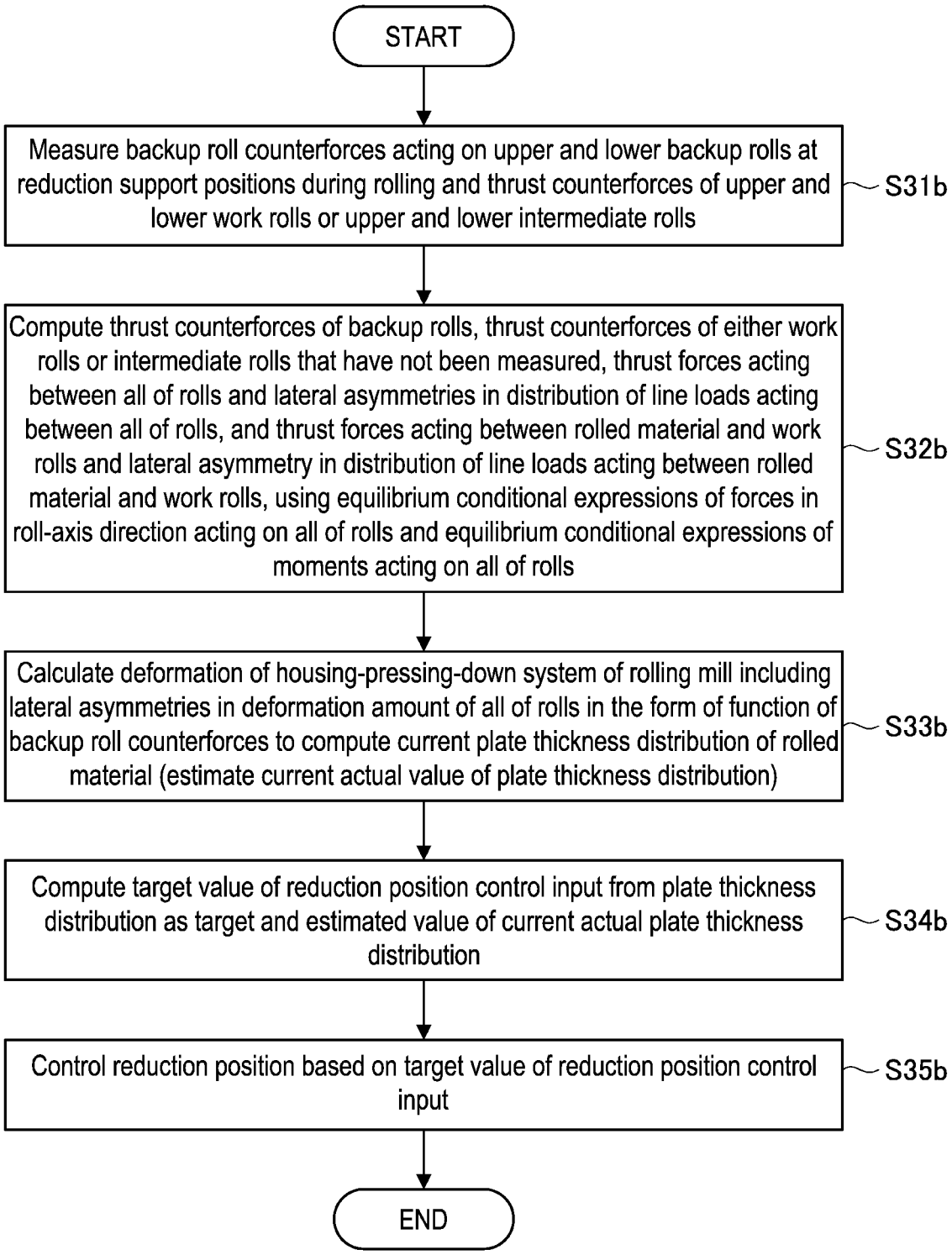
FIG. 11B is a flowchart illustrating another example of processing for reduction position control during rolling according to the present embodiment.

(1) In a Case where Only Asymmetry in Line Load is Taken into Consideration as the Asymmetry in Distribution of Line Loads Next, based on FIG. 10A to FIG. 11B, reduction position control during rolling will be described. FIG. 10A is a schematic diagram illustrating thrust forces in the roll-axis direction acting on the rolls of the four-high rolling mill 100 and perpendicular-direction components asymmetrical between the work side and the drive side, during rolling. FIG. 10B is a schematic diagram illustrating thrust forces in the roll-axis direction acting on the rolls of the six-high rolling mill 200 and perpendicular-direction components asymmetrical between the work side and the drive side, during rolling. FIG. 11A and FIG. 11B are flowcharts each illustrating the reduction position control during rolling. Processing illustrated in FIG. 11A is feasible for a rolling mill that can measure thrust counterforces of all of its rolls other than its backup rolls and applicable to a rolling mill of four-high or more. Processing illustrated in FIG. 11B is applicable to a six-high rolling mill that allows thrust counterforces of only either its work rolls or its intermediate rolls to be measured.

(For Four-High Rolling Mill)

In a normal four-high rolling mill illustrated in FIG. 10A, thrust counterforces in the roll-axis direction acting on its upper and lower work rolls 1 and 2 and backup roll counterforces acting in a vertical direction on its upper backup roll 3 at its reduction support positions are measured. At this time, unknowns of forces involved in the equilibrium conditional expressions relating to the forces in the roll-axis direction and the moments acting on the upper work roll 1 and the upper backup roll 3 are five unknowns: $T_B^T$, $T_{WB}^T$, $p^{df}_{WB}{}^T$, $p^{df}$, and $h_B^T$.

The unknowns do not include a thrust force $T_{MW}$ acting between a rolled material S and the work rolls 1 and 2, and a reason for this is as follows. A thrust force between rolls is produced by contact between elasticity bodies. When roll-axis-direction components of circumferential speed vectors of rolls being in contact with each other do not match due to occurrence of a minute inter-roll cross angle, a direction of a frictional force vector is along the roll-axis direction because magnitudes of circumferential speeds of the rolls at their contact surface are substantially equal. For example, in a case where a minute inter-roll cross angle of about 0.2° occurs, a ratio between a thrust force in the roll-axis direction and a rolling load is about 30%, which is substantially equal to a friction coefficient.

In contrast, in a case of a thrust force acting between the rolled material S and the work rolls 1 and 2, a speed of the rolled material S and circumferential speeds of the work rolls 1 and 2 do not match in magnitude in itself at locations other than a neutral point in a roll bite. For that reason, also in a case where an inter-roll cross angle of about 1° is given as in a cross rolling mill, the direction of the frictional force vector does not match the roll-axis direction. A thrust force that is obtained by integrating a roll-axis-direction component of the frictional force vector in the roll bite is therefore about 5%, which is significantly smaller than the friction coefficient. Accordingly, in a case of a normal rolling mill in which its work rolls 1 and 2 are not actively crossed, an inter-roll cross angle that can be produced due to a gap between a roll chock and a housing is generally 0.1° or less. The thrust force $T_{MW}$ acting between the rolled material S and the work rolls 1 and 2 therefore can be ignored.

Equations available to determining the five unknowns include two equilibrium conditional expressions relating to the forces of the upper work roll 1 and the upper backup roll 3 in the roll-axis direction and two equilibrium conditional expressions relating to the moments of the upper work roll 1 and the upper backup roll 3, four in total. Since there are five unknowns for these four equations, it is necessary to measure or identify one unknown to determine all of the unknowns. Also in this case, a practical solution is to identify beforehand working point positions of thrust counterforces that act on upper backup roll chocks 7*a* and 7*b*, as in the identification processing of the thrust counterforce working point positions of the backup rolls 3 and 4. In this case, all of the unknowns can be determined by solving the equilibrium conditional expressions relating to the forces and the moments of the rolls for the remaining four unknowns. After the unknowns are determined, deformation of an upper roll assembly can be calculated accurately including asymmetrical deformation between the work side and the drive side.

For a lower roll assembly, a difference between the work side and the drive side in distribution of line loads between the rolled material S and the work roll 2 is already determined. This difference is the same in the upper and lower roll assemblies according to equilibrium conditions of forces acting on the rolled material S. Therefore, deformation of the lower roll assembly can be calculated including asymmetrical deformation between the work side and the drive side in distribution of line loads between the lower work roll 2 and the lower backup roll 4. Equations applicable to solve the problem include two equilibrium conditional expressions relating to the forces in the roll-axis direction and the moments of each of the lower work roll 2 and the lower backup roll 4, four in total. For example, in a case where neither the thrust counterforces nor the backup roll counterforces of the lower roll assembly can be measured, unknowns involved in the equations are six unknowns: $T_B^B$, $T_{WB}^B$, $T_W^B$, $p^{df}_{WB}{}^B$, $P_{df}^B$, and $h_B^B$.

Of these, in a case where working point positions of thrust counterforces acting on lower backup roll chocks 8*a* and 8*b* can be identified beforehand, the number of the unknowns is five. In addition, in a case of a well-maintained rolling mill, the thrust force $T_{WB}^B$ acting between the lower work roll 2 and the lower backup roll 4 may be small enough to be ignored. In this case, the remaining unknowns can be all determined by assuming the thrust force $T_{WB}^B$ to be zero. Even in a case where such conditions are not established, the remaining unknowns can be all determined by making known or actually measuring at least one of the unknowns. Preferably, if differences in the thrust counterforce and the backup roll counterforce of the work roll 2 between the work side and the drive side can be measured for the lower roll assembly, the number of the unknowns falls below the number of the equations. In this case, calculation with higher accuracy can be performed by obtaining solutions of least squares.

(For Six-High Rolling Mill)

In a normal six-high rolling mill illustrated in FIG. 10B, thrust counterforces in the roll-axis direction acting on its upper and lower work rolls 1 and 2 and the intermediate rolls 31 and 32 are measured, and backup roll counterforces acting in the vertical direction on its upper backup roll 3 at its reduction support positions are measured. At this time, unknowns of forces involved in the equilibrium conditional expressions relating to the forces in the roll-axis direction and the moments acting on the upper work roll 1, the upper intermediate roll 31, and the upper backup roll 3 are seven unknowns: $T_B^T$, $T_{IB}^T$, $T_{WI}^T$, $p^{df}_{IB}{}^T$, $p^{df}_{WI}{}^T$, $p^{df}$, and $h_B^T$. These unknowns do not include the thrust force $T_{MW}$ acting between the rolled material S and the work rolls 1 and 2 since the thrust force $T_{MW}$ has a magnitude small enough to be ignored, as described in the case of the four-high rolling mill.

Equations available to determining the seven unknowns include three equilibrium conditional expressions relating to the forces of the upper work roll 1, the upper intermediate roll 31, and the upper backup roll 3 in the roll-axis direction and three equilibrium conditional expressions relating to the moments of the upper work roll 1, the upper intermediate roll 31, and the upper backup roll 3, six in total. Since there are seven unknowns for these six equations, it is necessary to measure or identify one unknown to determine all of the unknowns. Also in this case, a practical solution is to identify beforehand working point positions of thrust counterforces that act on upper backup roll chocks 7*a* and 7*b*, as in the identification processing of the thrust counterforce working point positions of the backup rolls 3 and 4. In this case, all of the unknowns can be determined by solving the equilibrium conditional expressions relating to the forces and the moments of the rolls for the remaining six unknowns. After the unknowns are determined, deformation of an upper roll assembly can be calculated accurately including asymmetrical deformation between the work side and the drive side.

For a lower roll assembly, a difference between the work side and the drive side in distribution of line loads between the rolled material S and the work roll 2 is already determined. This difference is the same in the upper and lower roll assemblies according to equilibrium conditions of forces acting on the rolled material S. Therefore, deformation of the lower roll assembly can be calculated accurately including asymmetrical deformations between the work side and the drive side in distribution of line loads between the lower work roll 2 and the lower intermediate roll 32 and between the lower intermediate roll 32 and the lower backup roll 4. Equations applicable to solve the problem include two equilibrium conditional expressions relating to the forces in the roll-axis direction and the moments of each of the lower work roll 2, the lower intermediate roll 32, and the lower backup roll 4, six in total. For example, in a case where neither the thrust counterforces nor the backup roll counterforces of the lower roll assembly can be measured, unknowns involved in the equations are nine unknowns: $T_W^B$, $T_I^B$, $T_B^B$, $T_{WI}^B$, $T_{IB}^B$, $p^{df}_{WI}{}^B$, $p^{df}_{IB}{}^B$, $p_{df}^B$, and $h_B^B$.

Of these, in a case where working point positions of thrust counterforces acting on lower backup roll chocks 8*a* and 8*b* can be identified beforehand, the number of the unknowns is eight. In addition, in a case of a well-maintained rolling mill, the thrust forces $T_{WI}^B$ and $T_{IB}^B$ acting between the lower work roll 2 and the lower intermediate roll 32 and acting between the lower intermediate roll 32 and the lower backup roll 4, respectively, may be small enough to be ignored. In this case, the remaining unknowns can be all determined by assuming the thrust forces $T_{WI}^B$ and $T_{IB}^B$ to be zero. Even in a case where such conditions are not established, the remaining unknowns can be all determined by making known or actually measuring at least two of the unknowns. Preferably, if differences between the work side and the drive side in the thrust counterforces and the backup roll counterforces of the work roll 2 and the intermediate roll 32 of the lower roll assembly can be measured, the number of the unknowns falls below the number of the equations. In this case, calculation with higher accuracy can be performed by obtaining solutions of least squares.

After the unknowns are determined, deformation of a lower roll assembly can be also calculated accurately including asymmetrical deformation between the work side and the drive side. As a result, asymmetries between the work side and the drive side in gaps of the upper and lower work rolls 1 and 2 can be calculated accurately by summing roll deformations of the upper and lower roll assemblies, superposing the sum on deformation characteristics of a housing-pressing-down system that is calculated in a form of a function of the backup roll counterforces, and taking a current reduction position into consideration. This enables calculation of a plate thickness wedge that results from deformation of the rolling mill.

After the preparations described above are made, a target value of the reduction position control input, particularly the leveling control input, for providing a target value of the plate thickness wedge required from a viewpoint of zigzagging control or camber control can be computed. By performing the reduction position control based on this target value, occurrence of zigzagging or camber can be suppressed with high accuracy.

Note that in a case where the upper and lower roll assemblies are switched in the above description, the reduction position control can be performed totally in the same manner.

Specifically, the reduction position control during rolling can be performed as follows. The following processing is performed by, for example, the arithmetic device 21 illustrated in FIG. 1A or FIG. 1B.

(i. In a Case where Thrust Counterforces of all of the Rolls Other than the Backup Rolls can be Measured)

First, processing in a rolling mill of four-high or more in which thrust counterforces of all of its rolls other than its backup rolls can be measured will be described. As illustrated in FIG. 11A, first, the backup roll counterforces acting on the upper and lower backup rolls 3 and 4 at their reduction support positions during rolling and the thrust counterforces acting on all of the rolls other than the upper and lower backup rolls 3 and 4 are measured (S31*a*). The thrust counterforces are measured on the upper work roll 1 and the lower work roll 2 in the case of a four-high rolling mill and measured on the upper work roll 1 and the lower work roll 2, and the upper intermediate roll 31 and the lower intermediate roll 32 in the case of a six-high rolling mill.

Next, based on the equilibrium conditional expressions relating to the forces in the roll-axis direction acting on all of the rolls and the equilibrium conditional expressions relating to the moments acting on all of the rolls, the thrust counterforces of the backup rolls 3 and 4, the thrust counterforces acting between all of the rolls and the lateral asymmetries in distribution of line loads acting between all of the rolls, the thrust forces acting between the work rolls 1 and 2 and the rolled material S, and the lateral asymmetries in distribution of line loads acting between the work rolls 1 and 2 and the rolled material S are calculated (S32*a*). Here, between all of the rolls refers to between the work rolls and the backup rolls in the case of a four-high rolling mill and refers to between the work rolls and the intermediate rolls and between the intermediate rolls and the backup rolls in the case of a six-high rolling mill. At this time, from the model or the table that represents a correlation between rolling load and thrust counterforce working point position that is obtained by use of the method for identifying thrust counterforce working point positions of backup rolls 3 and 4 illustrated in FIG. 4A, FIG. 5, or FIG. 6A, thrust counterforce working point positions corresponding to the rolling load are specified, and based on the thrust counterforce working point positions, the values described above are computed. This enables determination of these values with high accuracy.

In a case where the model or the table is not obtained, the thrust counterforce working point positions that are identified beforehand by the method illustrated in FIG. 4A, FIG. 5, or FIG. 6A with a rolling load assumed during rolling may be used. As the assumed rolling load, for example, a rolling load that is determined by mill setting calculation may be used, or a rolling load that is assumed from an actual value corresponding to a kind of steel and plate dimensions.

In addition, based on a result of the computation in step S32*a*, deformation amounts including their lateral asymmetries of all of the rolls are calculated, and deformation characteristics of the housing-pressing-down systems of the rolling mill 100 are calculated in a form of a function of the backup roll counterforces. Then, a current plate thickness distribution of the rolled material S is computed (S33*a*). Examples of the deformation amounts of the rolls include deflections of the rolls and flatnesses of the rolls, and the deformation amounts are calculated on the work rolls 1 and 2, the intermediate rolls 31 and 32, and the backup rolls 3 and 4. In step S33*a*, a current actual value of the plate thickness distribution of the rolled material S is estimated.

Thereafter, based on a plate thickness distribution that is set as a target for the rolling mill and the current actual value of the plate thickness distribution estimated in step S33*a*, a target value of the reduction position control input is computed (S34*a*). Then, based on the target value of the reduction position control input calculated in step S34*a*, the reduction position is controlled (S35*a*).

(ii. In a Case where Thrust Counterforces of Only Either the Work Rolls or the Intermediate Rolls can be Measured in the Six-High Rolling Mill)

Next, processing in a six-high rolling mill that allows thrust counterforces of only either its work rolls or its intermediate rolls to be measured will be described. As illustrated in FIG. 11B, first, the backup roll counterforces acting on the upper and lower backup rolls 3 and 4 at their reduction support positions during rolling and the thrust counterforces acting on either the upper and lower work rolls 1 and 2 or the upper and lower intermediate rolls 31 and 32 are measured (S31*b*).

Next, based on the equilibrium conditional expressions relating to the forces in the roll-axis direction acting on all of the rolls and the equilibrium conditional expressions relating to the moments acting on all of the rolls, the thrust counterforces of the backup rolls 3 and 4, the thrust counterforces of either the work rolls 1 and 2 or the intermediate rolls 31 and 32 that have not been measured, the thrust forces acting on all of the rolls (i.e., the work rolls 1 and 2, the intermediate rolls 31 and 32, and the backup rolls 3 and 4), and the lateral asymmetries in distribution of line loads acting on all of the rolls are computed (S32*b*). At this time, from the model or the table that represents a correlation between rolling load and thrust counterforce working point position that is obtained by use of the method for identifying thrust counterforce working point positions of backup rolls 3 and 4 illustrated in FIG. 4B or FIG. 6B, thrust counterforce working point positions corresponding to the rolling load are specified, and based on the thrust counterforce working point positions, the values described above are computed. This enables determination of these values with high accuracy.

In a case where the model or the table is not obtained, the thrust counterforce working point positions that are identified beforehand by the method illustrated in FIG. 4B or FIG. 6B with a rolling load assumed during rolling may be used. As the assumed rolling load, for example, a rolling load that is determined by mill setting calculation may be used, or a rolling load that is assumed from an actual value correspond to a kind of steel and plate dimensions may be used.

In addition, based on a result of the computation in step S32*b*, deformation amounts including their lateral asymmetries of all of the rolls are calculated, and deformation characteristics of the housing-pressing-down systems of the rolling mill 200 are calculated in a form of a function of the backup roll counterforces. Then, a current plate thickness distribution of the rolled material S is computed (S33*b*). Examples of the deformation amounts of the rolls include deflections of the rolls and flatnesses of the rolls, and the deformation amounts are calculated on the work rolls 1 and 2, the intermediate rolls 31 and 32, and the backup rolls 3 and 4. In step S33*b*, a current actual value of the plate thickness distribution of the rolled material S is estimated.

Thereafter, based on a plate thickness distribution that is set as a target for the rolling mill and the current actual value of the plate thickness distribution estimated in step S33*b*, a target value of the reduction position control input is computed (S34*b*). Then, based on the target value of the reduction position control input calculated in step S34*b*, the reduction position is controlled (S35*b*).

The reduction position control during rolling is described above. In the reduction position control during rolling, the method for identifying thrust counterforce working point positions of backup rolls 3 and 4 described above is used to identify the thrust counterforce working point positions of the backup rolls 3 and 4, by which the target value of the reduction position control input can be determined more accurately. As a result, the control of a reduction position of a rolling mill can be performed with high accuracy.

(2) In a Case where Asymmetry in Line Load and an Off-Center Amount is Taken into Consideration as Asymmetry in Distribution of Line Loads In the above description, only the difference in distribution of line loads between the work side and the drive side is taken into consideration as the asymmetry in distribution of line loads between the rolled material S and the work rolls 1 and 2. However, regarding the asymmetry in the roll-axis direction distribution of the line load, not only the asymmetry in line load but also a case where the rolled material S is passed with a center of the rolled material S being different from a mill center.

A distance between the center of the rolled material S and the mill center will be hereinafter referred to as an off-center amount. The off-center amount is basically confined within a predetermined allowance by side guides provided on an entrance side of the rolling mill 100. Nevertheless, if a considerable off-center amount can occur, for example, the off-center amount is preferably estimated from a measured value from a zigzagging sensor installed on the entrance side or a delivery side of the rolling mill 100. Moreover, if the zigzagging sensor cannot be installed, and moreover the considerable off-center amount can occur, the off-center amount can be determined by adopting, for example, the following method.

It is impossible to isolate and extract two unknowns the off-center amount and two unknowns of the off-center amount and the difference between the work side and the drive side in the distribution of line loads between the rolled material S and the work rolls 1 and 2, from the equilibrium conditional expressions relating to the moments of the work rolls 1 and 2. Hence, the target value of the reduction position control input is calculated for two cases: a case where the off-center amount is assumed to be zero, and only the difference in the line load between the work side and the drive side is treated as an unknown, and a case where the difference in the line load between work side and the drive side is assumed to be zero, and the off-center amount is treated as an unknown. For example, the target value of an actual reduction position control input is determined from a weighted average of computation results in both cases. How to assign weights for this is to adjust the weights as appropriate while observing rolling circumstances. As a generality, a practical method is to assign a larger weight to a computation result having a smaller reduction position control input to produce a control output, or to take the smaller control input and to multiply the control input by a tuning factor (normally 1.0 or less) to produce the control output.

In addition, in a case where the rolling mill 100 is not a four-high rolling mill but a six-high rolling mill, further including intermediate rolls, a number of inter-roll contact zones is increased by one every increase of one in a number of the intermediate rolls. Also in this case, a number of unknowns increased by measuring thrust counterforces of the intermediate rolls is two: a thrust force that acts on an increased inter-roll contact zone and a difference in distribution of line loads between the work side and the drive side. At the same time, a number of available equations is also increased by two: an equilibrium conditional expression relating to a force of the intermediate roll in the roll-axis direction and an equilibrium conditional expression of a moment of the intermediate roll; therefore, by combining the two equations with the equations relating to the other rolls, all of the equations can be solved.

In this manner, by measuring the thrust counterforces acting on all of the rolls other than at least the backup rolls, all of the unknowns including differences between the work side and the drive side in distribution of line loads acting between the rolls during rolling can be determined even in a case of a rolling mill of four-high or more. As a result, an optimum reduction position control input can be computed as in the case of a four-high rolling mill.

3. Conclusion

The method for identifying thrust counterforce working point positions of backup rolls according to the present embodiment, and the reduction position setting and the reduction position control that are performed based on the relation between the rolling load and the thrust counterforce working point positions identified by this method are described above. According to the present embodiment, a first step of measuring, at a plurality of levels, the thrust counterforces in the roll-axis direction acting on rolls forming at least any one of roll pairs other than the roll pair of the backup rolls and measuring the backup roll counterforces acting in the vertical direction on the backup rolls at the reduction support positions of the backup rolls, in the kiss roll state in which the rolls are brought into tight contact by the pressing-down device, and a second step of identifying, based on the measured thrust counterforces acting on the rolls, thrust counterforce working point positions of thrust counterforces acting on the backup rolls, using first equilibrium conditional expressions relating to forces acting on the rolls and second equilibrium conditional expressions relating to moments produced in the rolls are performed. This enables the identification of thrust counterforce working point positions of backup rolls to be easily performed even in a time other than a time of changing work rolls such as an idling time of a rolling mill.

By the identification method, thrust counterforce working point positions that vary in accordance with a rolling load can be set accurately in reduction position setting and reduction position control by obtaining the relation between the kiss roll load in a kiss roll state and the thrust counterforce working point positions. As a result, the setting and control of the reduction position can be performed with high accuracy.

Examples

In stands of hot finish rolling mills having the configurations illustrated in FIG. 1A and FIG. 1B, their inter-roll cross angles were changed, and identification of their thrust counterforce working point positions was performed. For each of the stand, the method described in Patent Document 2 was used in a comparative example. That is, after rolls other than backup rolls were drawn out from the stand, thrust counterforce working point positions were identified, and the rolls were inserted into the stand. In contrast, in an inventive example, the identification of thrust counterforce working point positions was performed without taking out the rolls.

Table 1 shows results of the comparative example and the inventive example conducted in the four-high rolling mill illustrated in FIG. 1A, and Table 2 shows results of the comparative example and the inventive example conducted in the six-high rolling mill illustrated in FIG. 1B. In both cases in the four-high rolling mill and the six-high rolling mill, times of the measurement were the same in the comparative example in the inventive example. Times of changing the rolls were 70 to 80 minutes in the comparative example, whereas the times were 0 minutes in the inventive example since there was no need to take out the rolls in the inventive example. Accordingly, in the inventive example, total times of the times of changing the rolls and the times of the measurement could be significantly shortened, and a decrease in productivity was kept to a minimum.

TABLE 1

| Four-high rolling mill (FIG. 1A) | | | |
|---|---|---|---|
| | times of changing rolls (min) | times of measurement (min) | total times (min) |
| comparative example | 70 | 35 | 105 |
| inventive example | 0 | 35 | 35 |

TABLE 2

| Six-high rolling mill (FIG. 1B) | | | |
|---|---|---|---|
| | times of changing rolls (min) | times of measurement (min) | total times (分) |
| comparative example | 80 | 40 | 120 |
| inventive example | 0 | 40 | 40 |

The comparative example requires to take out the rolls other than the backup rolls to identify the thrust counterforce working point positions. Therefore, in the comparative example, changes over time that occur by the time of changing the rolls changing due to wearing of various sliding parts of the rolling mill and the like are not taken into consideration, decreasing an accuracy of the identification. In contrast, the inventive example dispenses with taking out of the rolls, and thus the thrust counterforce working point positions can be identified with the changes over time due to the wearing of various sliding parts of the rolling mill and the like taken into consideration.

A preferred embodiment of the present invention is described above with reference to the accompanying drawings, but the present invention is not limited to the above examples. It is apparent that a person skilled in the art may conceive various alterations and modifications within technical concepts described in the appended claims, and it should be appreciated that they will naturally come under the technical scope of the present invention.

REFERENCE SIGNS LIST

1 upper work roll
2 lower work roll
3 upper backup roll
4 lower backup roll
5*a* upper work roll chock (work side)
5*b* upper work roll chock (drive side)
6*a* lower work roll chock (work side)
6*b* lower work roll chock (drive side)
7*a* upper backup roll chock (work side)
7*b* upper backup roll chock (drive side)
8*a* lower backup roll chock (work side)
8*b* lower backup roll chock (drive side)
9*a* upper load sensor (work side)
9*b* upper load sensor (drive side)
10*a* lower load sensor (work side)
10*b* lower load sensor (drive side)
11 housing
12*a* press block (work side)
12*b* press block (drive side)
13*a* screw (work side)
13*b* screw (drive side)
14 pressing-down device drive mechanism
15*a* work roll shift device (upper work roll)
15*b* work roll shift device (lower work roll)
15*c* intermediate roll shift device (upper intermediate roll)
15*d* intermediate roll shift device (lower intermediate roll)
16*a* thrust counterforce measurement apparatus (upper work roll)
16*b* thrust counterforce measurement apparatus (lower work roll)
16*c* thrust counterforce measurement apparatus (upper intermediate roll)
16*d* thrust counterforce measurement apparatus (lower intermediate roll)
21 arithmetic device
23 pressing-down device drive mechanism control device
31 upper intermediate roll
32 lower intermediate roll
41*a* upper intermediate roll chock (work side)
41*b* upper intermediate roll chock (drive side)
42*a* lower intermediate roll chock (work side)
42*b* lower intermediate roll chock (drive side)
100, 200 rolling mill

The invention claimed is:

1. A method for identifying thrust counterforce working point positions in a rolling mill including a plurality of rolls that include a first set of rolls comprising a pair of work rolls and a second set of rolls comprising a pair of backup rolls supporting the pair of work rolls, the method comprising:

a first step of causing thrust forces at a plurality of levels to act between the plurality of rolls with an unchanged kiss roll load by changing at least either friction coefficients between plurality of rolls or inter-roll cross angles between the plurality of rolls, and at each of the plurality of levels, measuring thrust counterforces in a roll-axis direction acting on the first set of rolls and measuring backup roll counterforces acting in a vertical direction on the pair of backup rolls at reduction support positions in a kiss roll state in which the plurality of rolls are brought into contact by a pressing-down device; and a second step of identifying, based on the measured thrust counterforces and backup roll counterforces acting on the plurality of rolls, thrust counterforce working point positions of thrust counterforces acting on the pair of backup rolls, using first equilibrium conditional expressions relating to forces acting on the plurality of rolls and second equilibrium conditional expressions relating to moments produced in the plurality of rolls.

2. The method for identifying thrust counterforce working point positions according to claim 1, wherein in the first step, the thrust counterforces in the roll-axis direction acting on the first set of rolls are measured, and the backup roll counterforces acting in the vertical direction on the pair of backup rolls are measured at the reduction support positions.

3. The method for identifying thrust counterforce working point positions according to claim 2, wherein the rolling mill is a four-high rolling mill capable of crossing a roll-axis direction of an upper roll assembly including at least an upper work roll and an upper backup roll and a roll-axis direction of a lower roll assembly including at least a lower work roll and a lower backup roll, and in the first step, the thrust forces at the plurality of levels are caused to act between the plurality of rolls by changing an inter-roll cross angle between the upper work roll and the lower work roll.

4. The method for identifying thrust counterforce working point positions according to claim 2, wherein the rolling mill includes external-force applying devices that apply different rolling-direction external forces to a work-side roll chock and a drive-side roll chock of at least one roll of the plurality of rolls, and in the first step, by applying different rolling-direction external forces to the work-side roll chock and the drive-side roll chock of the at least one roll including the external-force applying devices, the inter-roll cross angle of the at least one roll is changed with respect to an adjacent roll of the plurality of rolls to cause the thrust forces at the plurality of levels to act between the at least one roll and the adjacent roll.

5. The method for identifying thrust counterforce working point positions according to claim 1, wherein in the second step, based on a result of identifying the thrust counterforce working point positions of the pair of backup rolls at the plurality of levels of thrust force, a relation between the kiss roll load and the thrust counterforce working point positions is acquired in a kiss roll state at each of a plurality of levels of the kiss roll load.

6. A method for rolling a rolled material, comprising:

identifying the thrust counterforce working point positions of the pair of backup rolls by the method for identifying thrust counterforce working point positions according to claim 2;

measuring the thrust counterforces in the roll-axis direction acting on the first set of rolls and measuring the backup roll counterforces acting in the vertical direction on the pair of backup rolls at the reduction support positions of the pair of backup rolls, in the kiss roll state in which the plurality of rolls are brought into contact by the pressing-down device;

computing at least either a zero point position of the pressing-down device or a deformation characteristic of the rolling mill based on measured values of the thrust counterforces, measured values of the backup roll counterforces, and the identified thrust counterforce working point positions of the pair of backup rolls; and setting a reduction position for the pressing-down device for performing rolling, based on a result of the computation.

7. A method for rolling a rolled material, comprising:

identifying the thrust counterforce working point positions of the pair of backup rolls beforehand by the method for identifying thrust counterforce working point positions according to claim 2;

during rolling the rolled material, measuring a thrust counterforce in a roll-axis direction acting on a roll other than a backup roll in at least either an upper roll assembly including an upper work roll and an upper backup roll or a lower roll assembly including a lower work roll and a lower backup roll, and measuring backup roll counterforces acting in the vertical direction on a backup roll at reduction support positions for at least a roll assembly for which the thrust counterforce is measured;

computing a target value of a reduction position control input corresponding to a rolling load based on measured values of the thrust counterforces, measured values of the backup roll counterforces, and the identified thrust counterforce working point positions of the pair of backup rolls; and controlling a reduction position using the pressing-down device based on the target value of the reduction position control input.

8. A method for rolling a rolled material, comprising:

identifying the thrust counterforce working point positions of the pair of backup rolls beforehand by the method for identifying thrust counterforce working point positions according to claim 2;

during rolling the rolled material, measuring a thrust counterforce in a roll-axis direction acting on a roll other than a backup roll in at least either an upper roll assembly including an upper work roll and an upper backup roll or a lower roll assembly including a lower work roll and a lower backup roll, and measuring backup roll counterforces acting in the vertical direction on a backup roll at reduction support positions for at least a roll assembly for which the thrust counterforce is measured;

computing an asymmetry in roll-axis direction distribution of a rolling load acting between the rolled material and the pair of work rolls, with at least a thrust force acting between a backup roll and a roll being in contact with the backup roll taken into consideration, based on the measured values of the thrust counterforces, the measured values of the backup roll counterforces, and the identified thrust counterforce working point positions of the pair of backup rolls, and computing a target value of a reduction position control input corresponding to the rolling load, based on a result of the computation; and controlling the reduction position using the pressing-down device based on the target value of the reduction position control input.

9. The method for identifying thrust counterforce working point positions according to claim 1, wherein the first set of rolls includes a pair of intermediate rolls, and in the first step, thrust counterforces in the roll-axis direction acting on the first set of rolls are measured, and the backup roll counterforces acting in the vertical direction on the pair of backup rolls are measured at the reduction support positions.

10. The method for identifying thrust counterforce working point positions according to claim 9, wherein the rolling mill includes external-force applying devices that apply different rolling-direction external forces to a work-side roll chock and a drive-side roll chock of at least one roll of the plurality of rolls, and in the first step, by applying different rolling-direction external forces to the work-side roll chock and the drive-side roll chock of the at least one roll including the external-force applying devices, the inter-roll cross angle of the at least one roll is changed with respect to an adjacent roll of the plurality of rolls to cause the thrust forces at the plurality of levels to act between the at least one roll and the adjacent roll.

11. The method for identifying thrust counterforce working point positions according to claim 9, wherein in the second step, based on a result of identifying the thrust counterforce working point positions of the pair of backup rolls at the plurality of levels of thrust force, a relation between the kiss roll load and the thrust counterforce working point positions is further acquired in the kiss roll state at each of a plurality of levels of the kiss roll load.

12. A method for rolling a rolled material, comprising:

identifying the thrust counterforce working point positions of the pair of backup rolls by the method for identifying thrust counterforce working point positions according to claim 9;

measuring the thrust counterforces in the roll-axis direction acting the pair of intermediate rolls or the pair of work rolls and measuring the backup roll counterforces acting in the vertical direction on the pair of backup rolls at the reduction support positions, in the kiss roll state in which the plurality of rolls are brought into contact by the pressing-down device;

computing at least either a zero point position of the pressing-down device or a deformation characteristic of the rolling mill based on measured values of the thrust counterforces, measured values of the backup roll counterforces, and the identified thrust counterforce working point positions of the pair of backup rolls; and setting a reduction position for the pressing-down device for performing rolling, based on a result of the computation.

13. A method for rolling a rolled material, comprising:

identifying the thrust counterforce working point positions of the pair of backup rolls beforehand by the method for identifying thrust counterforce working point positions according to claim 9;

during rolling the rolled material, measuring a thrust counterforce in a roll-axis direction acting on a roll of the first set of rolls in an upper roll assembly including an upper work roll, an upper intermediate roll, and an upper backup roll or a lower roll assembly including a lower work roll, a lower intermediate roll, and a lower backup roll, and measuring backup roll counterforces acting in the vertical direction on a backup roll at reduction support positions for at least a roll assembly for which the thrust counterforce is measured;

computing a target value of a reduction position control input corresponding to a rolling load based on the measured values of the thrust counterforces, the measured values of the backup roll counterforces, and the identified thrust counterforce working point positions of the pair of backup rolls; and controlling a reduction position using the pressing-down device based on the target value of the reduction position control input.

14. A method for rolling a rolled material, comprising:

identifying the thrust counterforce working point positions of the pair of backup rolls beforehand by the method for identifying thrust counterforce working point positions according to claim 9;

during rolling the rolled material, measuring a thrust counterforce in a roll-axis direction acting on a roll of the first set of rolls in an upper roll assembly including an upper work roll, an upper intermediate roll, and an upper backup roll or a lower roll assembly including a lower work roll, a lower intermediate roll, and a lower backup roll, and measuring backup roll counterforces acting in the vertical direction on a backup roll at reduction support positions for at least a roll assembly for which the thrust counterforce is measured;

computing an asymmetry in roll-axis direction distribution of a rolling load acting between the rolled material and the pair of work rolls with at least a thrust force acting between a backup roll and a roll being in contact with the backup roll taken into consideration based on the measured values of the thrust counterforces, the measured values of the backup roll counterforces, and the identified thrust counterforce working point positions of the pair of backup rolls, and computing a target value of a reduction position control input corresponding to the rolling load based on a result of the computation; and controlling the reduction position using the pressing-down device based on the target value of the reduction position control input.

* * * * *